US009731176B2

(12) United States Patent
Issertell et al.

(10) Patent No.: US 9,731,176 B2
(45) Date of Patent: Aug. 15, 2017

(54) GOLF CLUB

(71) Applicant: Taylor Made Golf Company, Inc., Carlsbad, CA (US)

(72) Inventors: Jason W. Issertell, Carlsbad, CA (US); Joshua J. Dipert, Carlsbad, CA (US); Bret H. Wahl, Escondido, CA (US); Maresala Milo, San Diego, CA (US); Zac Atwell, Carlsbad, CA (US); Scott Taylor, Bonita, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 14/981,330

(22) Filed: Dec. 28, 2015

(65) Prior Publication Data

US 2016/0193508 A1 Jul. 7, 2016

Related U.S. Application Data

(63) Continuation of application No. 14/843,856, filed on Sep. 2, 2015.

(60) Provisional application No. 62/099,012, filed on Dec. 31, 2014, provisional application No. 62/098,707, filed on Dec. 31, 2014.

(51) Int. Cl.

| | |
|---|---|
| ***A63B 53/02*** | (2015.01) |
| ***A63B 53/04*** | (2015.01) |
| ***A63B 60/52*** | (2015.01) |

(52) U.S. Cl.

CPC ..... *A63B 53/047* (2013.01); *A63B 53/02* (2013.01); *A63B 53/0475* (2013.01); *A63B 60/52* (2015.10); *A63B 2053/023* (2013.01); *A63B 2053/045* (2013.01); *A63B 2053/0408* (2013.01); *A63B 2053/0433* (2013.01); *A63B 2053/0437* (2013.01)

(58) Field of Classification Search

CPC ..... A63B 53/047; A63B 2053/0408; A63B 2053/025; A63B 2053/023; A63B 53/02; A63B 2071/0694; A63B 2053/026; A63B 53/0475; A63B 60/52; A63B 2053/0433; A63B 2053/045; A63B 2053/0437

USPC ..... 473/305–315, 244–248

See application file for complete search history.

(56) References Cited

U.S. PATENT DOCUMENTS

| | | | | |
|---|---|---|---|---|
| 796,802 | A * | 8/1905 | Brown | A63B 53/02 279/93 |
| 1,026,181 | A | 5/1912 | Seely | |
| 1,266,529 | A * | 5/1918 | Mattern | A63B 53/02 473/312 |

(Continued)

FOREIGN PATENT DOCUMENTS

| | | |
|---|---|---|
| JP | 2004-351173 | 12/2004 |

*Primary Examiner* — Sebastiano Passaniti

(74) *Attorney, Agent, or Firm* — Klarquist Sparkman, LLP

(57) ABSTRACT

Disclosed herein are embodiments of iron-type golf club heads that comprise weight reducing features in the topline region of the club head that facilitate changing the Z-up location of the club head. In some exemplary embodiments, the body comprises a weight reducing feature in a topline weight reduction zone of the club head that extends over the entire face length from the par line to the toe portion ending at approximately the Z-up location of the iron type golf club head. The weight reducing feature results in a mass savings of about 2 g to about 20 g, and a Zup shift of about 0.5 mm to about 2.0 mm.

21 Claims, 32 Drawing Sheets

(56) References Cited

U.S. PATENT DOCUMENTS 1,695,291 A * 12/1928 Muller ..... A63B 53/02 473/308
1,778,122 A * 10/1930 Pedersen ..... A63B 53/02 473/308
1,892,482 A * 12/1932 Cash, Jr. ..... A63B 53/02 473/305
1,983,158 A 12/1934 Young
2,363,991 A * 11/1944 Reach ..... A63B 53/02 473/306
2,470,406 A * 5/1949 Matzie ..... A63B 53/02 473/308
3,191,936 A 6/1965 Guier
3,572,709 A * 3/1971 Risher ..... A63B 53/02 403/23
3,909,005 A 9/1975 Piszel
4,512,577 A * 4/1985 Solheim ..... A63B 53/04 473/290
4,655,457 A 4/1987 Thompson
5,184,819 A 2/1993 Desbiolles
5,244,205 A 9/1993 Melanson et al.
5,324,033 A * 6/1994 Fenton, Jr. ..... A63B 53/02 473/305
5,395,109 A * 3/1995 Fenton, Jr. ..... A63B 53/02 473/291
D361,358 S * 8/1995 Simmons ..... D21/750
5,451,048 A * 9/1995 Magamoto ..... A63B 53/02 473/324
5,513,844 A 5/1996 Ashcraft et al.
5,626,528 A 5/1997 Toulon
5,647,807 A * 7/1997 Nagamoto ..... A63B 53/02 473/305
D401,653 S * 11/1998 Burrows ..... D21/753
D401,655 S * 11/1998 Burrows ..... D21/753
D401,656 S * 11/1998 Burrows ..... D21/753
5,839,973 A 11/1998 Jackson
6,186,903 B1 2/2001 Beebe et al.
6,231,455 B1 5/2001 Chang
6,287,215 B1 9/2001 Fisher
6,368,230 B1 4/2002 Helmstetter et al.
6,422,950 B1 * 7/2002 Whitlam ..... A63B 53/0487 473/313
6,431,993 B1 8/2002 Dyer
6,475,100 B1 * 11/2002 Helmstetter ..... A63B 53/02 473/309
D478,951 S * 8/2003 Burrows ..... D21/759
6,752,726 B2 * 6/2004 Burrows ..... A63B 53/02 473/309
D506,798 S * 6/2005 Burrows ..... D21/759
7,077,763 B2 7/2006 Wahl et al.
7,438,645 B2 10/2008 Hsu
D637,675 S * 5/2011 Evans ..... D21/759
D686,679 S 7/2013 Greensmith et al.
D692,077 S 10/2013 Greensmith et al.
D696,366 S 12/2013 Milo et al.
D696,367 S 12/2013 Taylor et al.
D697,152 S 1/2014 Harbert et al.
8,684,859 B1 4/2014 Aguinaldo et al.
8,715,102 B1 5/2014 Aguinaldo et al.
8,932,147 B2 * 1/2015 Jertson ..... A63B 53/02 473/246
9,044,653 B2 6/2015 Wahl et al.
9,132,323 B2 9/2015 Beach et al.
9,308,430 B2 * 4/2016 Nivanh ..... A63B 53/00
D757,871 S * 5/2016 Dipert ..... D21/747
2003/0176235 A1 * 9/2003 Burrows ..... A63B 53/02 473/305
2004/0116202 A1 * 6/2004 Lin ..... A63B 60/54 473/306
2008/0102976 A1 * 5/2008 Chen ..... A63B 43/02 473/305
2008/0102977 A1 * 5/2008 Huang ..... A63B 53/02 473/305
2010/0279787 A1 11/2010 Stites et al.
2010/0323808 A1 * 12/2010 Sato ..... A63B 53/02 473/307
2011/0319185 A1 12/2011 Beach et al.
2014/0274444 A1 * 9/2014 Solheim ..... A63B 53/02 473/307
2014/0274457 A1 9/2014 Beach et al.
2015/0375065 A1 12/2015 Beach et al.
2016/0008674 A1 * 1/2016 Cackett ..... A63B 53/02 473/305
2016/0184663 A1 * 6/2016 Nivanh ..... A63B 53/00 473/309

* cited by examiner

MODE1

FREQUENCY (Hz)
3056
GV (m/s)
12.07
KE (mJ)
1498
DAMPING
0.025
TAU (ms)
6.5

GOLF CLUB

CROSS REFERENCE TO RELATED APPLICATION

This application is a continuation-in-part of U.S. patent application Ser. No. 14/843,856, filed Sep. 2, 2015, which is incorporated herein by reference. This application claims the benefit of U.S. Provisional Application No. 62/099,012, which was filed on Dec. 31, 2014, and is incorporated herein by reference in its entirety. This application claims the benefit of U.S. Provisional Application No. 62/098,707, which was filed on Dec. 31, 2014, and is incorporated herein by reference in its entirety. This application references U.S. patent application Ser. No. 14/145,761, entitled "GOLF CLUB," filed Dec. 31, 2013, which claims priority to U.S. Provisional Application No. 61/903,185, entitled "GOLF CLUB," filed Nov. 12, 2013, both of which are hereby incorporated by reference herein in their entireties. This application also references U.S. patent application Ser. No. 13/830,293, entitled "IRON TYPE GOLF CLUB HEAD," filed Mar. 14, 2013, which claims priority to U.S. Provisional Application No. 61/657,675, entitled "IRON TYPE GOLF CLUB HEAD," filed Jun. 8, 2012, both of which are hereby incorporated by reference herein in their entireties. This application also references U.S. Pat. No. 8,353,786, entitled "GOLF CLUB HEAD," filed Dec. 28, 2007, which is incorporated by reference herein in its entirety and with specific reference to discussion of variable face thickness of golf club heads.

TECHNICAL FIELD

This disclosure pertains to iron-type golf club heads, iron-type golf clubs, and sets of iron-type golf clubs. More particularly the present disclosure relates to iron-type golf club heads with a lightweight topline and/or lightweight hosel.

BACKGROUND

The performance of golf equipment is continuously advancing due to the development of innovative clubs and club designs. While all clubs in a golfer's bag are important, both scratch and novice golfers rely on the performance and feel of their irons for many commonly encountered playing situations.

Irons are generally configured in a set that includes clubs of varying loft, with shaft lengths and clubhead weights selected to maintain an approximately constant "swing weight" so that the golfer perceives a common "feel" or "balance" in swinging both the low irons and high irons in a set. The size of an iron's "sweet spot" is generally related to the size (i.e., surface area) of the iron's striking face, and iron sets are available with oversize club heads to provide a large sweet spot that is desirable to many golfers.

Conventional "blade" type irons have been largely displaced (especially for novice golfers) by so-called "perimeter weighted" irons, which include "cavity-back" and "hollow" iron designs. Cavity-back irons have a cavity directly behind the striking plate, which permits club head mass to be distributed about the perimeter of the striking plate, and such clubs tend to be more forgiving to off-center hits. Hollow irons have features similar to cavity-back irons, but the cavity is enclosed by a rear wall to form a hollow region behind the striking plate. Perimeter weighted, cavity back, and hollow iron designs permit club designers to redistribute club head mass to achieve intended playing characteristics associated with, for example, placement of club head center of gravity or a moment of inertia.

In addition, even with perimeter weighting, significant portions of the club head mass, such as the mass associated with the hosel, topline, or striking plate, are unavailable for redistribution. The striking plate must withstand repeated strikes both on the driving range and on the course, requiring significant strength for durability.

Golf club manufacturers are consistently attempting to design golf clubs that are easier to hit and offer golfers greater forgiveness when the ball is not struck directly upon the sweet spot of the striking face. As those skilled in the art will certainly appreciate, many designs have been developed and proposed for assisting golfers in learning and mastering the very difficult game of golf.

With regard to iron type club heads, cavity back club heads have been developed. Cavity back golf clubs shift the weight of the club head toward the outer perimeter of the club. By shifting the weight in this manner, the center of gravity of the club head is pushed toward the sole of the club head, thereby providing a club head that is easier to use in striking a golf ball. In addition, weight is shifted to the toe and heel of the club head, which helps to expand the sweet spot and assist the golfer when a ball is struck slightly off center.

Shifting weight to the sole lowers the center of gravity (CG) of the club resulting in a club that launches the ball more easily and with greater backspin. Golf club designers may measure the vertical CG of the golf club relative to the ground when the golf club is soled and in the proper address position, this CG measurement will be referred to as Zup or Z-up or CG Z-up. Decreasing Z-up as opposed to increasing it is preferable. Golf club designers can use a golf club with a low Z-up to design clubs for both low and high handicap golfers by either making a golf club that maintains similar launch angles but increases ball speed and distance or a club that launches the ball more easily in the air. Higher handicap golfers typically have trouble launching the ball in the air so a club that gets the ball in the air more easily is a great benefit. For lower handicap golfers, launching the ball in the air is not typically an issue. For lower handicap golfers, golf club designers may strengthen the loft of the golf club to maintain similar launch conditions and similar amounts of backspin, but resulting in greater ball speed and distance gains of several yards. The result is better golfers may now use one less club when approaching a green, such as, for example, a golfer may now use a 7-iron instead of a 6-iron to hit a green. Placing weight at the toe increases the moment of inertia (MOI) of the golf club resulting in a club that resists twisting and is thereby easier to hit straight even on mishits.

As club manufacturers have learned to assist golfers by shifting the center of gravity toward the sole of the club head, a wide variety of designs have been developed. Unfortunately, many of these designs substantially alter the appearance of the club head while attempting to shift the center of gravity toward the sole and perimeter of the club head. For example, one method of lowering the CG is to simply decrease the face height at the toe and make it closer in height to the face height at the heel of the club resulting in a very untraditional looking club. This is highly undesirable as golfers become familiar with a certain style of club head and alteration of that style often adversely affects their mental outlook when standing above a ball and aligning the club head with the ball. As such, a need exists for an improved club head which achieves the goal of shifting the center of gravity further toward the sole and perimeter of the club head without substantially altering the appearance of a traditional cavity back club head with which golfers have become comfortable. The present invention provides such a club head.

Unfortunately, an additional problem arises from relocating mass on a golf club in that the acoustical properties of the golf club head is often negatively impacted. The acoustical properties of golf club heads, e.g., the sound a golf club head generates upon impact with a golf ball, affect the overall feel of a golf club by providing instant auditory feedback to the user of the club. For example, the auditory feedback can affect the feel of the club by providing an indication as to how well the golf ball was struck by the club, thereby promoting user confidence in the club and himself.

The sound generated by a golf club is based on the rate, or frequency, at which the golf club head vibrates and the duration of the vibration upon impact with the golf ball. Generally, for iron-type golf clubs, a desired first mode frequency is generally around 3,000 Hz and preferably greater than 3,200 Hz. A frequency less than 3,000 Hz may result in negative auditory feedback and thus a golf club with an undesirable feel. Additionally, the duration of the first mode frequency is important because a longer duration results in a ringing sound and/or feel, which feels like a mishit or a shot that is not solid. This results in less confidence for the golfer even on well struck shots. Generally, for iron-type golf clubs, a desired first mode frequency duration is generally less than 10 ms and preferably less than 7 ms.

Accordingly, it would be desirable to reduce the topline weight to shift the CG to the sole and/or toe while maintaining acceptable vibration frequencies and durations. Such a club would be easier to hit because it would launch the ball more easily (low CG) and/or hit the ball straighter even on mishits (increased MOI), and the club would still provide desirable feel through positive auditory feedback. Accordingly, there exists a need for iron-type golf club heads with a strong and lightweight topline.

Golf clubs are typically manufactured with standard lie and loft angles. Some golfers prefer to modify the lie and loft angles of their golf clubs in order to improve the performance and consistency of their golf clubs and thereby improve their own performance.

In some cases, golf club heads, particularly iron-type golf club heads, can be adjusted by being plastically bent in a post-manufacturing process. In such a bending process, it can be difficult to plastically bend the material of the club head in a desired manner without adversely affecting the shape or integrity of the hosel bore, the striking face, or other parts of the club head. In addition, advancements in materials and manufacturing processes, such as extreme heat treatments, have resulted in club heads that are stronger and harder to bend and have more sensitive surface finishes. This increases the difficulty in accurately bending a club head in a desired manner without adversely affecting the club head. Additionally, the iron-type club heads must have a hosel design that will allow for bending. Bending bars are used for bending golf club heads to a golfer's preferred loft and lie. The bending process requires a significant amount of force and/or torque to plastically deform the iron-type club head. It can be difficult to plastically bend the club head in a desired manner without adversely affecting the shape or integrity of the hosel bore, the striking face, or other parts of the club head. As a result the hosel must have significant structural integrity to withstand multiple bending sessions and repeated strikes at the range and the golf course. The risk of club failure makes for a challenging design problem and makes the mass associated with the hosel largely unavailable for redistribution. Accordingly, there exists a need for iron-type golf club heads with strong and lightweight hosels.

SUMMARY

Disclosed herein are embodiments of iron-type golf club heads that comprise topline features that allow for removal and/or redistribution of mass from the topline to the sole and/or toe of an iron type golf club.

In some exemplary embodiments, an iron-type golf club head includes a hosel, a body including a heel portion, a sole portion, a toe portion, a topline portion, and a face portion. The iron-type golf club head further includes a weight reducing feature in a topline weight reduction zone of the club head that extends over the entire face length from the par line to the toe portion ending at approximately the Z-up location of the iron type golf club head. The weight reducing feature results in a mass savings of about 2 g to about 20 g, and a Zup shift of about 0.5 mm to about 2.0 mm.

In some exemplary embodiments, an iron-type golf club head includes a hosel, a body including a heel portion, a sole portion, a toe portion, a topline portion, and a face portion. The iron-type golf club head further includes a topline weight reduction zone that includes weight reducing features that yield a mass per unit length within the topline weight reduction zone of between about 0.09 g/mm to about 0.40 g/mm, such as between about 0.09 g/mm to about 0.35 g/mm, such as between about 0.09 g/mm to about 0.30 g/mm, such as between about 0.09 g/mm to about 0.25 g/mm, such as between about 0.09 g/mm to about 0.20 g/mm, or such as between about 0.09 g/mm to about 0.17 g/mm. In some embodiments, the topline weight reduction zone yields a mass per unit length within the weight reduction zone less than about 0.25 g/mm, such as less than about 0.20 g/mm, such as less than about 0.17 g/mm, such as less than about 0.15 g/mm, or such as less than about 0.10 g/mm. The iron-type golf club has a topline made from a metallic material having a density between about 7,700 kg/m$^3$ and about 8,100 kg/m$^3$.

In some exemplary embodiments, an iron-type golf club head includes a hosel, a body including a heel portion, a sole portion, a toe portion, a topline portion, and a face portion. The iron-type golf club head further includes a hosel having a hosel top edge, a bond length region, an outside diameter and the hosel containing a bore for receiving one end of a golf club shaft, said bore having a longitudinal axis and a desired orientation relative to said body, said hosel having a neck connected to the heel portion of the body. Additionally, the bond length region of the hosel extends from about the hosel top edge along the longitudinal axis of the hosel bore to a point on the hosel that is at least 10 mm from the hosel top edge, wherein within the bond length region the hosel has a mass per unit length of less than about 0.45 g/mm.

In other embodiments, the iron-type golf club head hosel has a mass per unit length of less than about 0.40 g/mm within the bond length region. In other embodiments, the iron-type golf club head hosel has a mass per unit length of less than about 0.35 g/mm within the bond length region. In other embodiments, the iron-type golf club head hosel has a mass per unit length of less than about 0.30 g/mm within the bond length region. In other embodiments, the iron-type golf club head hosel has a mass per unit length of less than about 0.26 g/mm within the bond length region. In some embodiments, the iron-type golf club head has a hosel having a density between about 7,700 kg/m$^3$ and about 8,100 kg/m$^3$.

In some exemplary embodiments, an iron-type golf club head includes a golf club body, the golf club body including a hosel, a top line portion, a toe portion, a heel portion, and a sole portion, wherein the hosel has a hosel top edge, a hosel length, a bond length region, and the hosel defining a bore. The iron-type golf club head further includes a striking face connected to the golf club body, the striking face including a striking surface defining a plurality of grooves. Additionally, the bond length region is offset from the hosel top edge along a longitudinal axis of the hosel bore by about 0 mm to about 5 mm, and the hosel bond length region extends along the longitudinal axis of the hosel bore toward the heel portion for about 20 mm to about 30 mm. Furthermore, a top portion of the hosel has a length of about 28.0 mm and a mass of less than about 12.5 grams.

In other embodiments, the top portion of the hosel has a mass of less than about 12.0 grams. In other embodiments, the top portion of the hosel has a mass less than about 11.5 grams. In other embodiments, the top portion of the hosel has a mass less than about 11.0 grams. In other embodiments, the top portion of the hosel has a mass less than about 10.5 grams. In other embodiments, the top portion of the hosel has a mass less than about 10.0 grams. In other embodiments, the top portion of the hosel has a mass less than about 9.5 grams. In other embodiments, the hosel has a density between about 7,700 kg/m$^3$ and about 8,100 kg/m$^3$.

In some embodiments, the iron-type golf club head has a face portion with a toe face height of at least 50 mm and a heel face height of at least 30 mm. Additionally, the iron-type golf club head has a hosel with a length that is at least 60 mm.

Additional embodiments of iron-type golf club heads are disclosed herein that comprise features allowing continuous adjustment of the geometry of the iron-type golf club head and related methods. In some embodiments, an iron-type golf club head includes a hosel having a notch formed therein and a screw extending into the hosel and through the notch such that adjustment of the screw causes the hosel to bend at the notch. The hosel of an adjustable iron-type golf club head can include a shaft bore configured to receive a golf club shaft and an adjustment bore, wherein the screw extends from the adjustment bore, through the notch, and at least proximate to the shaft bore. In some embodiments, the shaft bore has a central longitudinal axis, the adjustment bore has a central longitudinal axis, and adjustment of the screw causes the central longitudinal axis of the shaft bore to rotate with respect to the central longitudinal axis of the adjustment bore.

In some embodiments, adjustable iron-type golf club heads can also include a body portion coupled to and extending away from the hosel, wherein adjustment of the screw causes the hosel to rotate with respect to the body portion, thereby changing either a lie angle or a loft angle of the golf club head. In some embodiments, adjustable iron-type golf club heads can include a solid piece of material situated within the shaft bore which separates a portion of the shaft bore which can receive the screw and a portion of the shaft bore which can receive a golf club shaft.

Adjustable iron-type golf club heads can also include a threaded boss element coupled to the hosel at a distal end portion of the shaft bore, a range limiter coupled to the hosel which mechanically limits tightening of the screw, and/or indicators which indicate a level to which the screw is tightened. In some embodiments, the notch extends past a centerline of the hosel. In some embodiments, the hosel of adjustable iron-type golf club heads includes an adjustment bore within which a head of the screw is positioned and an opening connecting the adjustment bore to the notch and the screw extends from the adjustment bore, through the opening, through the notch, and threads into an upper portion of the hosel.

In some embodiments, adjustable iron-type golf club heads include a bearing pad situated between the head of the screw and the opening and/or a retaining ring situated within the adjustment bore. The bearing pad and/or retaining ring can include at least one spherical surface which can mate with the head of the screw. The bearing pad and/or retaining ring can include at least one cylindrical surface which can mate with the head of the screw.

In some embodiments, an adjustable iron-type golf club head includes a main body, a screw having threads, and a hosel having a shaft bore for receiving a golf club shaft, an adjustment bore for receiving the screw, a notch, an unthreaded opening connecting the notch to the adjustment bore, and a threaded opening connecting the notch to the shaft bore. The threaded opening can have threads complementing the threads of the screw, and the screw can extend from the adjustment bore, through the first opening, through the notch, through the second opening, and into the shaft bore.

Exemplary methods of adjusting the lie angle of a player's golf club include determining that a player's swing may benefit from an adjustment of the lie angle of one or more clubs in a set of golf clubs, each club having a club face and a shaft-receiving hosel, determining the amount of adjustment of the lie angle for the golf club, adjusting the golf club by turning a screw to cause the hosel to move toward or away from the club face, and ending the adjustment once the desired lie angle is obtained. In some methods, the adjustment is ended once a visual indicator reveals that the desired lie angle has been achieved.

In some embodiments, an iron iron-type golf club head comprises a hosel having a living hinge formed therein and a secondary member which increases a rigidity of the golf club head in the region of the living hinge. The secondary member can be an actuator which can cause adjustment of the golf club head at the living hinge, and the secondary member can be a screw.

One or more of the above features may be combined to achieve novel and non-obvious combinations. In some exemplary embodiments, an iron iron-type golf club head comprises a hosel having an outer diameter D, a living hinge, and a notch having a notch height H and a notch width W formed therein. The iron-type golf club head further includes a hosel having a bond length region of at least 10 mm and within the bond length region the hosel includes weight reducing features such that within the bond length region the hosel has a mass per unit length of less than about 0.45 g/mm. In other embodiments, the iron-type golf club head hosel has a mass per unit length within the bond length region between 0.45 g/mm and 0.40 g/mm, between 0.40 g/mm and 0.35 g/mm, between 0.35 g/mm and 0.30 g/mm, or between 0.30 g/mm and 0.26 g/mm within the bond length region. In some embodiments, the iron-type golf club head has a hosel having a density between about 7,700 kg/m$^3$ and about 8,100 kg/m$^3$.

In some embodiments, the hosel outer diameter D can be between about 12.3 mm and about 14.0 mm, or more specifically, between about 12.5 mm and 13.6 mm. The notch height H can be between 0.9 mm and 20.0 mm, between 0.9 mm and 15 mm, between 0.9 mm and 10 mm, between 0.9 mm and 5 mm, between 0.9 mm and 4 mm, between 0.9 mm and 3 mm, or between 0.9 mm and 2.5 mm. In some embodiments, the notch width W can be between 2.0 mm and 8.0 mm, between 3.0 mm and 6.0 mm, or between 4.0 mm and 6.0 mm. In other embodiments, the notch width W can be greater than 6.25 mm, greater than 6.5 mm, greater than 6.75 mm, or greater than 7.00 mm. In some embodiments, the notch width W can be greater than half the hosel outer diameter D(W>0.5*D).

In additional embodiments the iron iron-type golf club head may further include an adjustment screw for adjusting the loft angle and/or lie angle of the iron iron-type golf club head. This would allow for easier end-user adjustment rather than requiring someone skilled with using a bending bar to adjust the loft angle and/or lie angle. However, both embodiments are contemplated, that is, with and without an adjustment screw, and both embodiments have their respective advantages and disadvantages.

Importantly, combining an adjustment notch with a hosel having weight reducing features makes further mass reductions to the hosel possible because the notch disclosed herein improves bendability compared to a club without an adjustment notch. Without the adjustment notch, the hosel will fail more readily under bending thus limiting the potential amount of mass savings.

Similarly, an iron iron-type golf club head having weight reducing topline features may be combined with a hosel having weight reducing hosel features and/or with a notch for adjustment of loft angle and/or lie angle. The foregoing and other objects, features, and advantages of the disclosed technology will become more apparent from the following detailed description, which proceeds with reference to the accompanying figures.

DETAILED DESCRIPTION

The present disclosure describes iron type golf club heads typically including a head body and a striking plate. The head body includes a heel portion, a toe portion, a topline portion, a sole portion, and a hosel configured to attach the club head to a shaft. In various embodiments, the head body defines a front opening configured to receive the striking plate at a front rim formed around a periphery of the front opening. In various embodiments, the striking plate is formed integrally (such as by casting) with the head body.

Various embodiments and aspects will be described with reference to details discussed below, and the accompanying drawings will illustrate the various embodiments. The following description and drawings are illustrative and are not to be construed as limiting on the scope of the disclosure. Numerous specific details are described to provide a thorough understanding of various embodiments of the present disclosure. However, in certain instances, well-known or conventional details are not described in order to provide a concise discussion of the various embodiments described herein.

1. Iron Type Golf Club Heads

Figure 1A:
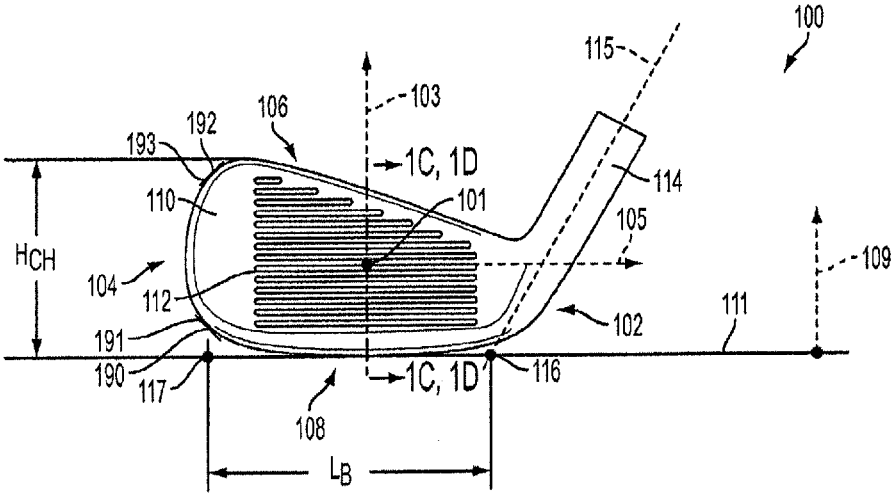
FIG. 1A is a front view of an embodiment of a golf club head.

FIG. 1A illustrates an iron type golf club head 100 including a body 113 (FIG. 1B) having a heel 102, a toe portion 104, a sole portion 108, a top line portion 106, and a hosel 114. The golf club head 100 is shown in FIG. 1A in a normal address position with the sole portion 108 resting upon a ground plane 111, which is assumed to be perfectly flat. As used herein, "normal address position" means the club head position wherein a vector normal to the center of the club face substantially lies in a first vertical plane (i.e., a vertical plane is perpendicular to the ground plane 111), a centerline axis 115 of the hosel 114 substantially lies in a second vertical plane, and the first vertical plane and the second vertical plane substantially perpendicularly intersect. The center of the club face is determined using the procedures described in the USGA "Procedure for Measuring the Flexibility of a Golf Club head," Revision 2.0, Mar. 25, 2005.

A lower tangent point 190 on the outer surface of the club head 100 of a line 191 forming a 45° angle relative to the ground plane 111 defines a demarcation boundary between the sole portion 108 and the toe portion 104. Similarly, an upper tangent point 192 on the outer surface of the club head 100 of a line 193 forming a 45° angle relative to the ground plane 111 defines a demarcation boundary between the top line portion 106 and the toe portion 104. In other words, the portion of the club head that is above and to the left (as viewed in FIG. 1A) of the lower tangent point 190 and below and to the left (as viewed in FIG. 1A) of the upper tangent point 192 is the toe portion 104.

The striking face 110 (FIG. 1B) defines a face plane 125 and includes grooves 112 that are designed for impact with the golf ball. It should be noted that, in some embodiments, the toe portion 104 may be understood to be any portion of the golf club head 100 that is toeward of the grooves 112. In some embodiments, the golf club head 100 can be a single unitary cast piece, while in other embodiments, a striking plate can be formed separately to be adhesively or mechanically attached to the body 113 (FIG. 1B) of the golf club head 100.

Figure 1B:
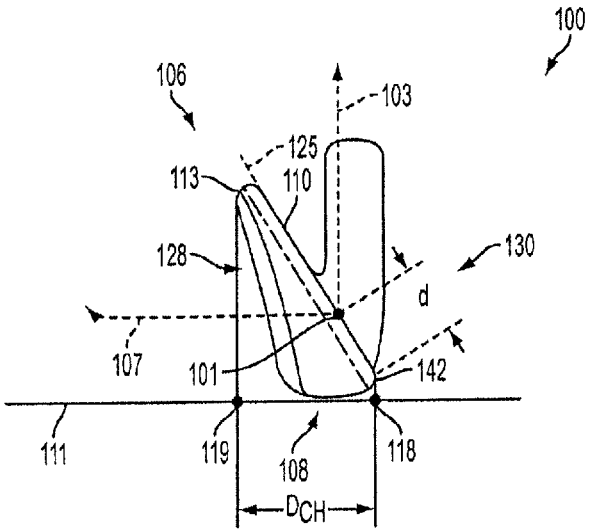
FIG. 1B is an elevated toe perspective view of a golf club head.

FIGS. 1A and 1B also show an ideal striking location 101 on the striking face 110 and respective orthogonal CG axes. As used herein, the ideal striking location 101 is located within the face plane 125 and coincides with the location of the center of gravity (CG) of the golf club head along the CG x-axis 105 (i.e., CG-x) and is offset from the leading edge 142 (defined as the midpoint of a radius connecting the sole portion 108 and the face plane 125) by a distance d of 16.5 mm within the face plane 125, as shown in FIG. 1B. A CG x-axis 105, CG y-axis 107, and CG z-axis 103 intersect at the ideal striking location 101, which defines the origin of the orthogonal CG axes. With the golf club head 100 in the normal address position, the CG x-axis 105 is parallel to the ground plane 111 and is oriented perpendicular to a normal extending from the striking face 110 at the ideal striking location 101. The CG y-axis 107 is also parallel to the ground plane and is perpendicular to the CG x-axis 105. The CG z-axis 103 is oriented perpendicular to the ground plane. In addition, a CG z-up axis 109 is defined as an axis perpendicular to the ground plane 111 and having an origin at the ground plane 111.

In certain embodiments, a desirable CG-y location is between about 0.25 mm to about 20 mm along the CG y-axis 107 toward the rear portion of the club head. Additionally, a desirable CG-z location is between about 12 mm to about 25 mm along the CG z-up axis 109, as previously described.

Figure 1C:
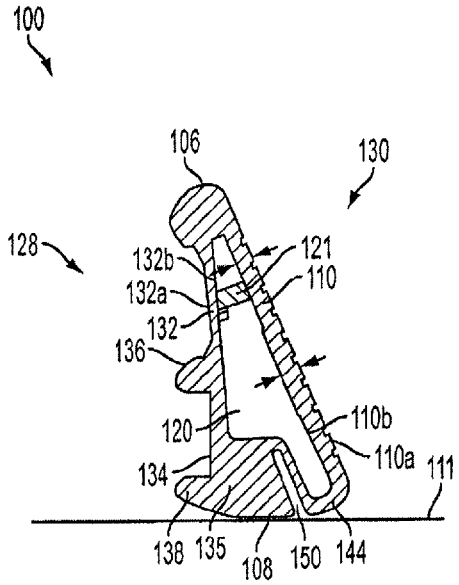
FIG. 1C is a cross-sectional view taken along section lines 1B-1B in FIG. 1A, showing an embodiment of a hollow club head.
Figure 1D:
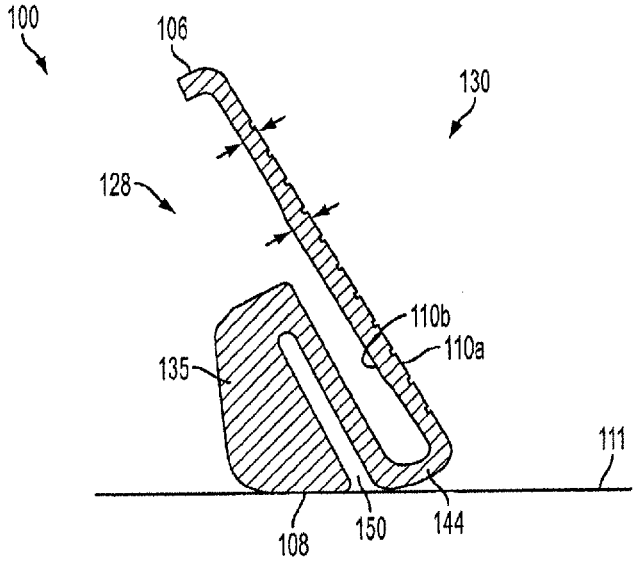
FIG. 1D is a cross-sectional view taken along section lines 1B-1B in FIG. 1A, showing an embodiment of a cavity back club head.

The golf club head may be of solid (also referred to as "blades" and/or "musclebacks"), hollow, cavity back, or other construction. FIG. 1C shows a cross sectional side view along the cross-section lines 1C-1C shown in FIG. 1A of an embodiment of the golf club head having a hollow construction. FIG. 1D shows a cross sectional side view along the cross-section lines 1D-1D of an embodiment of a golf club head having a cavity back construction. The cross-section lines 1C, 1D-1C, 1D are taken through the ideal striking location 101 on the striking face 110. The striking face 110 includes a front surface 110*a* and a rear surface 110*b*. Both the hollow iron golf club head and cavity back iron golf club head embodiments further include a back portion 128 and a front portion 130.

In the embodiments shown in FIGS. 1A-1D, the grooves 112 are located on the striking face 110 such that they are centered along the CG x-axis about the ideal striking location 101, i.e., such that the ideal striking location 101 is located within the striking face plane 125 on an imaginary line that is both perpendicular to and that passes through the midpoint of the longest score-line groove 112. In other embodiments (not shown in the drawings), the grooves 112 may be shifted along the CG x-axis to the toe side or the heel side relative to the ideal striking location 101, the grooves 112 may be aligned along an axis that is not parallel to the ground plane 111, the grooves 112 may have discontinuities along their lengths, or the grooves may not be present at all. Still other shapes, alignments, and/or orientations of grooves 112 on the surface of the striking face 110 are also possible.

In reference to FIG. 1A, the club head 100 has a sole length, $L_B$, and a club head height, $H_{CH}$. The sole length, $L_B$, is defined as the distance between two points projected onto the ground plane 111. A heel side 116 of the sole is defined as the intersection of a projection of the hosel axis 115 onto the ground plane 111. A toe side 117 of the sole is defined as the intersection point of the vertical projection of the lower tangent point 190 (described above) onto the ground plane 111. The distance between the heel side 116 and toe side 117 of the sole is the sole length $L_B$ of the club head. The club head height, $H_{CH}$, is defined as the distance between the ground plane 111 and the uppermost point of the club head as projected in the x-z plane, as illustrated in FIG. 1A.

FIG. 1B illustrates an elevated toe view of the golf club head 100 including a back portion 128, a front portion 130, a sole portion 108, a top line portion 106, and a striking face 110, as previously described. A leading edge 142 is defined by the midpoint of a radius connecting the face plane 125 and the sole portion 108. The club head includes a club head front-to-back depth, $D_{CH}$, which is the distance between two points projected onto the ground plane 111. A forward end 118 of the club head is defined as the intersection of the projection of the leading edge 142 onto the ground plane 111. A rearward end 119 of the club head is defined as the intersection of the projection of the rearward-most point of the club head (as viewed in the y-z plane) onto the ground plane 111. The distance between the forward end 118 and rearward end 119 of the club head is the club head depth $D_{CH}$.

In certain embodiments of iron type golf club heads having hollow construction, such as the embodiment shown in FIG. 1C, a recess 134 is located above the rear protrusion 138 in the back portion 128 of the club head. A back wall 132 encloses the entire back portion 128 of the club head to define an interior cavity 120. The interior cavity 120 may be completely or partially hollow, or it optionally may be filled with a filler material. In the embodiment shown in FIG. 1C, the interior cavity 120 includes a vibration dampening plug 121 that is retained between the rear surface 110 of the striking face and the inner surface 132*b* of the back wall. Suitable filler materials and details relating to the nature and materials comprising the plug 121 are described in US Patent Application Publication No. 2011/0028240, which is incorporated herein by reference in its entirety.

FIG. 1C further shows an optional ridge 136 extending across a portion of the outer back wall surface 132*a* forming an upper concavity and a lower concavity. An inner back wall surface 132*b* defines a portion of the cavity 120 and forms a thickness between the outer back wall surface 132*a* and the inner back wall surface 132*b*. In some embodiments, the back wall thickness varies between a thickness of about 0.5 mm to about 4 mm. A sole bar 135 is located in a low, rearward portion of the club head 100. The sole bar 135 has a relatively large thickness in relation to the striking plate and other portions of the club head 100, thereby accounting for a significant portion of the mass of the club head 100, and thereby shifting the center of gravity (CG) of the club head 100 relatively lower and rearward. A channel 150—described more fully below—is formed in the sole bar 135. Furthermore, the sole portion 108 has a forward portion 144 that is located immediately rearward of the striking face 110. In the embodiment shown in FIG. 1C, the forward portion 144 of the sole is a relatively thin-walled section of the sole that extends within a region between the channel 150 and the striking face 110.

FIG. 1D further shows a sole bar 135 of the cavity back golf club head 100. The sole bar 135 has a relatively large thickness in relation to the striking plate and other portions of the golf club head 100, thereby accounting for a significant portion of the mass of the golf club head 100, and thereby shifting the center of gravity (CG) of the golf club head 100 relatively lower and rearward. The embodiment shown in FIG. 1D also includes a forward portion 144 of the sole that has a reduced sole thickness and that extends within between the sole bar 135 and the striking face 110. A channel 150—described more fully below—is located in a forward region of the sole bar 135.

Figure 1E:
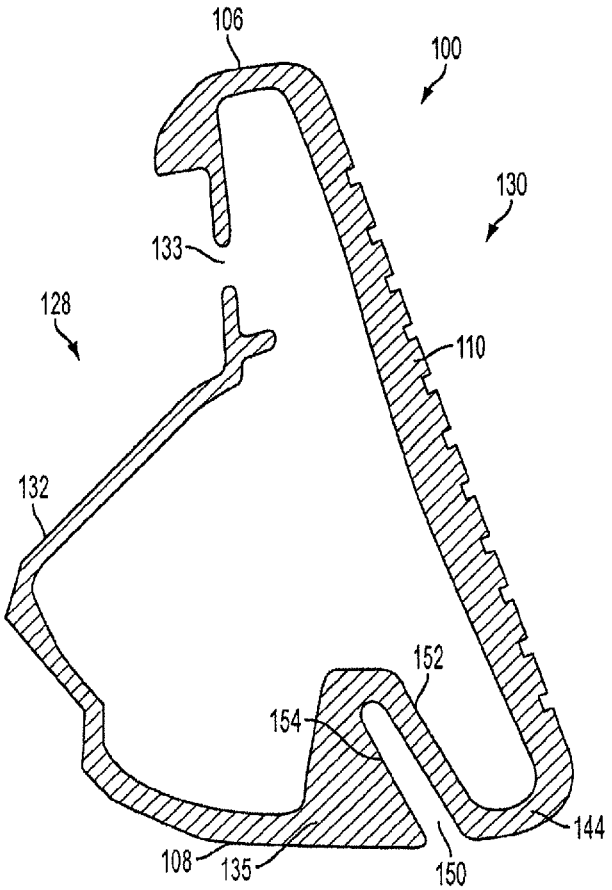
FIG. 1E is a cross-sectional view taken along section lines 1B-1B in FIG. 1A, showing another embodiment of a hollow club head.
Figure 1F:
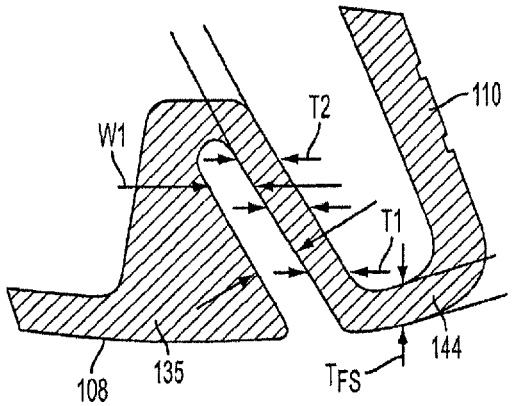
FIG. 1F is a cross-sectional view showing a portion of the embodiment of the hollow club head shown in FIG. 1E.

FIG. 1E shows another embodiment of a hollow iron club head 100 having a channel 150. As with the embodiment shown in FIG. 1C, the club head 100 includes a striking face 110, a top line 106, a sole 108, and a back wall 132. The sole includes a sole bar 135 having a channel 150 defined by a forward wall 152 and rear wall 154. A forward portion 144 of the sole is located between the striking face 110 and the forward wall 152 of the slot. The hollow club head 100 includes an aperture 133 that is suitable for installing a vibration dampening plug 121 like that shown in FIG. 1C, and which is described in more detail in US Patent Application Publication No. 2011/0028240, which is incorporated by reference in its entirety. Installation of the vibration dampening plug 121 effectively seals the aperture 133.

In some embodiments, the volume of the hollow iron club head 100 may be between about 10 cubic centimeters (cc) and about 120 cc. For example, in some embodiments, the hollow iron club head 100 may have a volume between about 20 cc and about 110 cc, such as between about 30 cc and about 100 cc, such as between about 40 cc and about 90 cc, such as between about 50 cc and about 80 cc, or such as between about 60 cc and about 80 cc. In addition, in some embodiments, the hollow iron club head 100 has a club head depth, $D_{CH}$, that is between about 15 mm and about 100 mm. For example, in some embodiments, the hollow iron club head 100 may have a club head depth, $D_{CH}$, of between about 20 mm and about 90 mm, such as between about 30 mm and about 80 mm, such as between about 40 mm and about 70 mm.

In certain embodiments of the golf club head 100 that include a separate striking plate attached to the body 113 of the golf club head, the striking plate can be formed of forged maraging steel, maraging stainless steel, or precipitation-hardened (PH) stainless steel. In general, maraging steels have high strength, toughness, and malleability. Being low in carbon, they derive their strength from precipitation of inter-metallic substances other than carbon. The principle alloying element is nickel (15% to nearly 30%). Other alloying elements producing inter-metallic precipitates in these steels include cobalt, molybdenum, and titanium. In one embodiment, the maraging steel contains 18% nickel.

Maraging stainless steels have less nickel than maraging steels but include significant chromium to inhibit rust. The chromium augments hardenability despite the reduced nickel content, which ensures the steel can transform to martensite when appropriately heat-treated. In another embodiment, a maraging stainless steel C455 is utilized as the striking plate. In other embodiments, the striking plate is a precipitation hardened stainless steel such as 17-4, 15-5, or 17-7.

The striking plate can be forged by hot press forging using any of the described materials in a progressive series of dies. After forging, the striking plate is subjected to heat-treatment. For example, 17-4 PH stainless steel forgings are heat treated by 1040° C. for 90 minutes and then solution quenched. In another example, C455 or C450 stainless steel forgings are solution heat-treated at 830° C. for 90 minutes and then quenched.

In some embodiments, the body 113 of the golf club head is made from 17-4 steel. However another material such as carbon steel (e.g., 1020, 1030, 8620, or 1040 carbon steel), chrome-molybdenum steel (e.g., 4140 Cr—Mo steel), Ni—Cr—Mo steel (e.g., 8620 Ni—Cr—Mo steel), austenitic stainless steel (e.g., 304, N50, or N60 stainless steel (e.g., 410 stainless steel) can be used.

In addition to those noted above, some examples of metals and metal alloys that can be used to form the components of the parts described include, without limitation: titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

In still other embodiments, the body 113 and/or striking plate of the golf club head are made from fiber-reinforced polymeric composite materials, and are not required to be homogeneous. Examples of composite materials and golf club components comprising composite materials are described in U.S. Patent Application Publication No. 2011/0275451, which is incorporated herein by reference in its entirety.

The body 113 of the golf club head can include various features such as weighting elements, cartridges, and/or inserts or applied bodies as used for CG placement, vibration control or damping, or acoustic control or damping. For example, U.S. Pat. No. 6,811,496, incorporated herein by reference in its entirety, discloses the attachment of mass altering pins or cartridge weighting elements.

After forming the striking plate and the body 113 of the golf club head, the striking plate 110 and body portion 113 contact surfaces can be finish-machined to ensure a good interface contact surface is provided prior to welding. In some embodiments, the contact surfaces are planar for ease of finish machining and engagement.

2. Iron Type Golf Club Heads Having a Flexible Boundary Structure

In some embodiments of the iron type golf club heads described herein, a flexible boundary structure ("FBS") is provided at one or more locations on the club head. The flexible boundary structure may comprise, in several embodiments, at least one slot, at least one channel, at least one gap, at least one thinned or weakened region, and/or at least one other structure that enhances the capability of an adjacent or related portion of the golf club head to flex or deflect and to thereby provide a desired improvement in the performance of the golf club head. For example, in several embodiments, the flexible boundary structure is located proximate the striking face of the golf club head in order to enhance the deflection of the striking face upon impact with a golf ball during a golf swing. The enhanced deflection of the striking face may result, for example, in an increase or in a desired decrease in the coefficient of restitution ("COR") of the golf club head. In other embodiments, the increased perimeter flexibility of the striking face may cause the striking face to deflect in a different location and/or different manner in comparison to the deflection that occurs upon striking a golf ball in the absence of the channel, slot, or other flexible boundary structure.

Turning to FIGS. 2A-2H, an embodiment of a cavity back golf club head 200 having a flexible boundary structure is shown. In the embodiment, the flexible boundary structure is a channel 250 that is located on the sole of the club head. It should be noted that, as described above, the flexible boundary structure may comprise a slot, a channel, a gap, a thinned or weakened region, or other structure. For clarity, however, the descriptions herein will be limited to embodiments containing a channel, such as the channel 250 illustrated in FIGS. 2A-2H, or a slot, included in several embodiments described below, with it being understood that other flexible boundary structures may be used to achieve the benefits described herein.

Figure 2A:
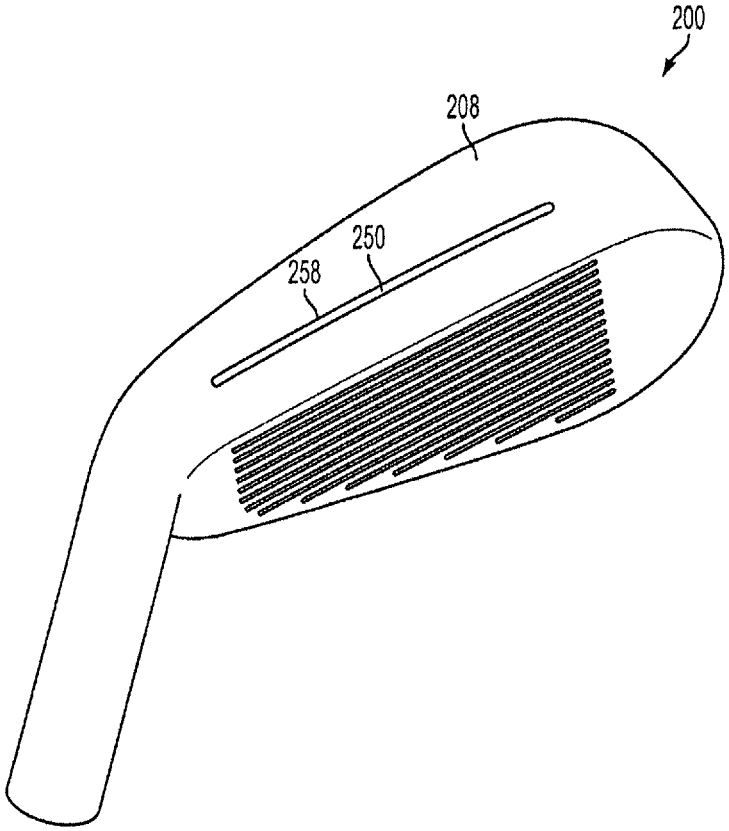
FIG. 2A is a bottom perspective view of an embodiment of a golf club head.
Figure 2B:
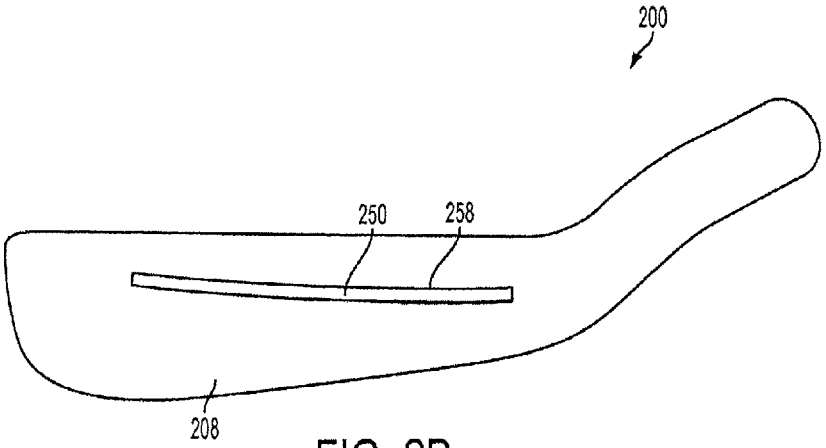
FIG. 2B is a bottom view of the sole of the golf club head shown in FIG. 2A.
Figure 2C:
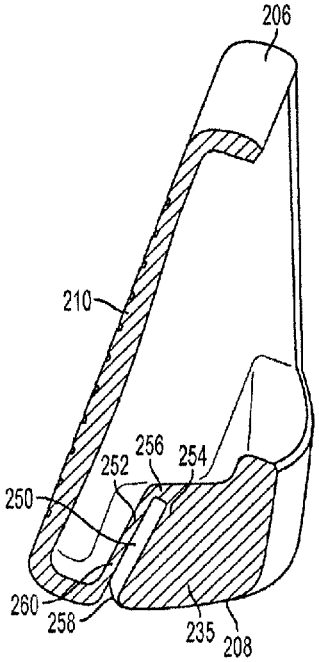
FIG. 2C is a cross-sectional view of the golf club head shown in FIG. 2A.
Figure 2D:
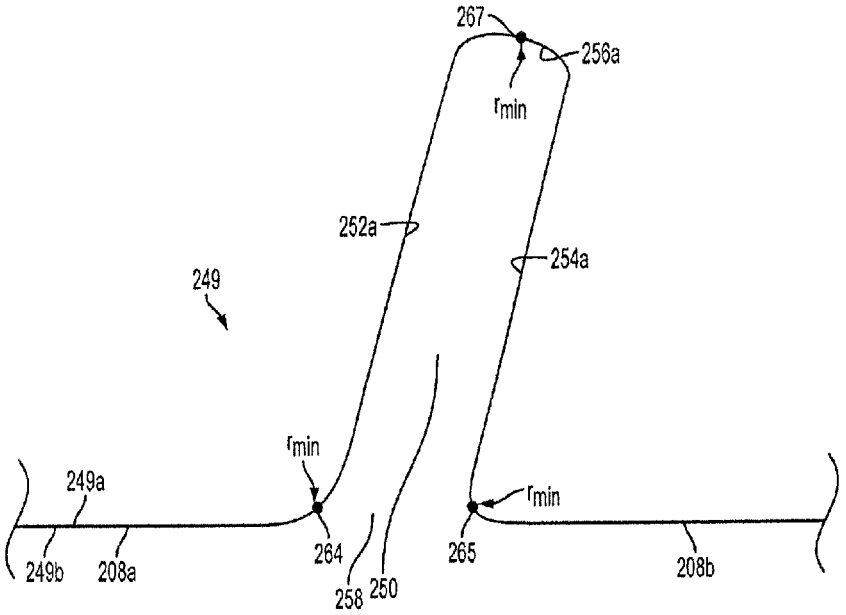
FIGS. 2D-E are schematic representations of a profile of the outer surface of a portion of a club head that surrounds and includes the region of a channel.
Figure 2E:
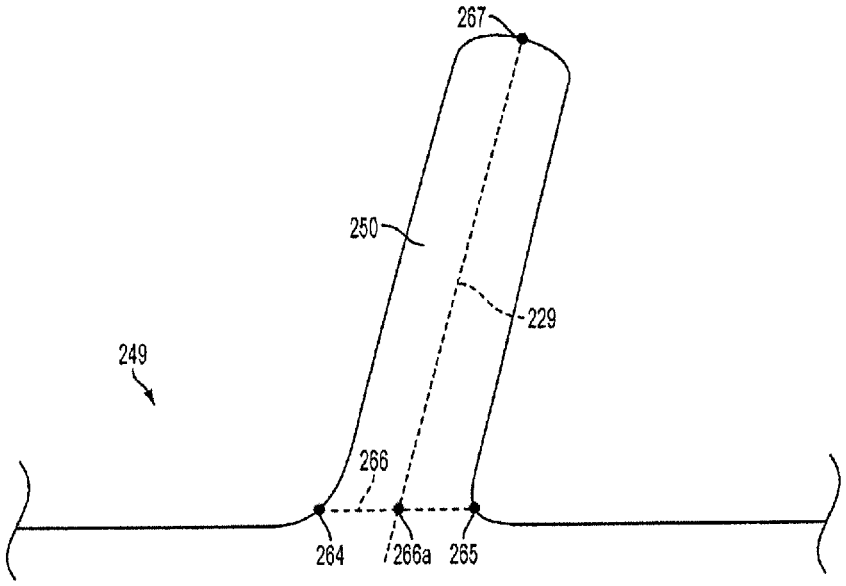
Figure 2F:
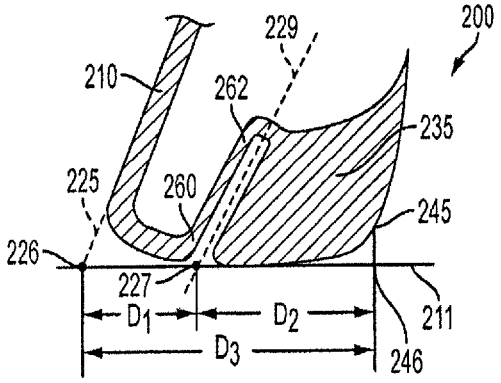
FIGS. 2F-H are cross-sectional views of a channel region of an embodiment of a golf club head.
Figure 2G:
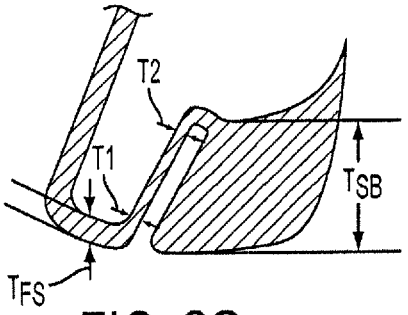
Figure 2H:
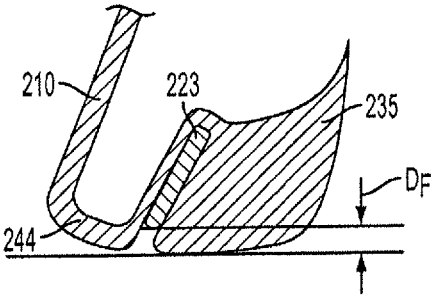
Figure 3:
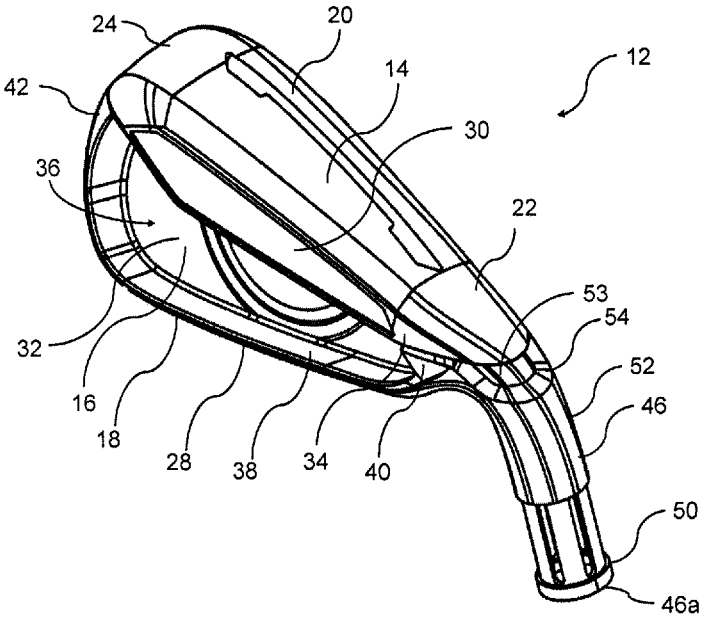
FIG. 3 is a perspective view of an iron type golf club head.
Figure 4:
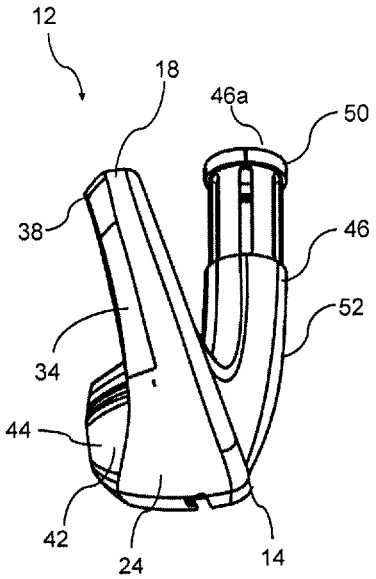
FIG. 4 is a toe end view of the golf club head of FIG. 3.
Figure 5:
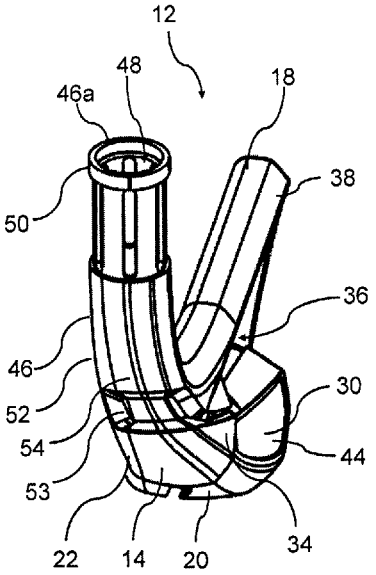
FIG. 5 is a heel end view of the golf club head of FIG. 3.
Figure 6:
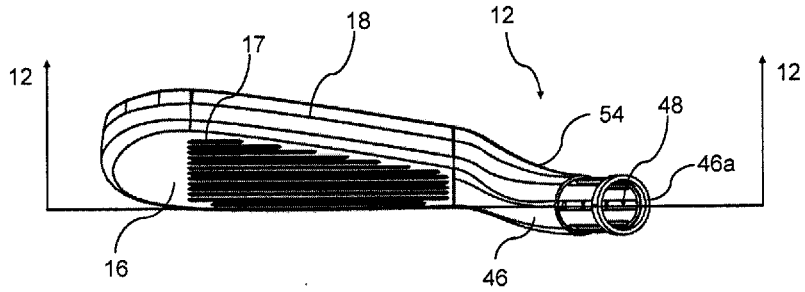
FIG. 6 is top view of the golf club head of FIG. 3.
Figure 7:
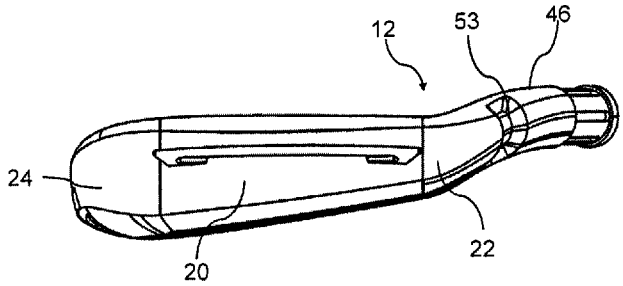
FIG. 7 is a bottom view of the golf club head of FIG. 3.

The channel 250 extends over a region of the sole 208 generally parallel to and spaced rearwardly from the striking face plane 225 (FIG. 2F). The channel extends into and is defined by a forward portion of the sole bar 235, defining a forward wall 252, a rear wall 254, and an upper wall 256. A channel opening 258 is defined on the sole portion 208 of the club head. The forward wall 252 further defines, in part, a first hinge region 260 located at the transition from the forward portion of the sole 244 (FIG. 2H) to the forward wall 252, and a second hinge region 262 (FIG. 2F) located at a transition from the upper region of the forward wall 252 to the sole bar 235. The first hinge region 260 and second hinge region 262 (FIG. 2F) are portions of the golf club head that contribute to the increased deflection of the striking face 210 of the golf club head due to the presence of the channel 250. In particular, the shape, size, and orientation of the first hinge region 260 and second hinge region 262 (FIG. 2F) are designed to allow these regions of the golf club head to flex under the load of a golf ball impact. The flexing of the first hinge region 260 and second hinge region 262 (FIG. 2F), in turn, creates additional deflection of the striking face 210.

Several aspects of the size, shape, and orientation of the club head 200 and channel 250 are illustrated in the embodiment shown in FIGS. 2A-H. For example, for each cross-section of the club head defined within the y-z plane, the face to channel distance D1 is the distance measured on the ground plane 211 between a face plane projection point 226 and a channel centerline projection point 227. (See FIG. 2F). The face plane projection point 226 is defined as the intersection of a projection of the striking face plane 225 onto the ground plane 211. The channel centerline projection point 227 is defined as the intersection of a projection of a channel centerline 229 onto the ground plane 211. The channel centerline 229 is determined according to the following.

Referring to FIGS. 2D-E, a schematic profile 249 of the outer surface of a portion of the club head 200 that surrounds and includes the region of the channel 250 is shown. The schematic profile has an interior side 249*a* and an exterior side 249*b*. A forward sole exterior surface 208*a* extends on a forward side of the channel 250, and a rearward sole exterior surface 208*b* extends on a rearward side of the channel 250. The channel has a forward wall exterior surface 252*a*, a rear wall exterior surface 254*a*, and an upper wall exterior surface 256*a*. A forward channel entry point 264 is defined as the midpoint of a curve having a local minimum radius ($r_{min}$, measured from the interior side 249*a* of the schematic profile 249) that is located between the forward sole exterior surface 208*a* and the forward wall exterior surface 252*a*. A rear channel entry point 265 is defined as the midpoint of a curve having a local minimum radius ($r_{min}$, also measured from the interior side 249*a* of the schematic profile 249) that is located between the rearward sole exterior surface 208*b* and the rear wall exterior surface 254*a*.

An imaginary line 266 that connects the forward channel entry point 264 and the rear channel entry point 265 defines the channel opening 258. A midpoint 266*a* of the imaginary line 266 is one of two points that define the channel centerline 229. The other point defining the channel centerline 229 is an upper channel peak 267, which is defined as the midpoint of a curve having a local minimum radius ($r_{min}$, as measured from the exterior side 249*b* of the schematic profile 249) that is located between the forward wall exterior surface 252*a* and the rear wall exterior surface 254*a*. In an embodiment having one or more flat segment(s) or flat surface(s) located at the upper end of the channel between the forward wall 252 and rear wall 254, the upper channel peak 267 is defined as the midpoint of the flat segment(s) or flat surface(s).

Another aspect of the size, shape, and orientation of the club head 200 and channel 250 is the sole width. For example, for each cross-section of the club head defined within the y-z plane, the sole width, D3, is the distance measured on the ground plane 211 between the face plane projection point 226 and a trailing edge projection point 246. (See FIG. 2F). The face plane projection point 226 is defined above. The trailing edge projection point 246 is the intersection with the ground plane 211 of an imaginary vertical line passing through the trailing edge 245 of the club head 200. The trailing edge 245 is defined as a midpoint of a radius or a point that constitutes a transition from the sole portion 208 to the back wall 232 or other structure on the back portion 228 of the club head.

Still another aspect of the size, shape, and orientation of the club head 200 and channel 250 is the channel to rear distance, D2. For example, for each cross-section of the club head defined within the y-z plane, the channel to rear distance D2 is the distance measured on the ground plane 211 between the channel centerline projection point 227 and a vertical projection of the trailing edge 245 onto the ground plane 211. (See FIG. 2F). As a result, for each such cross-section, D1+D2=D3.

General Iron Information

Turning to FIGS. 3-12, an iron-type golf club head 12 includes a club head body 14 having a striking face 16 with a plurality of scorelines 17, a top line 18 defining the upper limit of the striking face 16, a sole portion 20 defining the lower limit of the striking face 16, a heel portion 22, a toe portion 24 and a rear surface opposite the striking face 16. The rear surface 26 has a cavity back construction and includes an upper section 28 adjacent the top line 18, a lower section 30 adjacent the sole portion 20 and a middle section 32 between the upper section 28 and the lower section 30.

As mentioned above, the iron-type golf club head 12 has the general configuration of a cavity back club head and, consequently, the rear surface 26 includes a flange 34 extending rearwardly around the periphery of the club head body 14. The rearwardly extending flange 34 defines a cavity 36 within the rear surface 26 of the club head body 14. The flange 34 includes a top flange 38 extending rearwardly along the top line 18 of the club head body 14 adjacent the upper section 28. The top flange 38 extends the length of the top line 18 from the heel portion 22 of the club head body 14 to the toe portion 24 of the club head body 14. The club head body 14 is further provided with rearwardly extending flanges 40, 42 along the heel portion 22 (that is, a heel flange 40) and the toe portion 24 (that is, a toe flange 42) of the club head body 14. These rearwardly extending flanges 38, 40, 42 extend through the upper section 28, lower section 30 and middle section 32 of the rear surface 26 of the iron-type golf club head 12. Additionally, the club head body 14 is provided with a bottom flange 44 extending along the sole portion 20 of the club head body 14.

The iron-type golf club head 12 is preferably cast from suitable metal such as stainless steel. Although shown as a cavity-back iron, the iron-type golf club head 12 could be a "muscle back" or a "hollow" iron-type club and may be any iron-type club head from a one-iron to a wedge.

The iron type golf club head 12 further includes a hosel 46. The hosel 46 has a hosel top edge 46*a*, a hosel bore 48, a hosel outer diameter top 50, and a hosel outer diameter bottom 52 (if the hosel is tapered). The hosel bore 48 includes a proximal end 48*a* and a distal end 48*b*. The proximal end 48*a* of the hosel bore 48 is proximate the hosel top edge 46*a*. Proximate the distal end 48*b* of the hosel bore 48 is a weight cartridge port or simply a cartridge port 49 (See FIG. 12). The cartridge port 49 has a proximal end 49*a* and a distal end 49*b*. The hosel 46 further includes a neck 54 connected to the heel portion 22 of the body 14.

The hosel bore 48 ranges from about 8-12 mm, such as about 9.0 mm to about 9.6 mm. The hosel outer diameter top 50 ranges from about 12-15 mm, such as about 13.0 mm to about 13.6 mm. The hosel outer diameter bottom 52 ranges from about 12-17 mm, such as about 13.0 mm to about 13.6 mm.

The cartridge port 49 allows for addition of a weight adjustment member (not shown) having a shape and size similar to the cartridge port 49, which may optionally be used to adjust the swing weight of the iron type golf club. This may help with overcoming manufacturing tolerances or adjusting the iron type club to a player's preferred swing weight. The weight adjustment member may be formed of metal or plastic. Since the weight adjustment member is located near the center of gravity of the iron type club head 12, the club head center of gravity will not change significantly when selecting any of the plurality of weight adjustment members.

Figure 8:
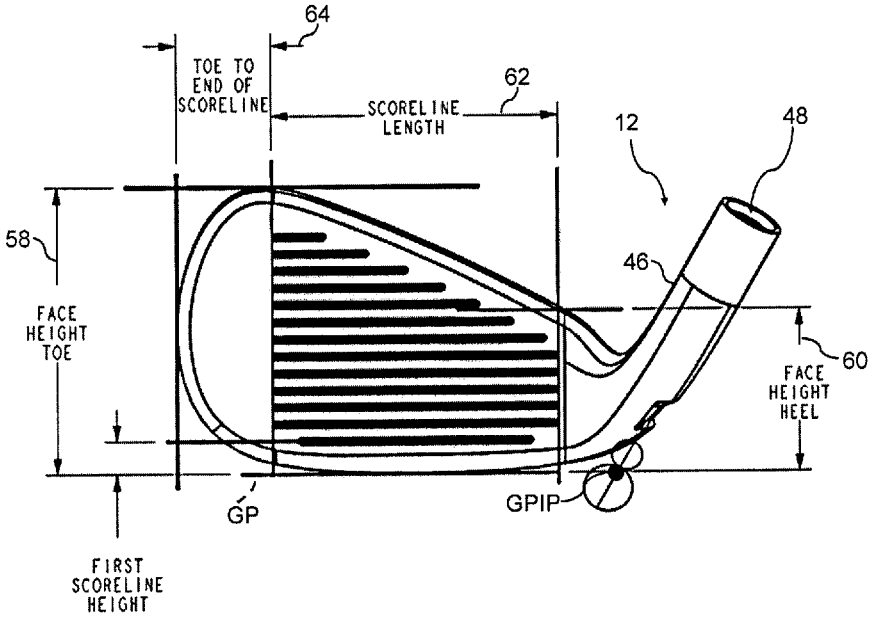
FIG. 8 is a front elevation view of the golf club head of FIG. 3.
Figure 9:
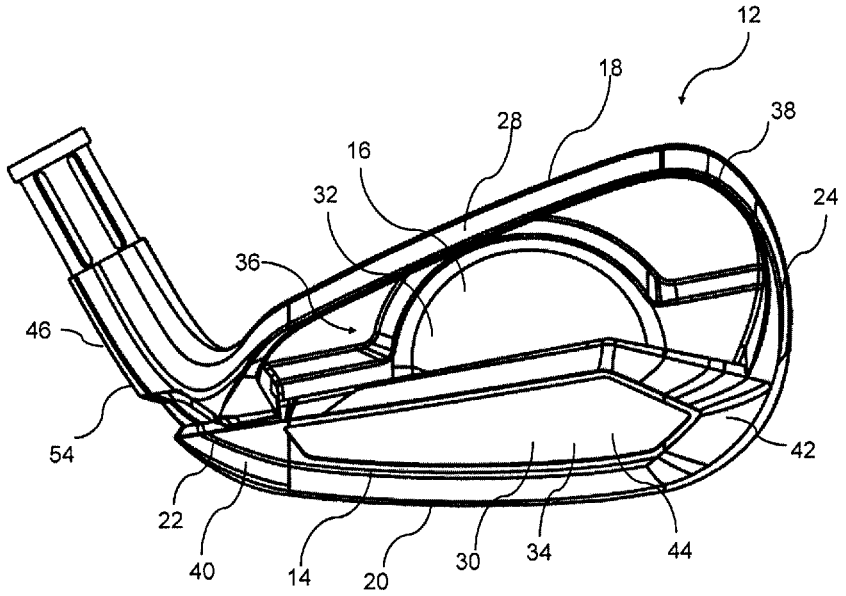
FIG. 9 is a rear elevation view of the golf club head of FIG. 3.
Figure 16A:
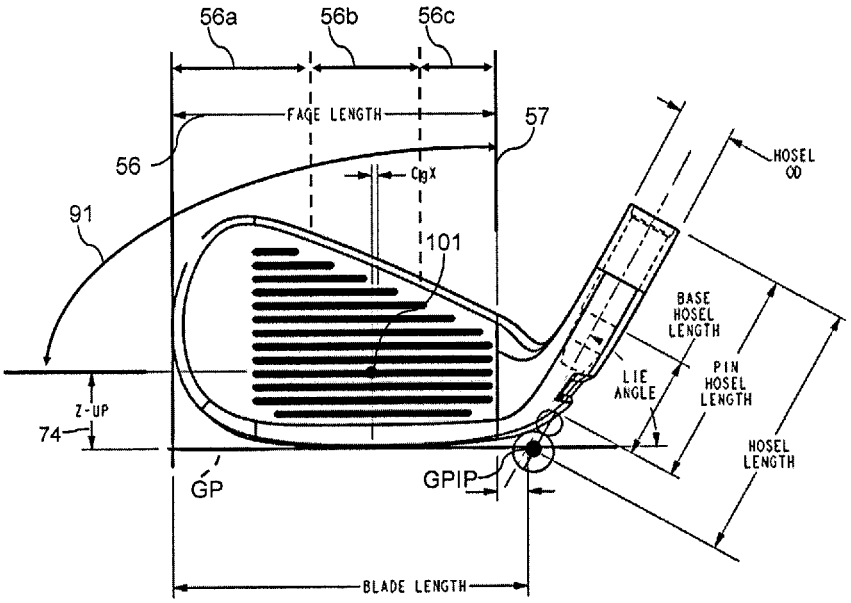
FIG. 16*a* is a front elevation view of one embodiment of an iron type golf club head embodying a lightweight topline design.

Turning to FIGS. 8 and 16*a*, iron type golf club head 12 includes a face length 56, a par line 57, a toe face height 58, a heel face height 60, a scoreline length 62, and a toe to end of scorelines length 64. The par line 57 is at the transition point between the flat striking face 16 and the organically shaped region that attaches the club head body 14 to the hosel 46. The scorelines 17 end just before the par line 57. The face length 56 extends from the par line 57 to toe portion 24 of the iron type golf club head 12. As shown the toe face height 58 and the heel face height 60 sandwich the scorelines. Accordingly, the toe face height 58 is measured proximate the scorelines 17 near the toe portion 24, and the heel face height 60 is measured proximate the scorelines 17 near the heel portion 22. The toe face height 58 is at least 40 mm, such as at least 45 mm, such as at least 50 mm, or such as at least 60 mm. The heel face height 60 ranges from about 20-60 mm, such as about 25-45 mm, such as about 25-40 mm, or such as about 25-35 mm. The toe to end of scorelines length 64 is the maximum distance measuring from the scorelines to the toe portion 24, and the toe to end of scorelines length 64 is at least 5 mm, such as at least 10 mm, or such as at least 15 mm. The scorelines length 62 is the maximum length of the scorelines, and the scorelines length 62 is at least 40 mm, such as at least 45 mm, such as at least 50 mm, or such as at least 60 mm.

Figure 10:
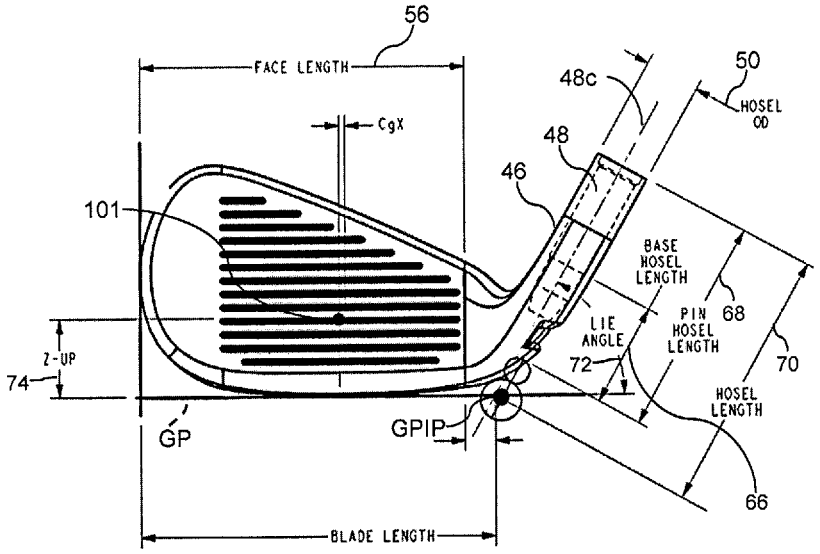
FIG. 10 is another front elevation view of the golf club head of FIG. 3.
Figure 11:
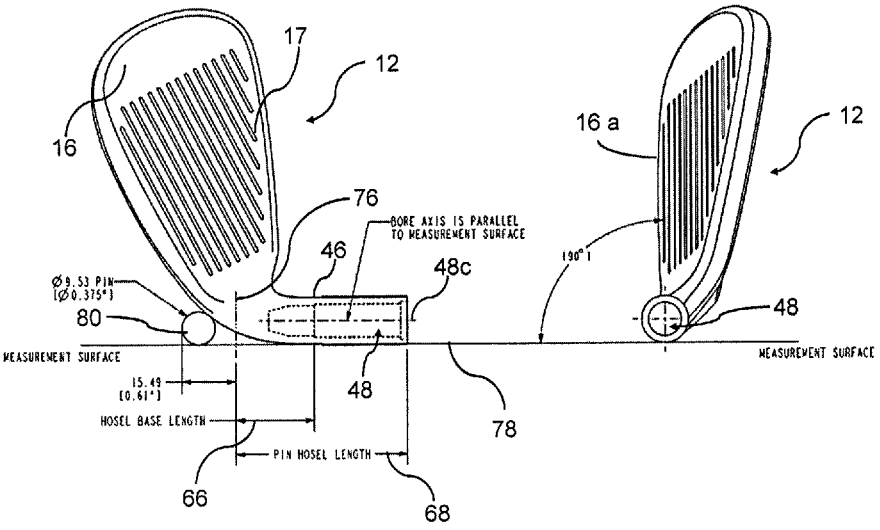
FIG. 11 is a front view demonstrating pin hosel and base hosel length measurements of the golf club head of FIG. 3.

Turning to FIGS. 10 and 11, iron type golf club head 12 includes a base hosel length 66, a pin hosel length 68, a hosel length 70, a lie angle 72, and a Z-up 74. In some embodiments, the hosel bore 46 may be generally symmetric about a longitudinal hosel bore axis 48 *c*. As shown, the hosel bore axis 48*c* is at an angle relative to a ground plane (GP), and this angle is commonly referred to as a lie angle 72 of the club head. The ground plane is the plane onto which the iron type golf club head 12 may be properly soled i.e. arranged so that the sole portion 20 is in contact with the GP. The intersection of the ground plane and the hosel bore axis 48*c* creates a ground plane intersection point (GPIP) (See FIG. 12). The GPIP may be used to measure or reference features of the iron type golf club head 12.

The hosel length 70 is measured from the GPIP to hosel top edge 46*a* along the hosel bore axis 48*c*. A hosel bore length 48*d* is measured from the hosel top edge 46*a* along the hosel bore axis 48*c* to the hosel bore distal end 48*b*. For reference and as shown in FIG. 11, a hosel measurement datum 76 is used for making the base hosel length and the pin hosel length measurements 66, 68. The hosel measurement datum 76 is created by first placing the iron type golf club head 12 on a generally planar measurement surface 78, second the hosel bore axis 48 *c* is aligned parallel to the measurement surface 78 and the heel portion 22 of the iron type golf club head 12 is pressed against a pin 80 having a 0.375 inch diameter, next the hosel measurement datum 76 is created perpendicular to the measurement surface and offset 15.49 mm from a plane tangent to a distal end of the pin and perpendicular to the measurement surface. Additionally, as shown a leading edge 16*a* of the striking face 16 is aligned at 90 degrees relative to the measurement surface 78.

The base hosel length 66 is measured parallel to the measurement surface from the hosel measurement datum 76 to the distal end 48*b* of the hosel bore 48. The pin hosel length 68 is measured parallel to the measurement surface 78 from the hosel measurement datum 76 to the hosel top edge 46*a*. Generally, the hosel bore axis 48*c* passes through the center of the hosel. The hosel bore axis can be found by inserting a cylindrically shaped pin or dowel having a diameter substantially similar to the hosel bore in the hosel bore. The axis of the pin or dowel should be substantially aligned with the hosel bore axis. If the hosel bore is tapered then the pin or dowel should have a substantially similar taper to determine the hosel bore axis. Another method of determining the hosel bore axis would be to measure the diameter of the hosel bore at two or more locations along the hosel bore and then construct an axis through the center points of the two or more diameters measured.

The base hosel length 66 is at least 15 mm, such as at least 20 mm, such as at least 25 mm, such as at least 30 mm, or such as at least 35 mm. Typically in a lower lofted iron (e.g. 17 degrees to 48 degrees) the base hosel length may range from about 20 mm to about 30 mm. For wedges 50 degrees and greater, such as gap wedge, sand wedge, and lob wedge, the base hosel length is generally at least 40 mm.

The pin hosel length 68 is at least 40 mm, such as at least 45 mm, such as at least 50 mm, such as at least 55 mm, such as at least 60 mm, such as at least 65 mm, such as at least 70 mm, or such as at least 75 mm. Although, this measurement may vary, generally the pin hosel length will be about 23 mm to about 33 mm greater than the base hosel length, or preferably about 25 mm to about 28 mm. Typically in a lower lofted iron e.g. 17 degrees to 48 degrees the pin hosel length may range from about 45 mm to about 60 mm, or preferably about 50 mm to about 60 mm. For wedges 50 degrees and greater, such as gap wedge, sand wedge, and lob wedge, the base hosel length is generally at least 40 mm.

The hosel length 70 is at least 40 mm, such as at least 45 mm, such as at least 50 mm, such as at least 55 mm, such as at least 60 mm, such as at least 65 mm, such as at least 70 mm, such as at least 75 mm, such as at least 80 mm, such as at least 85 mm, such as at least 90 mm, or such as at least 95 mm.

The portion of the shaft that bonds to the hosel bore of the iron type golf club head is referred to as the bond length. In many instances, the bond length is the same as the hosel bore length 48*d*, however in some instances there is a difference of about 1 mm to about 4 mm between the bond length and the hosel bore length. This is because a ferrule may be used that snaps into the hosel bore, which requires about 1 mm to about 4 mm for engagement. The bond length is generally about 20 mm to about 35 mm, preferably about 25 mm to about 30 mm. The bond length may also be approximated by finding the difference between the pin hosel length 68 and the base hosel length 66, which is typically between about 25 mm to about 30 mm.

Light Weight Iron-Type Hosel Construction

Figure 12:
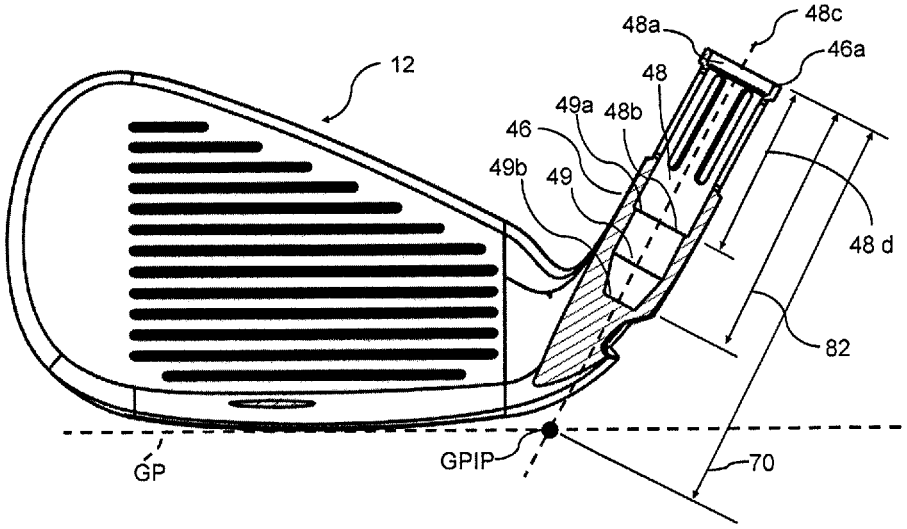
FIG. 12 is another front elevation view showing a section of the golf club head of FIG. 3.

Turning attention to FIGS. 13-15, several designs are shown for achieving a lighter weight hosel by employing a weight reducing feature over a hosel weight reduction zone 82. As shown in FIG. 12, the hosel weight reduction zone 82 extends from about the hosel top edge 46*a* to about the cartridge port distal end 49*b*. Each of weight reducing designs maintains a "traditional" length hosel for bending while offering a savings from about 1 g to about 4 g in the hosel area, and provides a downward CG-Z shift of at least 0.4 mm to at least 1.2 mm. This large downward CG-Z shift is the result of mass being removed from locations far from the club head CG and repositioned to a position at or below the club head CG, such as, for example, the sole of the club. Furthermore, the additional structural material removed from the hosel can be relocated to another location on the club, such as the toe portion of the club, to provide a lower center of gravity, increased moments of inertia, or other properties that result in enhanced ball striking performance for the club head.

The weight reducing designs generally have a hosel outside diameter ranging from about 11.6 mm to about 13.6 mm. Several of the designs selectively thin portions of the hosel resulting in a third outside diameter or a hosel outer diameter 51. Additionally, several of the designs offset the weight reducing feature from the hosel top edge 46*a* by a hosel offset distance 83 ranging from about 1 mm to about 4 mm. The hosel bore 48 diameter ranges from about 9.0 mm to about 9.6 mm. As a result, a hosel wall thickness 84 ranges from of about 1.0 mm to about 2.3 mm. The hosel weight reduction zone 82 extends from about 10 mm to about 30 mm. However, the hosel weight reduction zone 82 pattern may extend further or less depending on the hosel length and desire to adjust the weight savings. For example, a club with a longer hosel length, such as a sand wedge, the pattern may extend about 20 mm to about 50 mm.

Figure 13A:
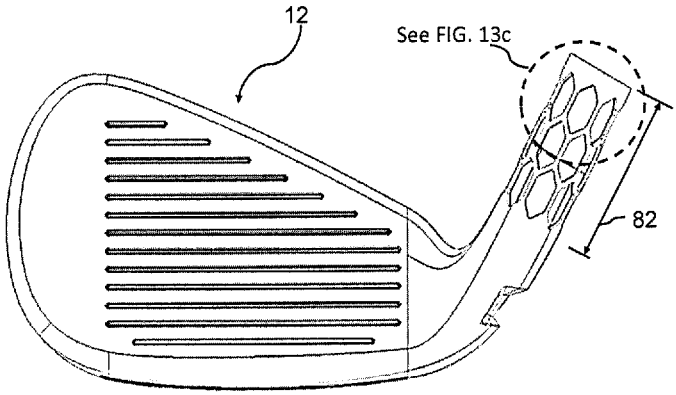
FIG. 13*a* is front elevation view of an iron type golf club head embodying another lightweight hosel design.
Figure 13B:
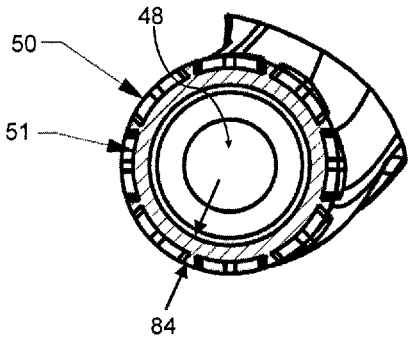
FIG. 13*b* is top elevation detail view of the golf club head of FIG. 13*a*.
Figure 13C:
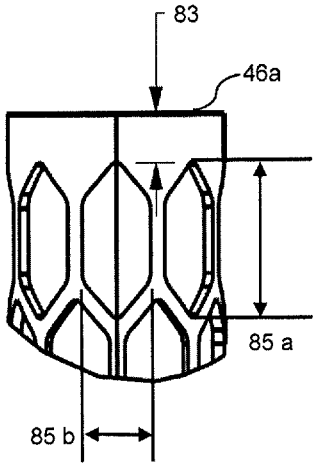
FIG. 13*c* is front elevation detail view of the golf club head of FIG. 13*a*.

As shown in FIGS. 13*a-c* the design uses a weight reducing feature that has a honeycomb-like pattern to selectively reduce the wall thickness around the hosel. The honeycomb-like pattern is an efficient way of removing mass from the hosel wall thickness. The honeycomb design removes at least 1 g, such as at least 2 g, such as at least 3 g, such as at least 4 g of mass from the hosel. In the design shown, about 4 g was removed from the hosel and reallocated to a lower point on the club head resulting in a downward Zup shift of about 0.6 mm while maintaining the same overall head weight.

FIGS. 13*b*-13*c* are detail views of the honeycomb design. Specifically, FIG. 13*b* is a top detail view of the design shown in FIG. 13*a* showing the hosel bore 48, the hosel outer diameter 50, hosel outer diameter 51, and the hosel wall thickness 84. FIG. 13*c* is a detail view of the honeycomb pattern showing the hosel offset distance 83, a honeycomb height 85*a* and a honeycomb width 85*b* of the individual honeycomb-like features. As shown, there are three rows of honeycomb-like features that encircle the hosel. More or less rows may be used, and the height 85*a* and width 85*b* may be varied. The honeycomb height 85*a* may range from about 2 mm to about 30 mm and the width 85*b* may range from about 1 mm to about 42 mm. The honeycomb pattern extends from about 10 mm to about 30 mm. However, the honeycomb pattern may extend further or less depending on the hosel length and desire to adjust the weight savings. Additionally and/or alternatively, the honeycomb-like pattern may take on other geometric shapes, such as, for example, a triangle, square, pentagon, hexagon, octagon, or a circle, and/or a combination of shapes.

Figure 14A:
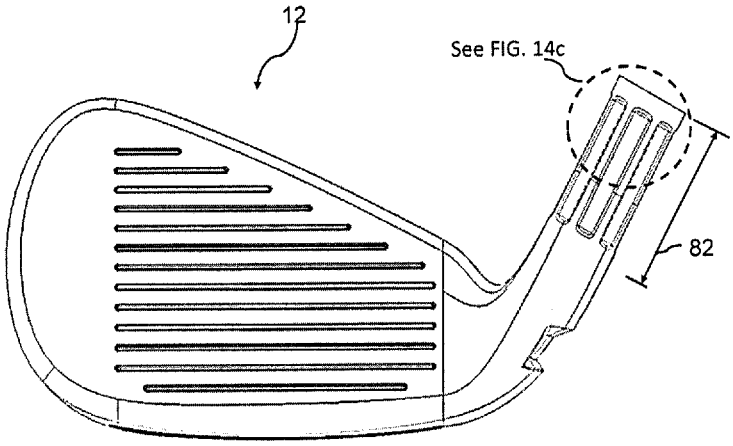
FIG. 14*a* is front elevation view of an iron type golf club head embodying another lightweight hosel design.
Figure 14B:
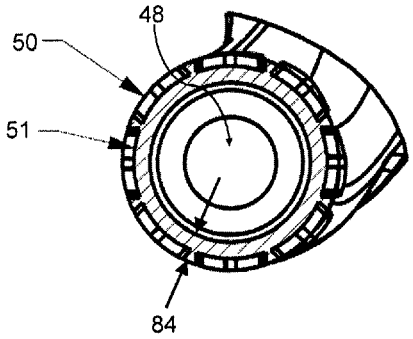
FIG. 14*b* is top elevation detail view of the golf club head of FIG. 14*a*.
Figure 14C:
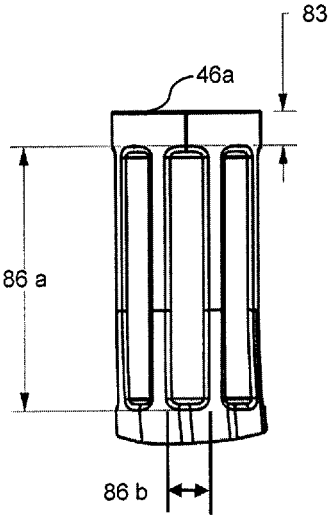
FIG. 14*c* is front elevation detail view of the golf club head of FIG. 14*a*.

Turning to FIGS. 14*a*-*c*, an alternative weight reducing feature is shown for removing hosel material. This design is a variation on the honeycomb pattern design. Similarly, this design selectively removes material from the hosel creating flutes around the hosel perimeter and along the longitudinal axis of the hosel. The flutes allow for a mass savings of at least 1 g, such as at least 2 g, such as at least 3 g, such as at least 4 g. The design may incorporate multiple flutes, such as 2 or more flutes, such as 3 or more flutes, such as 4 or more flutes, such as 5 or more flutes, such as 6 or more flutes, such as 7 or more flutes, such as 8 or more flutes. The flute design and number of flutes has a direct effect on the amount of mass savings.

In the design shown in FIGS. 14*a* and 14*c*, eight flutes are used to remove about 3 g from the hosel. The 3 g mass savings was reallocated to a lower point on the club head resulting in a downward Zup shift of about 0.6 mm while maintaining the same overall head weight. Accordingly, this fluted design removes about 1 g less material compared to the honeycomb design, but results in the same Zup shift as the honeycomb design. This is because material removed from points relatively far from the CG have a greater impact on Zup.

FIGS. 14*b*-14*c* are detail views of the flute design. Specifically, FIG. 14*b* is a top detail view of the design shown in FIG. 14*a* showing the hosel bore 48, the hosel outer diameter 50, hosel outer diameter 51, and the hosel wall thickness 84. FIG. 14*c* is a detail view of the flute pattern showing the hosel offset distance 83, a flute height 86 *a* and a flute width 86*b* of the individual flute features. As shown, there is a single row of flute features that encircle the hosel. More rows may be used, and the height 86*a* and width 86*b* may be varied. The flute height 86*a* may range from about 2 mm to about 30 mm and the width 86*b* may range from about 1 mm to about 42 mm. The flute pattern extends from about 10 mm to about 30 mm. However, the flute pattern may extend further or less depending on the hosel length and desire to adjust the weight savings.

The flute design selectively reduces the hosel wall thickness by varying the outer hosel wall diameter. The outer hosel wall diameter ranges from about 11.6 mm to about 13.6 mm. The flute design like the honeycomb design is offset from hosel top edge 46*a* by about 2 mm to about 4 mm. The hosel bore diameter ranges from about 9.0 mm to about 9.6 mm resulting in a hosel wall thickness ranging from about 1.0 mm to about 2.3 mm. The flute pattern may have a length along the longitudinal axis of the hosel ranging from about 10 mm to about 30 mm. The pattern may extend further or less along the longitudinal axis of the hosel to adjust the weight savings. For example, a club with a longer hosel length, such as a sand wedge, the pattern may extend about 20 mm to about 50 mm.

The flute design may be angled relative to longitudinal axis of the hosel or it may be aligned with the longitudinal axis of the hose. The flute widths and flute heights may all be the same or vary along the hosel depending on the desired weight savings. The flute width is the horizontal distance measured from a first flute edge to a second flute edge, and the flute width is at least 1 mm and may range from about 1 mm to about 20 mm, preferably about 3 mm to about 5 mm. The flute length is the vertical distance measured from a top of the flute to a bottom of the flute, and the flute length is at least 4 mm and may range from about 5 mm to about 50 mm, such as about 10 mm to about 35 mm, or such as about 15 mm to about 25 mm. Alternatively, a pattern of flutes having smaller flute lengths may be used instead of long flutes. For example, two or more flutes may be stacked on top of one another to create a flute pattern similar to the honeycomb pattern discussed above.

Turning to FIGS. 15*a*-*d*, an alternative weight reducing feature is shown for removing hosel material. Like the previous design, this design selectively removes material from the hosel by creating thru-slots around the hosel perimeter and along the longitudinal axis of the hosel. The thru-slots allow for a mass savings of at least 1 g, such as at least 2 g, such as at least 3 g, or such as at least 4 g. The design may incorporate multiple thru-slots, such as 2 or more thru-slots, such as 3 or more thru-slots, such as 4 or more thru-slots, such as 5 or more thru-slots, such as 6 or more thru-slots, such as 7 or more thru-slots, or such as 8 or more thru-slots. The thru-slots design and number of thru-slots has a direct effect on the amount of mass savings.

In the design shown in FIGS. 15*a*-*d*, six thru-slots are used to remove about 2 g from the hosel. The 2 g mass savings was reallocated to a lower point on the club head resulting in a downward Zup shift of about 0.7 mm while maintaining the same overall head weight. Accordingly, the thru-slot design removed about 2 g less material compared to the honeycomb design, and resulted in an improved Zup shift over the honeycomb design.

Figure 15A:
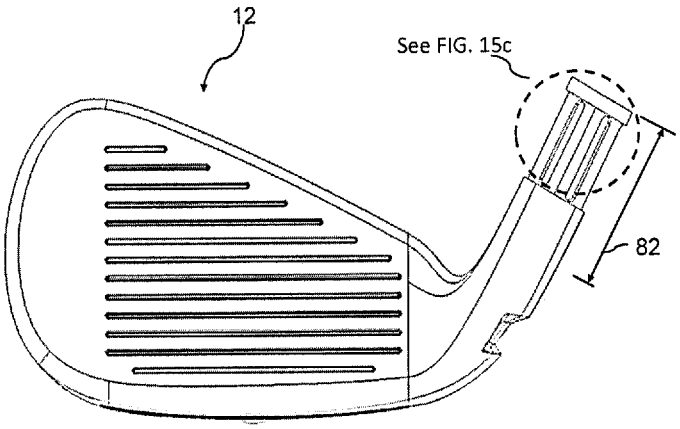
FIG. 15*a* is front elevation view of an iron type golf club head embodying another lightweight hosel design.
Figure 15B:
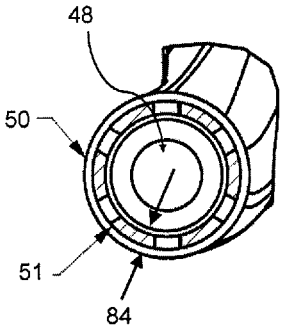
FIG. 15*b* is top elevation detail view of the golf club head of FIG. 15*a*.
Figure 15C:
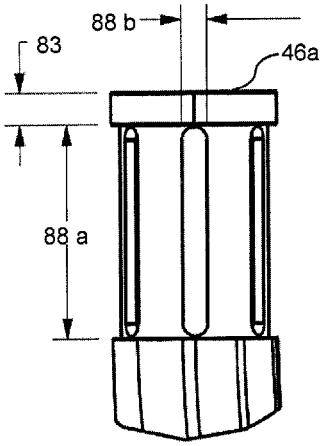
FIG. 15*c* is front elevation detail view of the golf club head of FIG. 15*a*.

FIGS. 15*b*-15*c* are detail views of the slot design. Specifically, FIG. 15*b* is a top detail view of the design shown in FIG. 15*a* showing the hosel bore 48, the hosel outer diameter 50, hosel diameter 51, and the hosel wall thickness 84. FIG. 15*c* is a detail view of the slot pattern showing the hosel offset distance 83, a slot height 88*a* and a slot width 88*b* of the individual slot features. As shown, there is a single row of slot features that encircle the hosel. More rows may be used, and the height 88*a* and width 88*b* may be varied. The slot height 88*a* may range from about 2 mm to about 30 mm and the width 88*b* may range from about 1 mm to about 42 mm. The slot pattern extends from about 10 mm to about 30 mm. However, the slot pattern may extend further or less depending on the hosel length and desire to adjust the weight savings.

The thru-slot design selectively reduces the hosel wall thickness around the perimeter of the hosel. As shown in FIG. 15*c*, the slot pattern is offset from the hosel top edge

46*a* by about 2 mm to about 5 mm. Where the slot pattern begins, the hosel diameter reduces to about 11.6 mm and continues to be reduced over the hosel weight reduction zone 82.

Figure 15D:
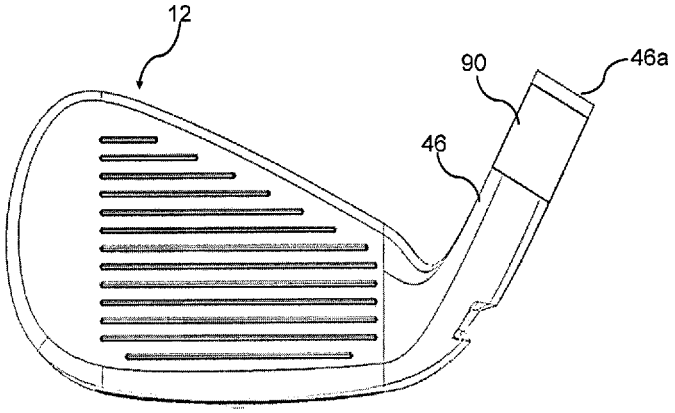
FIG. 15*d* is a front elevation view of an iron type golf club head embodying another lightweight hosel design.

Turning to FIG. 15*d*, the thru-slot design includes a sleeve 90 to cover the slots. The sleeve helps prevent the adhesive used to secure the golf club shaft to the iron type golf club from flowing out of the slots. Additionally, the sleeve helps maintain a traditional hosel outer diameter of about 13.0 mm to about 13.6 mm, which helps accommodate traditional bending tools. Without the sleeve, the bond of the shaft to the iron-type golf club head may be insufficient to withstand repeated use, and bending tools would cause greater stress on the hosel due to the slop. The sleeve is made of plastic, but may be made of any material preferably having a density less than the material being removed.

The slot design selectively reduces the hosel wall thickness by varying the outer hosel wall diameter. The outer hosel wall diameter ranges from about 11.6 mm to about 13.6 mm. The slot design like the honeycomb design is offset from hosel top edge 46*a* by about 2 mm to about 4 mm. The hosel bore diameter ranges from about 9.0 mm to about 9.6 mm resulting in a hosel wall thickness ranging from about 1.0 mm to about 2.3 mm. The slot pattern may have a length along the longitudinal axis of the hosel ranging from about 10 mm to about 30 mm. The pattern may extend further or less along the longitudinal axis of the hosel to adjust the weight savings. For example, for a club with a longer hosel length, such as a sand wedge, the pattern may extend about 20 mm to about 50 mm.

The slot design may be angled relative to longitudinal axis of the hosel or it may be aligned with the longitudinal axis of the hose. Additionally, each slot has a slot width and a slot length. The slot widths and slot lengths may all be the same or vary along the hosel depending on weight savings. The slot width is the horizontal distance measured from a first slot edge to a second slot edge, and the slot width is at least 1 mm and may range from about 1 mm to about 8 mm, preferably about 3 mm to about 5 mm. The slot length is the vertical distance measured from a top of the slot to a bottom of the slot, and the slot length is at least 5 mm and may range from about 5 mm to about 50 mm, such as about 10 mm to about 35 mm, such as about 15 mm to about 25 mm. Alternatively, a pattern of slots having smaller slot heights or widths may be used instead of long slots. For example, two or more slots may be stacked on top of one another to create a slot pattern.

For each of the above designs, by increasing the depth, width, and/or length of the weight reducing features even more mass savings may be had due to more material being removed. However, it is most beneficial to remove material that is furthest away from the club head CG because this has the most substantial effect on shifting Z-up downward. As discussed above, a lower Z-up promotes a higher launch and allows for increased ball speed depending on impact location.

By using the weight reducing features discussed above, a mass of at least 2 g to at least 4 g may be removed from the hosel and positioned elsewhere on the club to promote better ball speed. For a club that does not include the weight reducing features discussed above the mass of the hosel in the bond length region is about 12.7 g to about 13.0 g. Where the bond length region is about 25.4 mm plus about 2.5 mm of offset from the hosel top edge, or about 28 mm. By employing the weight reducing features, a traditional length hosel can be maintained while reducing the overall mass of the hosel. Over approximately 28 mm of hosel length the hosel mass can be reduced to less than about 11.0 g, such as less than about 10.5 g, such as less than about 10.0 g, such as less than about 9.5 g, such as less than about 9.0 g, such as less than about 8.7 g.

Similarly, by employing the weight reducing features the mass per unit length of the hosel can be reduced compared to a club without the weight reducing features. A club without the weight reducing features discussed above has a mass per unit length of about 0.454 g/mm, whereas a club employing the weight reducing features discussed above has a mass per unit length of less than about 0.40 g/mm, such as less than about 0.35 g/mm, such as less than about 0.30 g/mm, or such as less than about 0.26 g/mm. The weight reducing features may be applied over a hosel length of at least 10 mm, such as at least 15 mm, at least 20 mm, at least 25 mm, at least 30 mm, at least 35 mm, or at least 40 mm.

As discussed above, the iron type golf club head has a certain CG location. The CG location can be measured relative to the x, y, and z-axes. An additional measurement may be taken referred to as Z-up. The Z-up measurement is the vertical distance to the club head CG taken relative to the ground plane when the club head is soled and in the normal address position. It is important to understand that the hosel is a large chunk of mass that greatly impacts the CG location of the club head. Accordingly, removing mass from the hosel and repositioning the mass at or below the CG, such as, the sole of the club, can significantly impact the CG location of the club head. For example, by employing the weight reducing features, the Z-up shifted downward at least 0.5 mm and in some instances at least 1.5 mm. This Z-up shift was accomplished while maintaining a traditional hosel length and hosel diameter.

Light Weight Topline Construction

Turning attention to FIGS. 16-20, several designs are shown for achieving a lighter weight topline by employing a weight reducing feature over a topline weight reduction zone 91. As shown in FIG. 16*a*, the topline weight reduction zone 91 extends over the entire face length 56 from the par line 57 to the toe portion 24 ending at approximately the Z-up location of the iron type golf club head 12. However, the topline weight reduction zone 91 may be made into smaller zones, such as, for example, two, three, or four different zones. As shown in FIG. 16*a*, the face length 56 is broken into three zones, a first zone 56*a*, a second zone 56*b*, and a third zone 56*c*. The zones may be equal in length or of variable length. The first zone 56*a* will have the most drastic impact on shifting Z-up because it is furthest from the CG, but it will not have a substantial impact on shifting the CG-x towards the toe. The third zone 56*c* will have the least impact on shifting Z-up, but mass removed from the third zone 56*c* may be used to shift CG-x towards the toe. The middle zone may be used to shift both Z-up and CG-x, but will have a lesser impact on Z-up than first zone 56*a* and a lesser impact on CG-x than third zone 56*c* because the mass located in this zone is already near the Z-up location and the CG-x location.

Each of weight reducing designs maintains a "traditional" face height for maintain a traditional profile while offering a savings from about 2 g to about 18 g in the topline weight reduction zone 91, and provides a downward CG-Z shift of at least 0.4 mm to at least 2.0 mm. This large downward CG-Z shift is the result of mass being removed from locations away from the club head CG and repositioned to a position at or below the club head CG, such as, for example, the sole of the club. Furthermore, the additional structural material removed from the hosel can be relocated to another location on the club, such as the toe portion of the club, to provide a lower center of gravity, increased moments of inertia, or other properties that result in enhanced ball striking performance for the club head.

The weight reducing designs generally have a topline thickness ranging from about 3 mm to about 12 mm. Several of the designs selectively thin portions of the topline resulting in a thinner topline. As a result, a topline wall thickness ranges from of about 1.0 mm to about 8 mm. The topline weight reduction zone 91 extends from about 10 mm to about 80 mm. However, the topline weight reduction zone 91 may extend further or less depending on the face length and desire to adjust the weight savings. For example, a club with a longer face length may have a larger weight reduction zone.

Figure 16B:
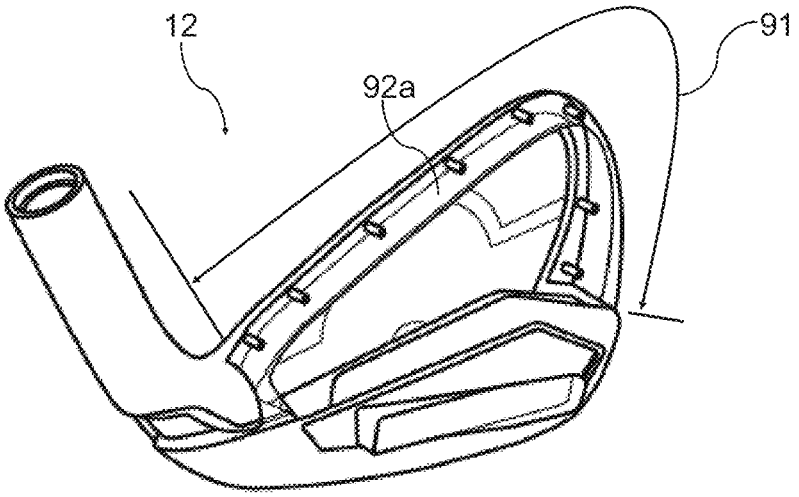
FIG. 16*b* is a rear perspective view of the golf club head of FIG. 13*a*.
Figure 16C:
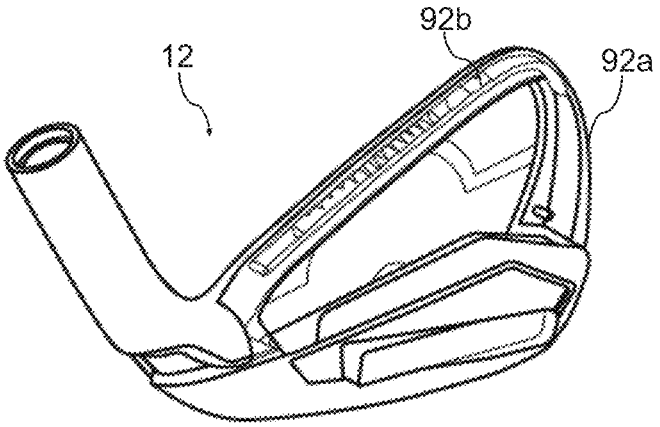
FIG. 16*c* is a rear perspective view of an alternative embodiment to the golf club head of FIG. 13*a*.

As shown, in FIGS. 16*a-c* the design uses a plastic topline 92*a* as a weight reducing feature to reduce the weight across the entire topline weight reduction zone 91. The plastic topline is an efficient way of removing mass from the topline. The plastic topline 92*a* design removes at least 10 g, such as at least 15 g, such as at least 17 g, or such as at least 20 g of mass from the topline. In the design shown, about 18 g was removed from the topline and reallocated to a lower point on the club head resulting in a downward Zup shift of about 1.8 mm while maintaining the same overall head weight.

The plastic material may be made from any suitable plastic including structural plastics. For the designs shown, the parts were modeled using Nylon-66 having a density of 1.3 g/cc, and a modulus of 3500 megapascals. However, other plastics may be perfectly suitable and may obtain better results. For example, a polyamide resin may be used with or without fiber reinforcement. For example, a polyamide resin may be used that includes at least 35% fiber reinforcement with long-glass fibers having a length of at least 10 millimeters premolding and produce a finished plastic topline having fiber lengths of at least 3 millimeters. Other embodiments may include fiber reinforcement having short-glass fibers with a length of at least 0.5-2.0 millimeters pre-molding. Incorporation of the fiber reinforcement increases the tensile strength of the primary portion, however it may also reduce the primary portion elongation to break therefore a careful balance must be struck to maintain sufficient elongation. Therefore, one embodiment includes 35-55% long fiber reinforcement, while an even further embodiment has 40-50% long fiber reinforcement.

One specific example is a long-glass fiber reinforced polyamide 66 compound with 40% carbon fiber reinforcement, such as the XuanWu 5 XW5801 resin having a tensile strength of 245 megapascal and 7% elongation at break. Long fiber reinforced polyamides, and the resulting melt properties, produce a more isotropic material than that of short fiber reinforced polyamides, primarily due to the three dimensional network formed by the long fibers developed during injection molding.

Another advantage of long-fiber material is the almost linear behavior through to fracture resulting in less deformation at higher stresses. In one particular embodiment the plastic topline is formed of a polycaprolactam, a polyhexamethylene adipinamide, or a copolymer of hexamethylene diamine adipic acid and caprolactam. However, other embodiments may include polypropylene (PP), nylon 6 (polyamide 6), polybutylene terephthalates (PBT), thermoplastic polyurethane (TPU), PC/ABS alloy, PPS, PEEK, and semi-crystalline engineering resin systems that meet the claimed mechanical properties.

In another embodiment the plastic topline is injection molded and is formed of a material having a high melt flow rate, namely a melt flow rate (275°/2.16 Kg), per ASTM D1238, of at least 10 g/10 min. A further embodiment is formed of a non-metallic material having a density of less than 1.75 grams per cubic centimeter and a tensile strength of at least 200 megapascal; while another embodiment has a density of less than 1.50 grams per cubic centimeter and a tensile strength of at least 250 megapascal.

FIGS. 16*b*-16*c* are rear views of two different plastic topline designs. Specifically, FIG. 16*b* is a rear view of a purely plastic topline 92 *a* design that is adhesive secured to the iron type golf club. Additionally and/or alternatively, the plastic topline may be co-molded onto the iron type golf club. FIG. 16*c* is a rear view of a second plastic topline 92*b* design that includes a steel rib inside of the topline for added stiffness. The design shown in FIG. 16*b* had a mass savings of about 18 g, a Zup shift of about 1.8 mm, a first mode frequency of 1828 Hz, and tau time (frequency duration) of 7.5 ms. The design shown in FIG. 16*c* made a slight improvement to sound and tau time with a frequency of 1882 Hz, and a duration of 6.5 ms. However, the mass saving was reduced to about 13 g and, a Zup shift of about 1.5 min.

Although, the mass savings and Zup shift is impressive for these two designs, the frequency far below 3000 Hz is unacceptable for most golfers, and the frequency duration is borderline acceptable. For comparison, the baseline club without any weight reduction done to the topline has a first mode frequency of 3213 Hz and a frequency duration of 4.4 ms. Accordingly the next several designs focus on improving the frequency while still achieving a modest weight savings and Zup shift. The frequency of these designs would likely be improved if weight reduction was targeted to only zone 56*a*, or zones 56*a* and 56*c*.

Figure 17A:
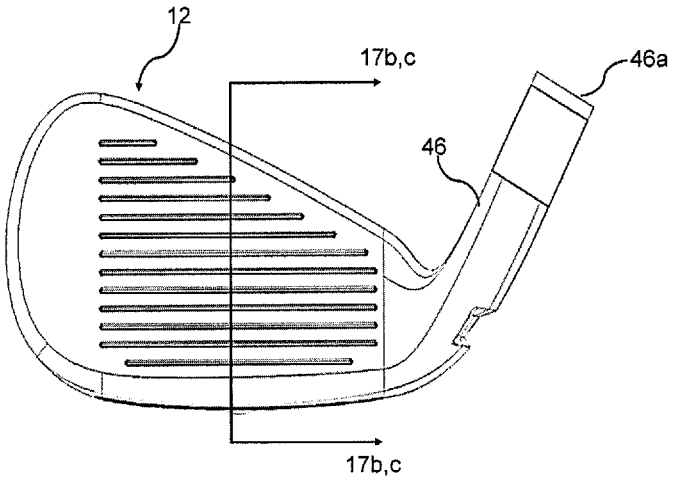
FIG. 17*a* is a front elevation view of another embodiment of an iron type golf club head embodying a lightweight topline design.
Figure 17B:
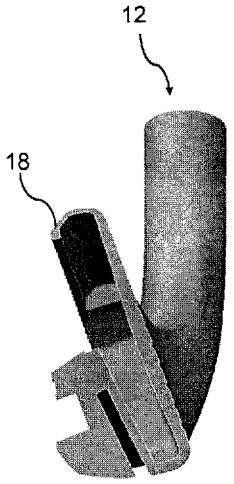
FIG. 17*b* is a section view of the golf club head of FIG. 17*a*.
Figure 17C:
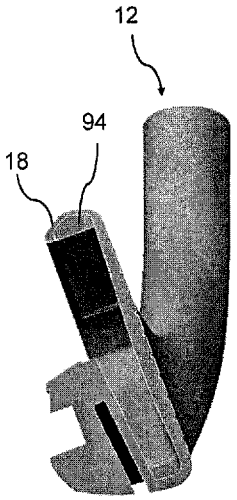
FIG. 17*c* is a section view of an alternative embodiment to the golf club head of FIG. 17*a*.

Turning to FIGS. 17*a-c*, alternative designs are shown for removing topline material. These designs selectively remove material from the existing topline to create a rib like structure along the entire topline weight reduction zone 91, however the traditional look of the topline is maintained and the weight reduction is not visible to the golfer. Thinning the topline allows for a mass savings of at least 5 g, such as at least 7 g, such as at least 9 g, such as at least 11 g.

Turning to FIGS. 17*b* and 17*c*, section views are shown so that the thin topline is visible. The design shown in FIG. 17*b* had a mass savings of about 10 g, a Zup shift of about 1.3 mm, a first mode frequency of 3092 Hz, and tau time (frequency duration) of 6.6 ms. The design shown in FIG. 17*c* put back some of the material removed in the form of a plastic topline insert 94 made of Nylon-66. This was done in an attempt to dampen the frequency and frequency duration. The frequency duration decreased to 5.9 ms, but surprisingly the frequency stayed about the same at 3086 Hz. The mass saving was reduced to about 8 g and, and the Zup shift decreased to about 1.2 mm. Although, the mass savings and Zup shift is more modest for these two designs, the frequency is above 3000 Hz, which is acceptable for most golfers, and the frequency duration being below 7 ms is also acceptable.

As already discussed above, instead of reducing weight across the entire topline weight reduction zone 91, a more targeted approach that targets different zones, such as, for example, the first zone 56*a*, the second zone 56*b*, and the third zone 56*c*, may be a better approach to balancing mass reduction and acoustic performance. As already discussed, removing material from the first zone 56*a* allows for a greater impact on Zup, while removing material from the third zone 56*c* allows for a greater impact to CG-x with only a minor impact to Z-up. Accordingly, if the goal is to shift Zup, then removing mass from the first zone 56*a* is more modest approach that would provide better acoustic properties.

Figure 18A:
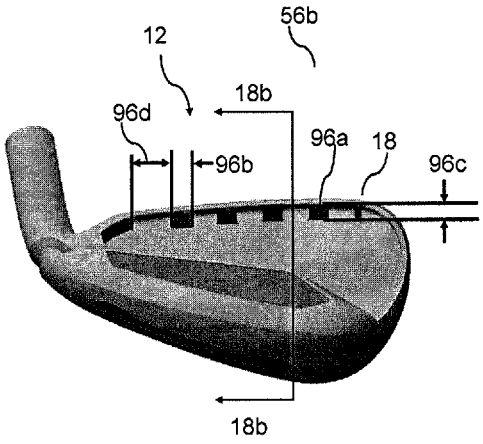
FIG. 18*a* is a rear perspective view of another embodiment of an iron type golf club head embodying a lightweight topline design.
Figure 18B:
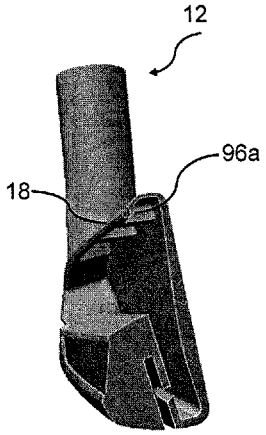
FIG. 18*b* is a section view of the golf club head of FIG. 18*a*.

Turning to FIGS. 18*a*-*b*, an alternative weight reducing feature is shown for removing topline material. Like the previous design, this design selectively removes material from the topline. However, instead of using a plastic insert to increase stiffness steel ribs 96*a* are spaced along the entire topline weight reduction zone 91. The steel ribs 96*a* have a rib width 96*b*, a rib height 96*c*, and a rib spacing 96*d*. The ribs may range in width from about 3 mm to about 10 mm, preferably about 4.5 mm to about 7 mm. The ribs may range in height from about 2 mm to about 10 mm, or preferably about 3 mm to about 7 mm. The rib spacing is measured from the end of one rib to beginning of the next rib and may range from about 3 mm to about 10 mm, preferably about 5 mm to about 8 mm.

The design shown in FIGS. 18*a*, 18*b* have a mass savings of about 5 g, a Zup shift of about 0.9 mm, a first mode frequency of 3122 Hz, and tau time (frequency duration) of 5.7 ms. Although, the mass savings and Zup shift is more modest for this design, the frequency is above 3100 Hz, which is acceptable for most golfers, and the frequency duration being below 6 ms is also acceptable.

Figure 19A:
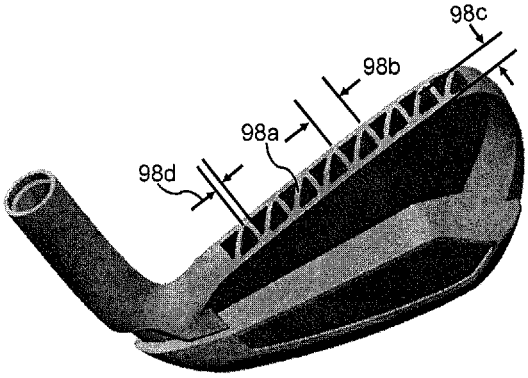
FIG. 19*a* is a rear perspective view of another embodiment of an iron type golf club head embodying a lightweight topline design.
Figure 19B:
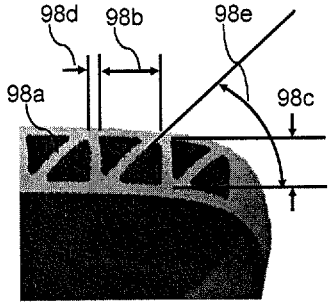
FIG. 19*b* is a detailed view of the golf club head of FIG. 19*a*.
Figure 20A:
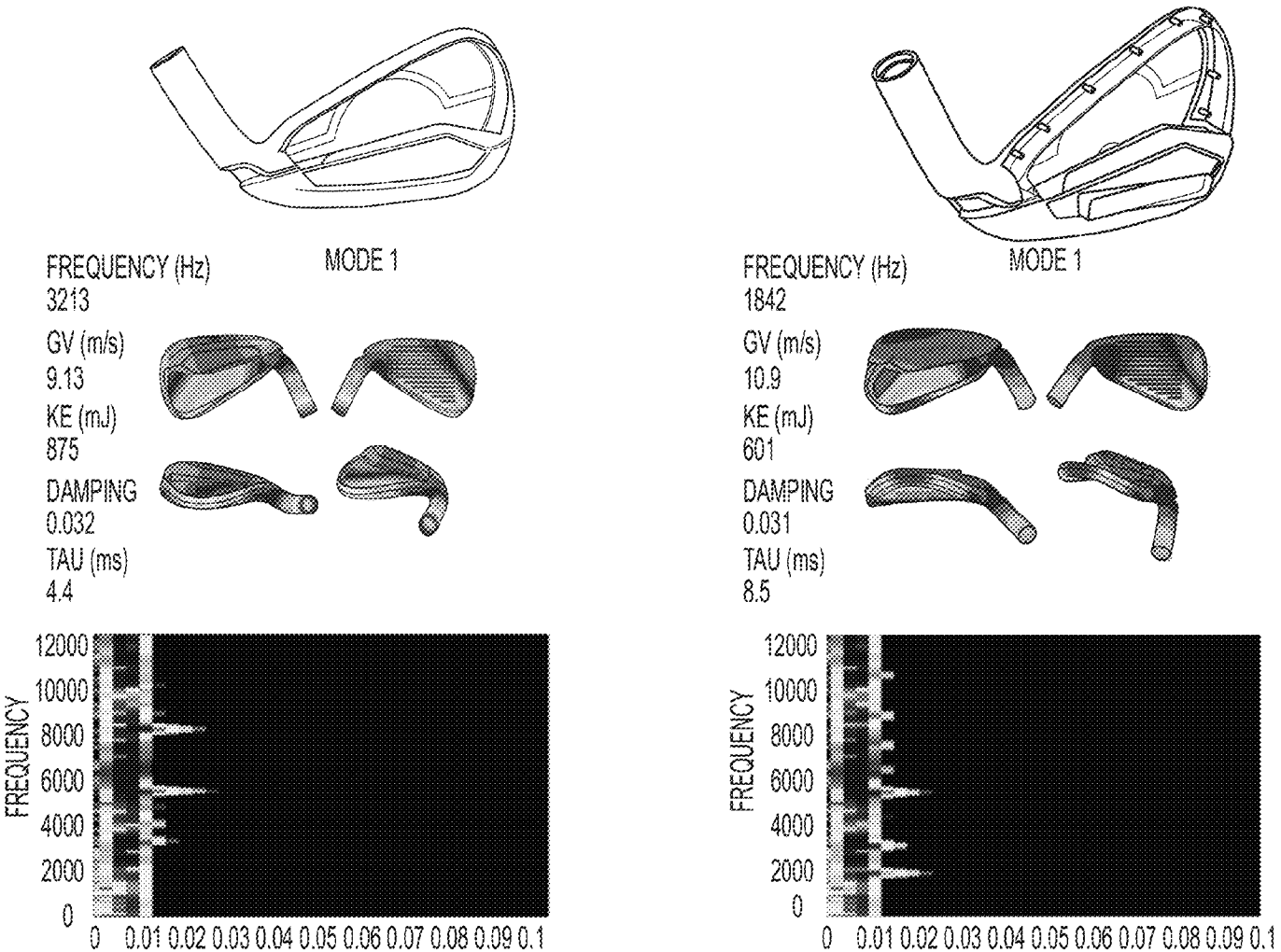
FIG. 20*a* are first modal FEA results of various golf club heads including the golf club head of FIG. 16*b*.
Figure 20B:
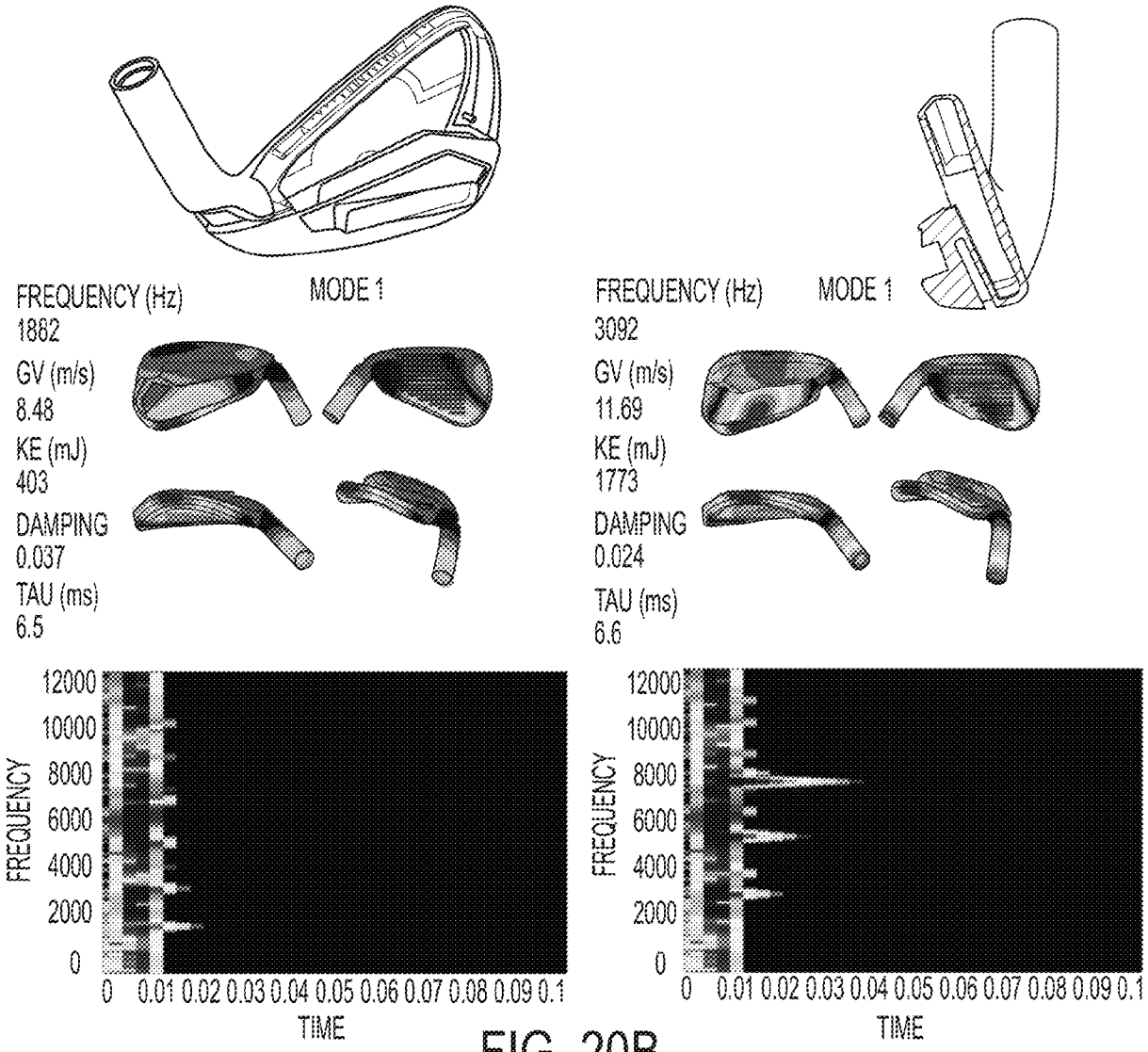
FIG. 20*b* are first modal FEA results of the golf club heads of FIG. 16*c* and FIG. 17*b*.
Figure 20C:
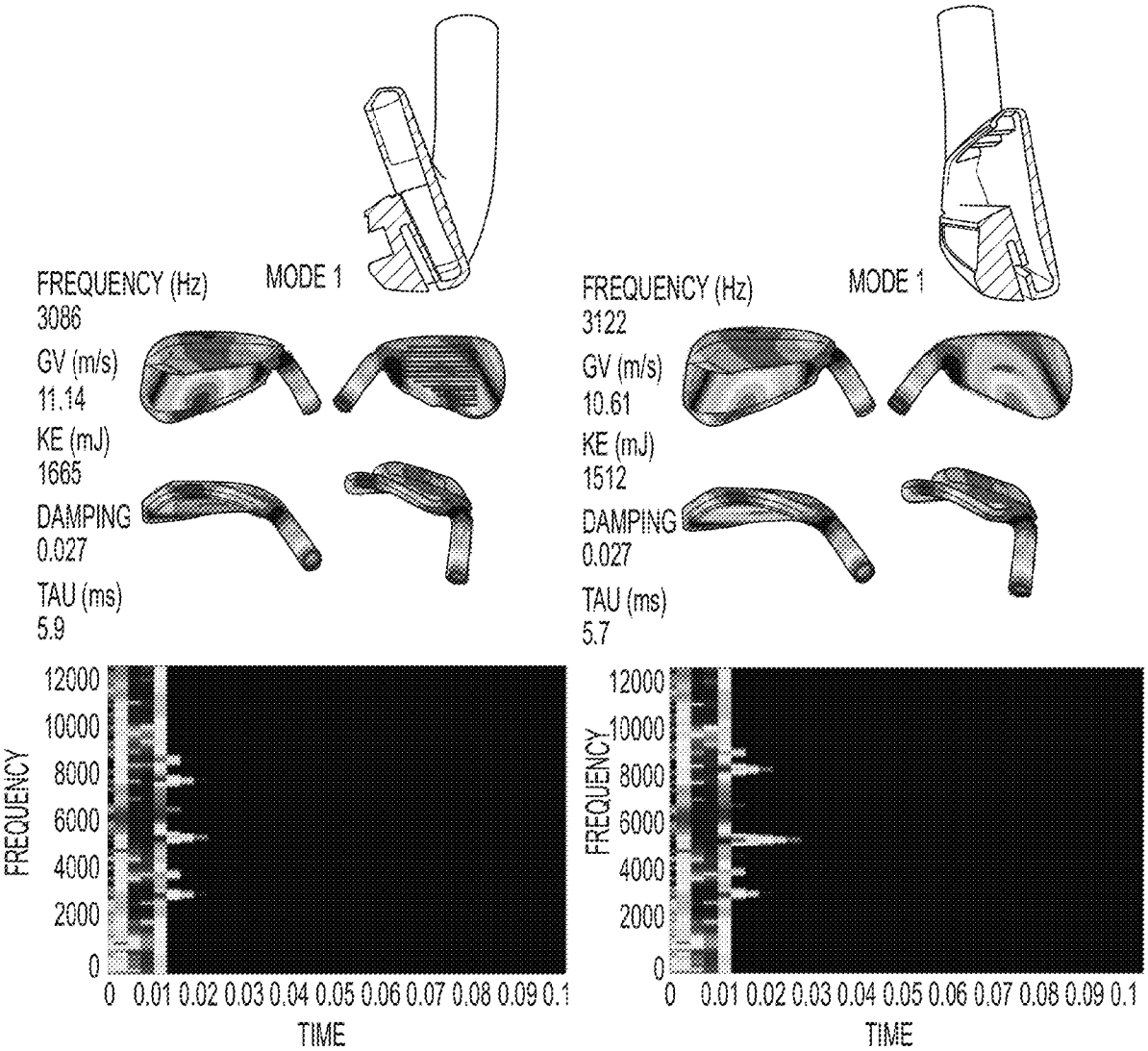
FIG. 20*c* are first modal FEA results of the golf club heads of FIG. 17*c* and FIG. 18*b*.
Figure 20D:
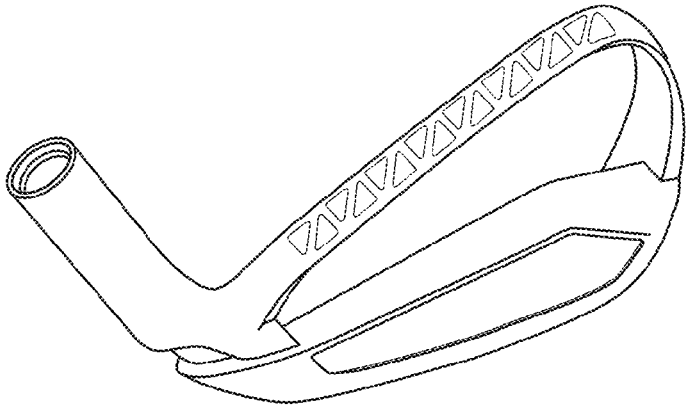
FIG. 20*d* is first modal FEA results of the golf club head of FIG. 19.
Figure 20D:
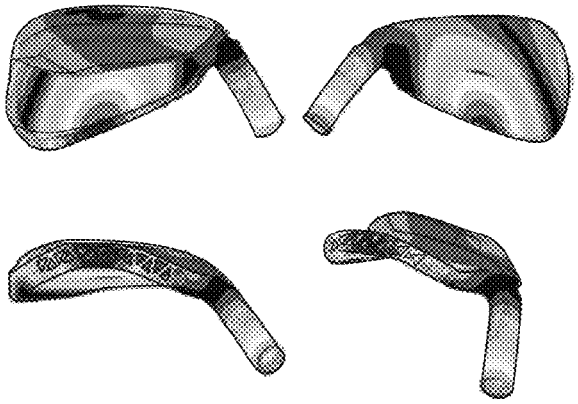
Figure 20D:
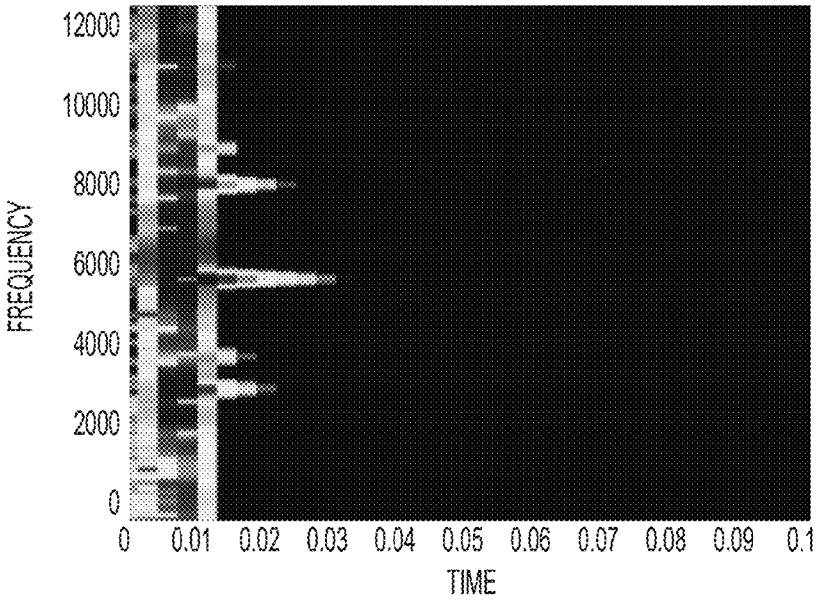

Turning to FIG. 19*a*, 19*b*, an alternative weight reducing feature is shown for removing topline material. Like the previous designs, this design selectively removes material from the topline creating. However, instead of using ribs to increase stiffness truss members 98*a* are spaced along the entire topline weight reduction zone 91. As best seen in FIG. 19*b*, the truss members 98*a* have a member width 98*b*, a member height 98*c*, a member spacing 98*d*, and have an angle 98*e* ranging from about 15 degrees to about 75 degrees relative to the topline. The members may range in width from about 0.75 mm to about 3 mm, preferably about 1.0 mm to about 1.5 mm. The members may range in height from about 2 mm to about 10 mm, preferably about 3 mm to about 7 mm. The member spacing is measured from the end of one truss to beginning of the next truss and may range from about 0.75 mm to about 5 mm, preferably about 1 mm to about 3 mm.

The design shown in FIG. 19*a*, 19*b*, has a mass savings of about 4 g, a Zup shift of about 0.9 mm, a first mode frequency of 3056 Hz, and tau time (frequency duration) of 6.5 ms. Although, the mass savings and Zup shift is more modest for this design, the frequency is above 3000 Hz, which is acceptable for most golfers, and the frequency duration being below 7 ms is also acceptable.

FIGS. 20*a*-20*d* show first modal results for each of the designs discussed above. Table 1 below summarizes the results of the first modal analysis for each of the designs. Table 1 lists several exemplary values for each of the weight reducing designs including mass savings, Zup, Zup shift, First Mode Frequency, and First Mode Duration. The measurements reported in Table 1 are without a badge, which may be used to impact the frequency and or duration, such as for example, to dampen the frequency duration.

TABLE 1

| Design | Mass Savings (g) | Zup (mm) | Zup Shift (mm) | First Mode Frequency (Hz) | First Mode Duration (ms) |
|---|---|---|---|---|---|
| Baseline | — | 18.4 | — | 3213 | 4.4 |
| 13b | 18 | 16.6 | 1.8 | 1828 | 7.5 |
| 13c | 13 | 17 | 1.5 | 1882 | 6.5 |

TABLE 1-continued

| Design | Mass Savings (g) | Zup (mm) | Zup Shift (mm) | First Mode Frequency (Hz) | First Mode Duration (ms) |
|---|---|---|---|---|---|
| 14b | 10 | 17.1 | 1.3 | 3092 | 6.6 |
| 14c | 8 | 17.2 | 1.2 | 3086 | 5.9 |
| 15b | 5 | 17.5 | 0.9 | 3122 | 5.7 |
| 16 | 4 | 17.5 | 0.9 | 3056 | 6.5 |

Each iron type golf club head design was modeled using commercially available computer aided modeling and meshing software, such as Pro/Engineer by Parametric Technology Corporation for modeling and Hypermesh by Altair Engineering for meshing. The golf club head designs were analyzed using finite element analysis (FEA) software, such as the finite element analysis features available with many commercially available computer aided design and modeling software programs, or stand-alone FEA software, such as the ABAQUS software suite by ABAQUS, Inc.

For each of the above designs, by increasing the depth, width, and/or length of the weight reducing features even more mass savings may be had due to more material being removed. However, it is most beneficial to remove material that is furthest away from the club head CG because this has the most substantial effect on shifting Z-up downward. As discussed above, a lower Z-up promotes a higher launch and allows for increased ball speed depending on impact location.

By using the weight reducing features discussed above, a mass of at least 2 g to at least 20 g may be removed from the hosel and positioned elsewhere on the club to promote better ball speed. By employing the weight reducing features the mass per unit length of the topline can be reduced compared to a club without the weight reducing features. Employing the weight reducing features over a topline length may yield a mass per unit length within the weight reduction zone of between about 0.09 g/mm to about 0.40 g/mm, such as between about 0.09 g/mm to about 0.35 g/mm, such as between about 0.09 g/mm to about 0.30 g/mm, such as between about 0.09 g/mm to about 0.25 g/mm, such as between about 0.09 g/mm to about 0.20 g/mm, or such as between about 0.09 g/mm to about 0.17 g/mm. In some embodiments, the topline weight reduction zone yields a mass per unit length within the weight reduction zone less than about 0.25 g/mm, such as less than about 0.20 g/mm, such as less than about 0.17 g/mm, such as less than about 0.15 g/mm, such as less than about 0.10 g/mm. The mass per unit length values given are for a topline made from a metallic material having a density between about 7,700 $kg/m^3$ and about 8,100 $kg/m^3$, e.g. steel. If a different density material is selected for the topline construction that could either increase or decrease the mass per unit length values. The weight reducing features may be applied over a topline length of at least 10 mm, such as at least 20 mm, such as at least 30 mm, such as at least 40 mm, such as at least 45 mm, such as at least 50 mm, such as at least 55 mm, or such as at least 60 mm.

As discussed above, the iron type golf club head has a certain CG location. The CG location can be measured relative to the x, y, and z-axis. An additional measurement may be taken referred to as Z-up. The Z-up measurement is the vertical distance to the club head CG taken relative to the ground plane when the club head is soled and in the normal address position. It is important to understand that the topline is a large chunk of mass that greatly impacts the CG location of the club head. Accordingly, removing mass from the topline and repositioning the mass at or below the CG, such as, the sole of the club, can significantly impact the CG location of the club head. For example, by employing the weight reducing features, the Z-up shifted downward at least 0.5 mm and in some instances at least 2 mm. This Z-up shift was accomplished while maintaining a traditional profile and traditional heel and toe face heights.

Adjustable Iron-Type Golf Club Construction

Figure 21:
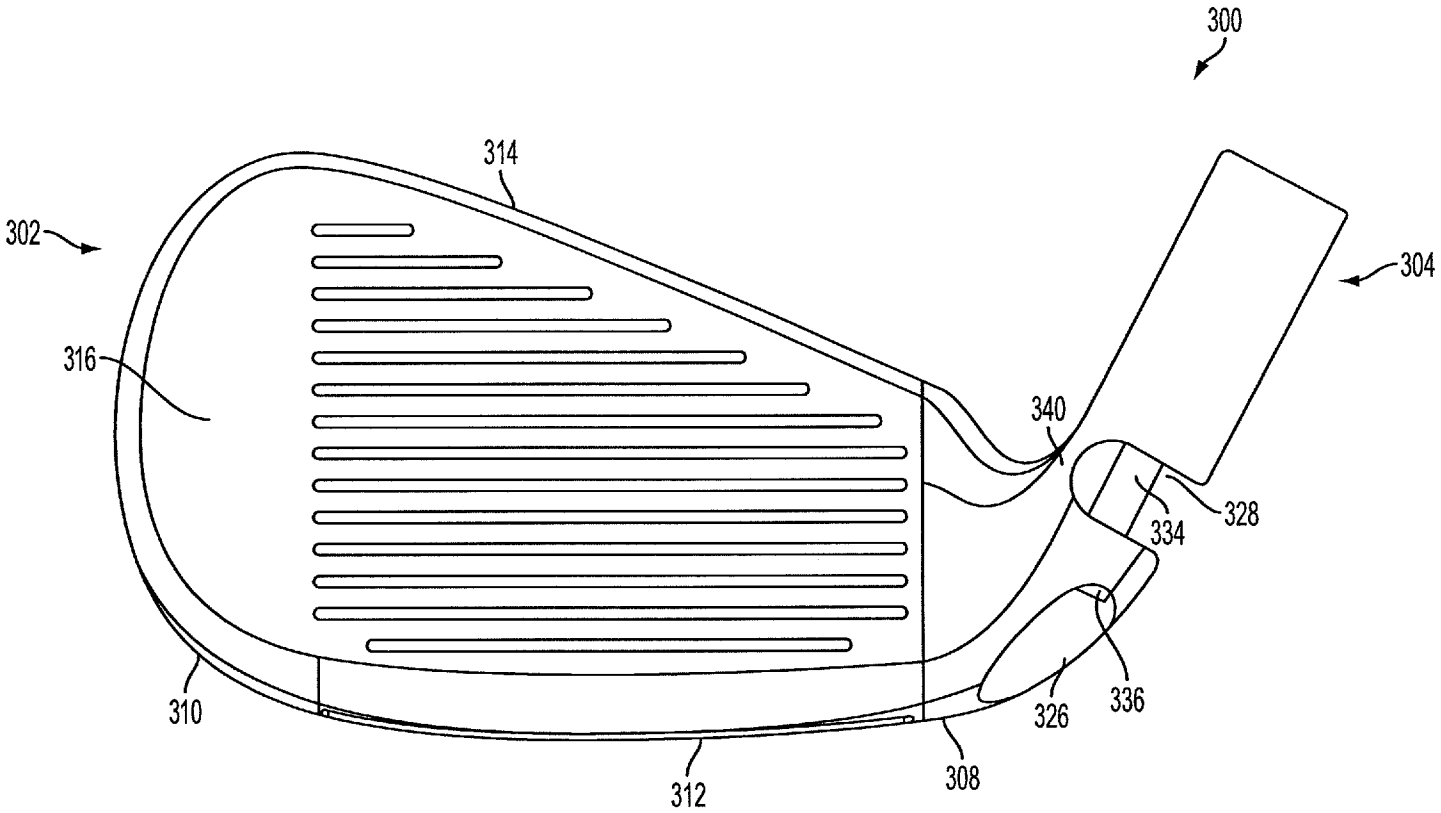
FIG. 21 shows an exemplary embodiment of an adjustable golf club head.
Figure 22:
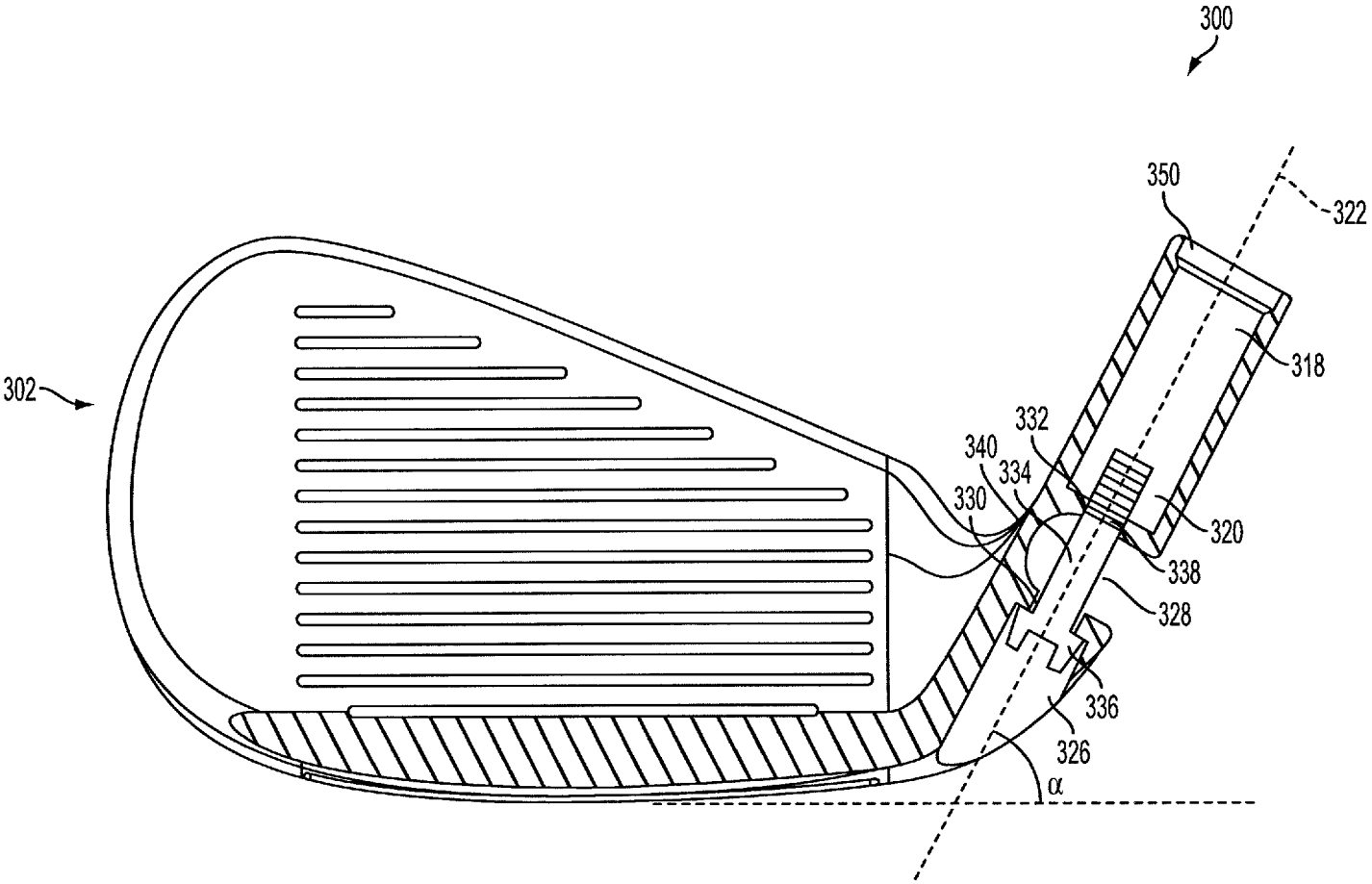
FIG. 22 shows a cross sectional view of the adjustable golf club head of FIG. 21.
Figure 23:
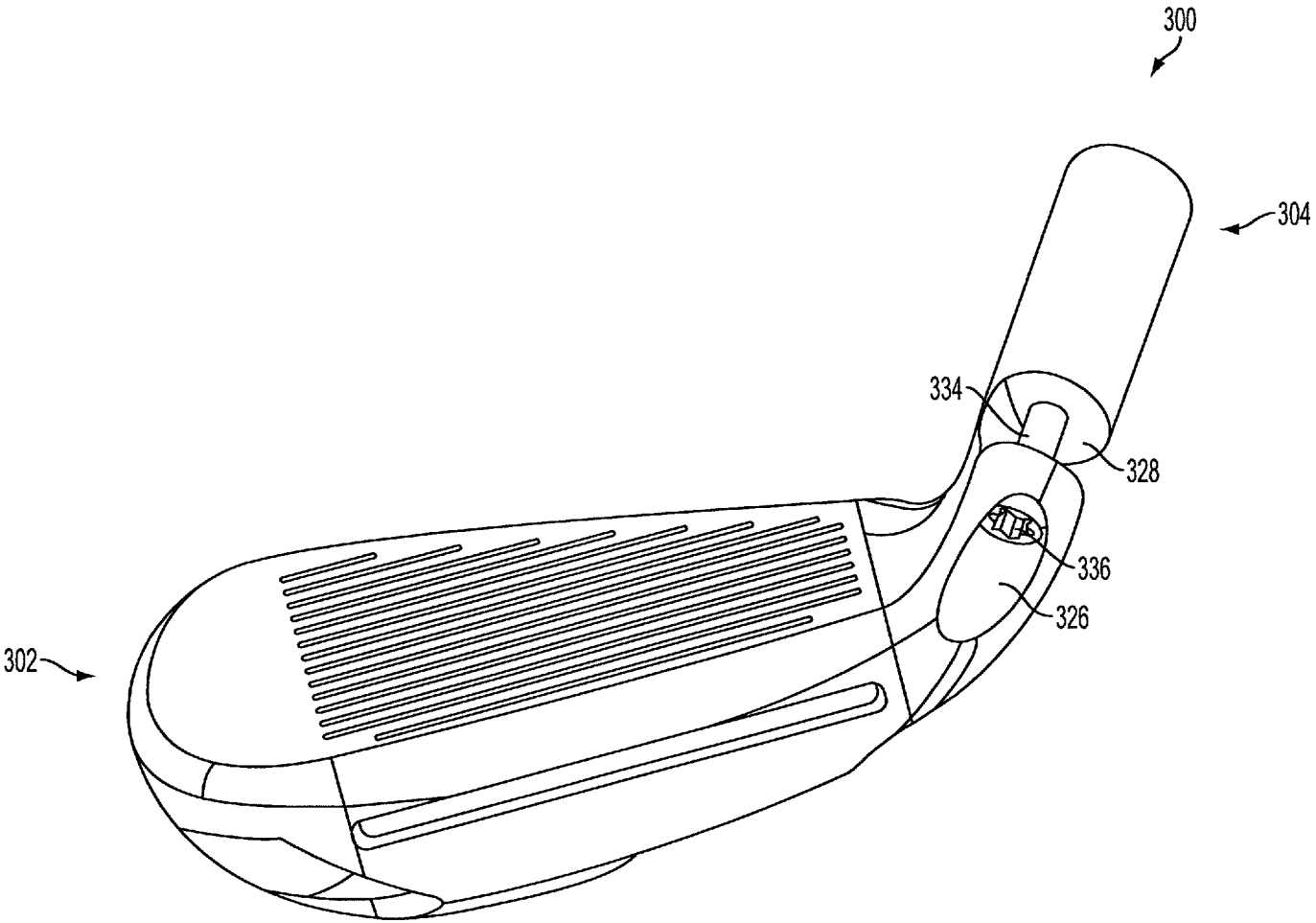
FIG. 23 shows a perspective view of the adjustable golf club head of FIG. 21.

FIGS. 21-23 show an exemplary golf club head 300 which includes a body 302 and a hosel 304 configured to allow the club head 300 to be coupled to a shaft (not pictured). The golf club head 300 can include a heel portion 308, a toe portion 310, a sole portion 312, a topline portion 314, and a striking face portion 316 configured for striking golf balls.

The hosel 304 can include a shaft bore 318 formed within the hosel 304 that extends to a distal end portion 320 of the shaft bore 318. The shaft bore 318 can have a generally cylindrical shape, and can have a central longitudinal axis 322. The shaft bore 318 can be configured to receive a distal end portion of the shaft, which can be secured in the shaft bore 318 in various manners, such as with epoxy adhesive or glue. The hosel 304 can also include a recess 350, which can facilitate the securing of the shaft to the hosel 304, for example, by allowing the use of a sealing ring (not pictured) in the recess 350. In such a configuration, a central longitudinal axis of the shaft can be aligned with the central longitudinal axis 322.

For purposes of this description, the "hosel" of a golf club head includes the portion of the club head which encloses the shaft bore and extends to within the region of the heel portion of the body. Thus, the hosel of the golf club heads described herein includes the adjustment bore, notch, openings, and other components described more fully below. Thus, the hosel of the golf club heads described herein includes what is sometimes referred to in the industry as a "hosel blend." For purposes of this description, an "upper portion of the hosel" refers to the portion of the hosel which encloses the shaft bore.

The geometry of the golf club head 300 can be adjusted and thus a golf club can be tailored to an individual golfer. That is, the geometry of the body 302 and hosel 304 of the golf club head 300 can be adjusted based on a golfer's anatomy and/or golfing technique, in order to improve the reliability and/or quality of the golfer's shot. Generally, the geometry of the golf club head 300 can be adjusted to help ensure that when a golfer swings a golf club, the striking face portion 316 of the club head 300 strikes a golf ball in a consistent and desired manner (e.g., in a way that minimizes "slice" and/or "hook," as those terms are generally understood in the game of golf).

Figure 24:
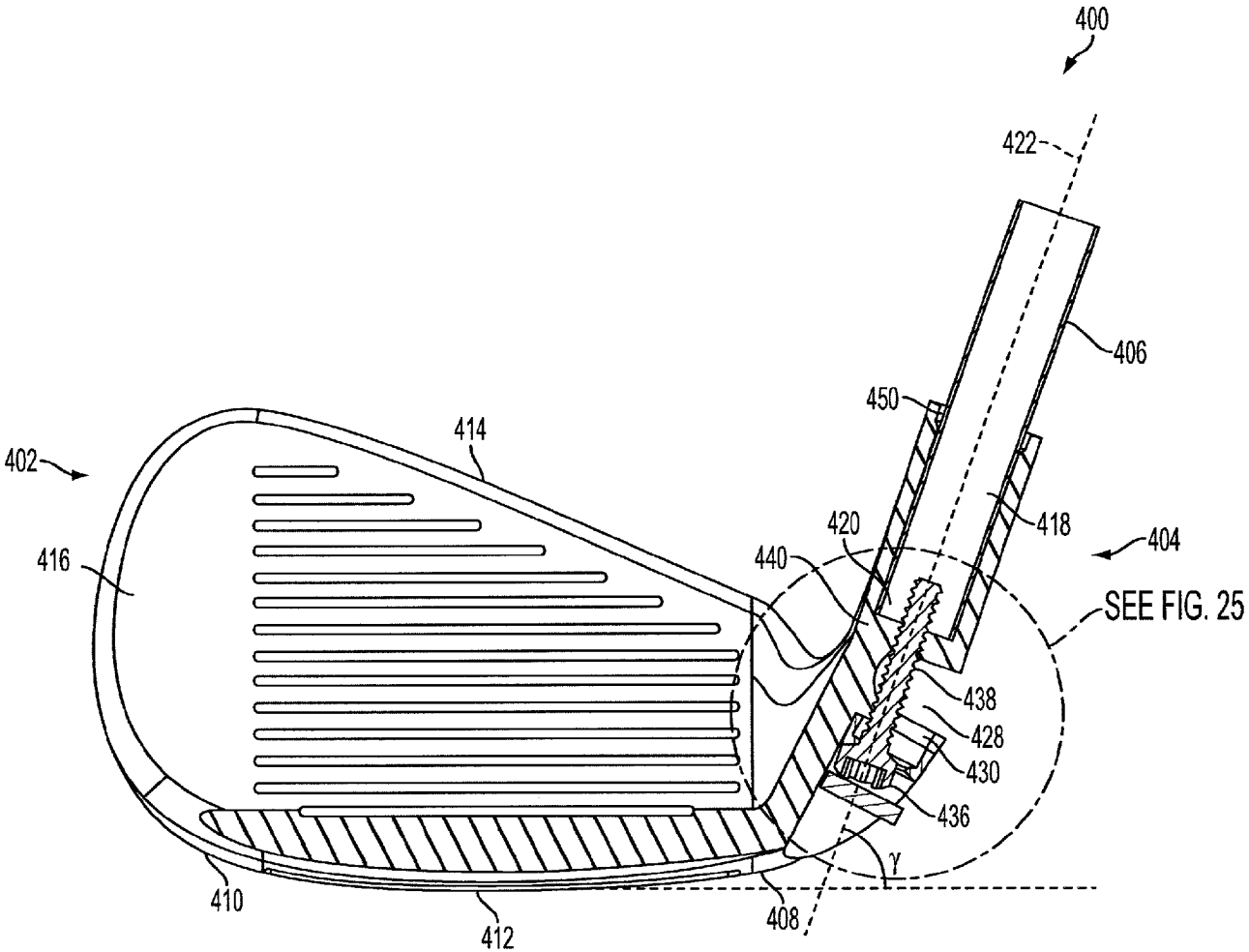
FIG. 24 shows a cross sectional view of an alternative exemplary embodiment of an adjustable golf club.

The terms "lie angle" and "loft angle" have well-understood meanings within the game of golf and the golf club industry. As used herein, these terms are intended to carry this conventional meaning. For purposes of illustration, the term "lie angle" can refer to an angle formed between the central longitudinal axis 322 of the shaft bore 318 and the ground when the sole portion 312 of the golf club head 300 rests on flat ground. For example, lie angle $\alpha$ is shown in FIG. 22 and lie angle $\gamma$ is shown in FIG. 24. Also for purposes of illustration, the term "loft angle" can refer to the angle formed between a line normal to the surface of the striking face portion 316 and the ground when the sole portion 312 of the golf club head 300 rests on flat ground. Thus, the loft and lie angles are geometrically independent of one another, and thus in various golf clubs can be adjusted either independently or in combination with one another. As one particular example, the loft and lie angles of club head 300 can each be independently adjusted by appropriately deforming the hosel 304.

FIGS. 21-23 show that a golf club head 300 can include an adjustment bore 326 and an adjustment notch 328 in the hosel 304. The adjustment bore 326 can be generally cylindrically shaped, and can open in a direction opposite that of the shaft bore 318. As discussed further below, a central longitudinal axis of the adjustment bore can be generally aligned with the axis 322 of the shaft bore 318, but can be displaced from such alignment as the geometry of the golf club head 300 is adjusted. As shown, the bores 318, 326 can have differing diameters, but in alternative embodiments, each of the bores can have any of various appropriate diameters and in some embodiments can have the same diameter. As shown, the hosel 304 can have a narrow portion, or living hinge 340, in the region of the hosel 304 opposing the notch 328. The living hinge 340 can be formed as a continuous piece of material, formed integrally with the remainder of the hosel 304, and can be configured to provide a relatively flexible location about which the club head 300 can be bent.

A first opening 330 can be provided in the hosel 304 which can connect a distal end portion of the adjustment bore 326 and the notch 328. A second opening 332 can be provided in the hosel 304 which can connect a distal end portion of the shaft bore 318 with the notch 328. As shown, the openings 330 and 332 can have diameters which are smaller than the diameters of the adjustment bore 326 and the shaft bore 318. In some embodiments, the openings 330 and 332 can be generally aligned with one another, and can have central longitudinal axes which are generally aligned with the central longitudinal axis 322 of the shaft bore 318. The opening 332 can be provided with mechanical threads extending radially inward into the opening 332.

FIGS. 21-23 show an adjustment screw 334 having a head portion 336 and a threaded portion 338 having threads complementing those of the second opening 332. As shown, the head 336 of the screw 334 can be situated in the adjustment bore 326, and the threaded portion 338 can extend from the head 336, through the first opening 330 and notch 328, be threaded through the second opening 332, and extend into the shaft bore 318. As shown, the first opening 330 can have a diameter which is smaller than a diameter of the screw head 336 but larger than a diameter of the threaded portion 338. Thus, the threaded portion 338 can move freely through the opening 330, but the screw head 336 cannot.

In this configuration, the screw 334 can be used as an actuator which can cause adjustment of the golf club head at the hinge to control geometric properties of the golf club head 300. Specifically, in the illustrated embodiment, the screw 334 can be used to modify the lie angle of the golf club head 300. When the screw 334 is tightened (e.g., threaded through the threads in the second opening 332 toward the shaft bore 318), the hosel 304 bends at the living hinge 340 such that the body 302 of the club head 300 rotates away from the hosel 304 about the hinge 340. Thus, when the screw 334 is tightened, the topline portion 314 and toe 310 of the head 300 rotate away from the hosel 304 and the lie angle $\alpha$ decreases.

A retaining ring (not pictured) can be provided within the adjustment bore 326 such that when the screw 334 is loosened (e.g., threaded through the threads in the second opening 332 away from the shaft bore 318), the hosel 304 bends at the living hinge 340 such that the body 302 of the club head 300 rotates toward the hosel 304 about the hinge 340. Thus, when the screw 334 is loosened, the topline portion 314 and toe 310 of the head 302 rotate toward the hosel 304 and the lie angle α increases. These features are described in more detail below.

A golf club can be fabricated, sold, and/or delivered with the golf club head 300 in a neutral configuration. That is, the configuration in which it is anticipated that the fewest golfers will need to adjust the lie angle, or in which it is anticipated that the average amount by which golfers need to adjust the lie angle is minimized. This neutral configuration can be determined, for example, based on expert knowledge or empirical studies. The golf club head 300 can be fabricated such that this neutral configuration is achieved by positioning the screw 334 within the adjustment bore 326 and tightening it to a predetermined degree, which can include not tightening it at all. When an individual golfer commences the process of adjusting, or "tuning," the golf club, the screw can be further tightened to decrease the lie angle, or the screw can be loosened to increase the lie angle.

By fabricating and/or selling the golf club head 300 in the neutral configuration, the number of golfers who adjust the club head 300 can be decreased, and the degree to which many golfers adjust the golf club head 300 can be reduced. This can help to reduce the stresses induced in the golf club head 300 and/or reduce the potential for developing problems of fatigue in the hinge 340. Further, a screw 334 which has been tightened to a predetermined degree can carry a net tension force, which can increase frictional forces between the screw 334 and the rest of the club head 300. Increased frictional forces can in turn help to ensure that the screw 334 is not unintentionally tightened, loosened, or removed from the openings 330 and 332, and the adjustment bore 326.

It can be desirable to design the hinge 340 to be relatively flexible so that it can be more easily bent by tightening or loosening the screw 334. This can be accomplished by reducing the cross sectional area of the hinge 340 or by forming the hinge 340 from a relatively flexible material. The hinge 340 can be made to be sufficiently flexible to allow adjustment while retaining sufficient strength to withstand stresses caused by using the club head 300 to hit a golf ball. For example, striking a golf ball with the striking face portion 316 of the club head 300 can induce torque in the hosel 304. Thus, the strength of the hinge 340, in combination with the screw 334 (which can provide additional strength) can be capable of resisting the torque experienced when the club head 300 is used to hit a golf ball. That is, the screw can act as a secondary member which increases the rigidity of the golf club head in the region of the hinge. Further, the hinge 340, in combination with the screw 334, can be capable of resisting the stresses caused by repetitive use of the club head 300 to strike golf balls, that is, they can be resistant to fatigue failure due to repetitive, cyclic stresses, for example, the stresses caused by hitting a golf ball several thousand times.

The features illustrated in FIGS. 21-23 allow the lie angle of the golf club head 300 to be adjusted more easily than the lie angle of many other known golf club heads. The lie angle of the golf club head 300 can be adjusted simply by tightening or loosening a single screw 334. For example, a golfer can adjust the lie angle α by hand or with a single hand tool (e.g., a screwdriver). This can allow repeatable, reversible, and/or rapid adjustment of the golf club head. This allows significant improvement over previous known methods in which a golf club head is plastically bent in a post manufacturing process. It also allows significant improvement over previously known systems which use an adjustable shaft attachment system, as these systems allow only incremental adjustment between predetermined, discrete angles, rather than continuous adjustment over a continuous range of angles, as in golf club head 300.

As best shown in FIGS. 21 and 22, the notch 328 can extend inward from the periphery of the hosel 304 opposite the club head body 302, through the hosel 304 toward the body 302, and stop short of the opposing periphery of the hosel 304, thus forming the hinge 340. Thus, the notch 328, the screw 334, and the hinge 340 can be aligned with each other so that tightening or loosening the screw 334 can cause a corresponding change primarily in the lie angle α, without significantly changing the loft angle, of the club head 300.

In alternative embodiments, the alignment of the notch, screw, and hinge can be displaced angularly about the central longitudinal axis of the hosel bore from the alignment of the notch 328, screw 334, and hinge 340 shown in FIGS. 21-23. In one exemplary alternative embodiment, the alignment can be angularly displaced from that illustrated in FIGS. 21-23 by about ninety degrees. In this alternative embodiment, tightening or loosening the screw can cause a corresponding change primarily in the loft angle, without significantly changing the lie angle of the golf club head. In another exemplary alternative embodiment, the alignment can be angularly displaced from that shown in FIGS. 21-23 by more than zero but less than ninety degrees. In this alternative embodiment, tightening or loosening the screw can cause a significant corresponding change in both the lie angle and the loft angle.

Figure 25:
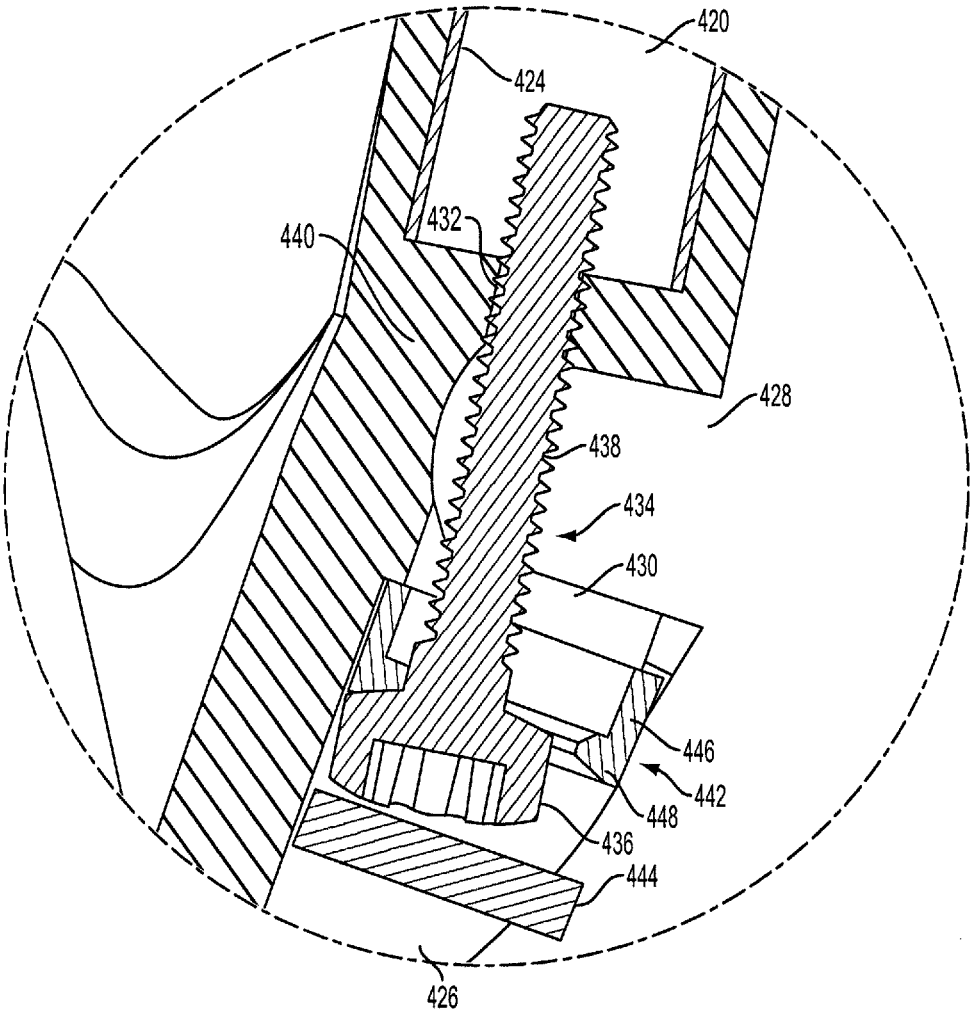
FIG. 25 shows an enlarged detailed partial cross sectional view of the adjustable golf club of FIG. 24.

FIGS. 24 and 25 show that an alternative golf club head 400 can include a body 402 and a hosel 404. The body 402 can include a heel portion 408, a toe portion 410, a sole portion 412, a topline portion 414, and a striking face portion 416. The hosel 404 can include a shaft bore 418 having a recess 450, a central longitudinal axis 422, and a distal end portion 420 which can receive and be secured to a distal end portion 424 (FIG. 25) of a shaft 406. The hosel 404 can also include an adjustment bore 426, an adjustment notch 428, a living hinge 440, a first opening 430 connecting a distal end of the adjustment bore 426 with the notch 428, and a second opening 432 connecting a distal end of the shaft bore 418 with the notch 428. An adjustment screw 434, having a head portion 436 and a threaded portion 238, can extend through the adjustment bore 426, first opening 430, notch 428, threaded opening 432, and into the shaft bore 418.

Golf club head 400 can also include a screw bearing pad 242. The bearing pad 242 can be configured to support the screw head 436 within the adjustment bore 426, separating the screw head 436 from the first opening 430. The bearing pad 242 can include a first hollow portion 246 formed integrally with a second hollow portion 248. The first hollow portion 246 can be configured to avoid interference with the screw 434 (that is, to allow the screw 434 to pass through it without contacting it), and can be positioned adjacent to the first opening 430. The second hollow portion 248 can be configured for mating with the screw head 436, in a way that facilitates some degree of lateral movement and/or rotation of the screw head 436 relative to the bearing pad 242, for example, as needed as the screw 434 is loosened or tightened.

Thus, as best shown in FIG. 25, an inside diameter of the second hollow portion 248 can be smaller than an inside diameter of the first hollow portion 246, smaller than a diameter of the screw head 436, and larger than a diameter of the threaded portion 238 of the screw 434. Thus, the screw 434 can extend through the bearing pad 242, with the screw head 436 resting on the second hollow portion 248. Tightening of the screw 434 can cause it to come into contact with the bearing pad 242, bearing against the second hollow portion 248.

Further tightening of the screw 434 through the threaded opening 432 can thus cause the screw 434 to pull the bearing pad 242 generally toward the threaded opening 432, thereby causing the golf club head 400 to bend at the living hinge 240. That is, tightening the screw 434 can cause the topline portion 414 and toe 410 of the head 400 to rotate away from the hosel 402, thereby decreasing the lie angle γ (FIG. 24) of the golf club head 400.

The bearing pad 242 can be formed integrally with the rest of the hosel 404, or can be formed separately and coupled to the hosel 404 after each has been independently formed. Thus, use of the bearing pad 242 can allow the surface on which the screw head 436 bears to be formed from a material different from that used to form the rest of the golf club head 400. Use of the bearing pad 242 can also allow the surface on which the screw head 436 bears to be replaced periodically without a golfer needing to replace the entire golf club head 400.

Golf club head 400 can also include a retaining ring 244. The retaining ring 244 can be positioned within the adjustment bore 426 and can serve to partially enclose the screw 434 within the bore 426. The retaining ring 244 can include an opening (not pictured) through which a golfer or other person can reach the screw head 436 and thereby tighten or loosen the screw 434. The retaining ring 244 can comprise an annular piece of material coupled to the hosel 404 within the bore 426. The retaining ring 244 can in some cases prevent the screw 434 from falling out of the adjustment bore 426, and can provide a bearing surface configured for mating with the screw head 436.

Loosening of the screw 434 can cause it to come into contact with and bear against the retaining ring 244. Further loosening of the screw 434 through the threaded opening 432 can thus cause the screw 434 to push the retaining ring 244 generally away from the threaded opening 432, thereby causing the golf club head 400 to bend at the living hinge 240. That is, loosening the screw 434 can cause the topline portion 414 and toe 410 of the head 400 to rotate toward the hosel 402, thereby increasing the lie angle γ of the golf club head 400.

The retaining ring 244 can be coupled to the hosel 404 by casting, welding, bonding or any other method known in the art. Use of the retaining ring 244 can allow the surface on which the screw head 436 bears to be formed from a material different from that used to form the rest of the golf club head 400. Use of the retaining ring 244 can also allow the surface on which the screw head 436 bears to be replaced periodically without a golfer needing to replace the entire golf club head 400.

FIGS. 24 and 25 show that the shaft 406 can be hollow, and can extend to the distal end portion 420 of the shaft bore 418 and be secured therein. Thus, as shown, the threaded portion 238 of the screw 434, which extends through the second opening 432 and into the distal end portion 420 of the shaft bore 418, can also extend into the distal end portion 424 of the hollow shaft 406. In some alternative embodiments, the shaft of a golf club need not extend all the way to the distal end portion of the shaft bore of the hosel. Thus, in some alternative embodiments, a solid piece of material can separate the shaft bore into two sections, with the screw extending into one section and the shaft extending into the other portion. In such an embodiment, the screw need not extend within the hollow shaft.

Figure 26:
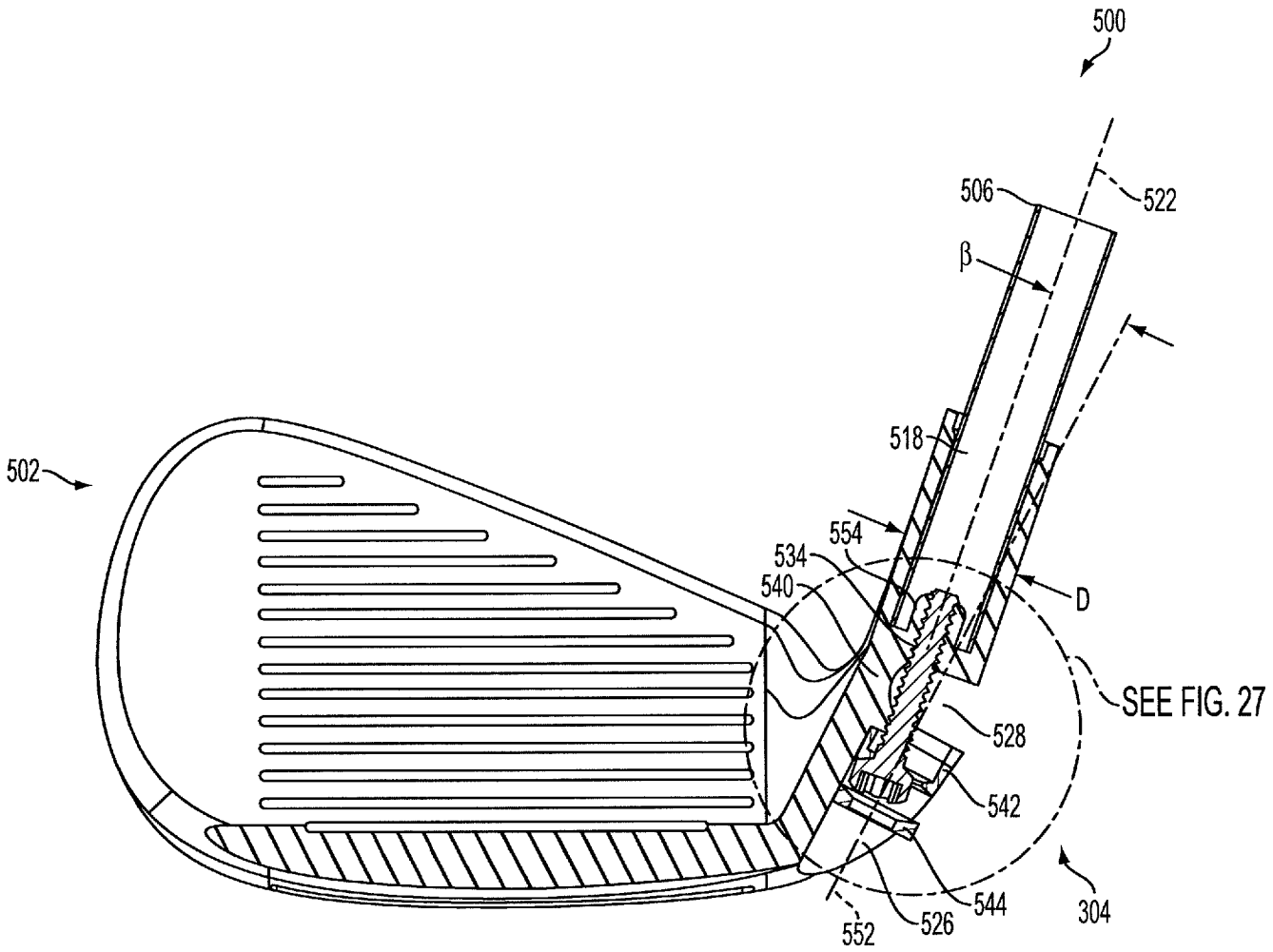
FIG. 26 shows a cross sectional view of another alternative exemplary embodiment of an adjustable golf club.
Figure 27:
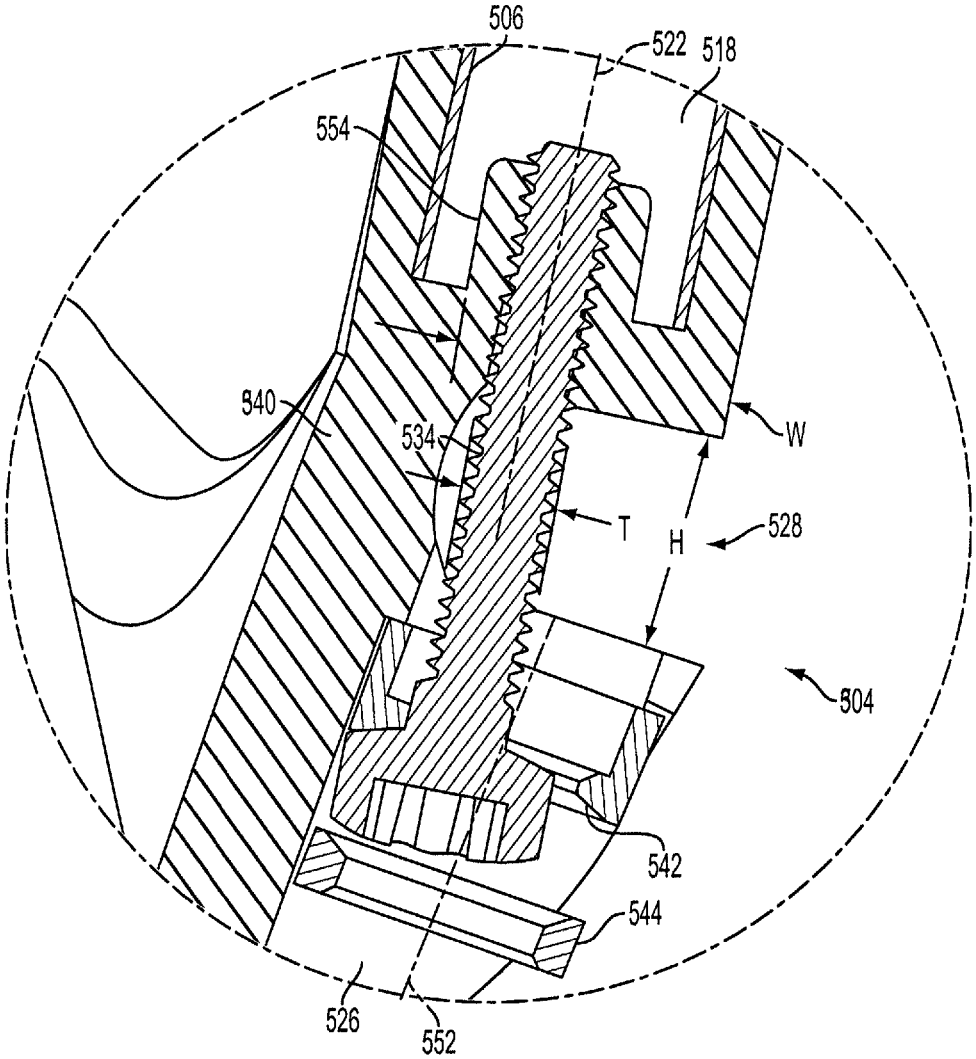
FIG. 27 shows an enlarged detailed partial cross sectional view of the adjustable golf club of FIG. 26.

FIGS. 26 and 27 show golf club head 500 as an alternative embodiment which includes a body 502 and a hosel 504. The hosel 504 has a shaft bore 518 having a central longitudinal axis 522 and which can accommodate a golf club shaft 506. The club head 500 also includes an adjustment bore 526 having a central longitudinal axis 552, which can accommodate a bearing pad 542 and a retaining ring 544. The club head 500 also includes a boss element 554 located at a distal end of the shaft bore 518 which can provide additional threads for engaging a threaded portion of an adjustment screw 534. The boss element 554 can be formed integrally with the rest of the hosel 504. For example, the boss element 554 can be formed as the hosel 504 is cast, or the boss element 554 can be machine cut from the hosel 504 after the hosel 504 is cast.

The golf club head 500 can be bent about a living hinge 540 by tightening or loosening the screw 534 in a manner similar to that described with respect to golf club head 400. Changes in angle β (FIG. 26), measuring the angular displacement between the longitudinal axis 522 of the shaft bore 518 and the longitudinal axis 552 of the adjustment bore 526, can indicate the degree to which the lie angle of the club head 500 has been adjusted. For example, a golf club can be fabricated, sold, and/or delivered with the golf club head 500 in a neutral configuration wherein the angle β is zero. In such a configuration, the angle β indicates the degree the lie angle has been adjusted from the neutral configuration.

FIGS. 26-27 illustrate that the hosel 504 can have a diameter D and can include a notch 528 having a height H and a width W. The screw 534 can be of a standardized size, and can be, for example, between a size M3 and a size M8 screw. The screw 534 can have a maximum thread diameter T of between about 3 and 8 mm. In some embodiments, the diameter D can be between about 12.3 mm and about 14.0 mm, or more specifically, between about 12.5 mm and 13.6 mm. The notch height H can be between 0.9 mm and 20.0 mm, between 0.9 mm and 15 mm, between 0.9 mm and 10 mm, between 0.9 mm and 5 mm, between 0.9 mm and 4 mm, between 0.9 mm and 3 mm, or between 0.9 mm and 2.5 mm. In some embodiments, the notch width W can be between 2.0 mm and 8.0 mm, between 3.0 mm and 6.0 mm, between 4.0 mm and 6.0 mm. In other embodiments, the notch width W can be greater than 6.25 mm, greater than 6.5 mm, greater than 6.75 mm, or greater than 7.00 mm. In some embodiments, the notch width W can be greater than half the hosel outer diameter D (W>0.5*D). In some embodiments, the width W can be greater than half the sum of the thread diameter T and the hosel diameter D. In some embodiments, the width W can be greater than the sum of the thread diameter T and half the hosel diameter D. Thus, the width W can be governed in different embodiments by the following equations:

$$W>0.5*D$$

$$W>0.5*(D+T)$$

$$W>T+(0.5*D)$$

The greater the distance W is, the less material is present in the living hinge 540, and thus less force is required to adjust the golf club head 500. In addition, the greater the distance W is, the longer the moment arm is between the screw 534 and the hinge 540, and thus less force is required to adjust the golf club head 500.

In some embodiments, the hosel outer diameter D can be between about 12.3 mm and about 14.0 mm, or more specifically, between about 12.5 mm and 13.6 mm. The notch height H can be between 0.9 mm and 20.0 mm, between 0.9 mm and 15 mm, between 0.9 mm and 10 mm, between 0.9 mm and 5 mm, between 0.9 mm and 4 mm, between 0.9 mm and 3 mm, or between 0.9 mm and 2.5 mm. In some embodiments, the notch width W can be between 2.0 mm and 8.0 mm, between 3.0 mm and 6.0 mm, between 4.0 mm and 6.0 mm. In other embodiments, the notch width W can be greater than 6.25 mm, greater than 6.5 mm, greater than 6.75 mm, or greater than 7.00 mm. In some embodiments, the notch width W can be greater than half the hosel outer diameter D(W>0.5*D).

Figure 30:
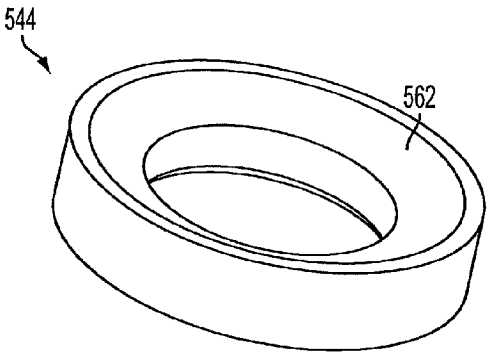
FIG. 30 shows one view of an exemplary retaining ring which can be used with adjustable golf club heads disclosed herein.
Figure 31:
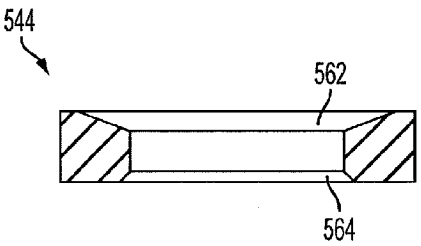
FIG. 31 shows a cross sectional view of the retaining ring of FIG. 30.
Figure 28:
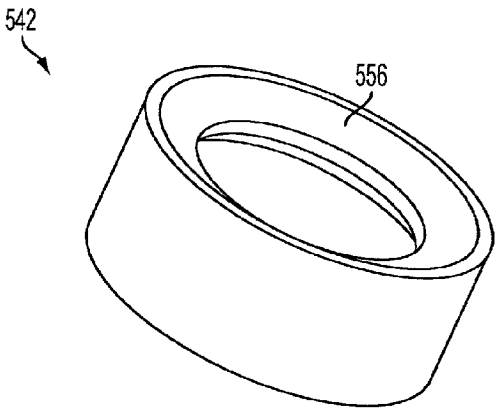
FIG. 28 shows one view of an exemplary bearing pad which can be used with adjustable golf club heads disclosed herein.
Figure 29:
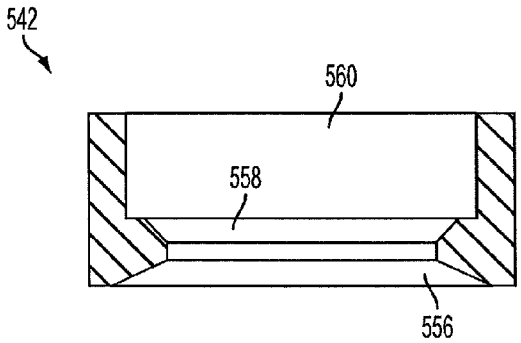
FIG. 29 shows a cross sectional view of the bearing pad of FIG. 28.

FIGS. 28 and 29 illustrate the bearing pad 542 in greater detail. As shown, the bearing pad 542 can include a spherical bearing or mating surface 556 for mating with the head of the screw 534. The bearing pad 542 can also include a chamfered edge 558 and a relief area 560. FIGS. 30 and 31 illustrate the retaining ring 544 in greater detail. As shown, the retaining ring 544 can include a spherical bearing or mating surface 562 for mating with the head of the screw 534 and a chamfered edge 564. The surfaces of the head of the screw that mate with the bearing pad and the retaining ring can have various shapes, for example, these surfaces can be generally spherically shaped.

Spherical surfaces such as bearing surfaces 556 and 562 are especially advantageous because they can help to ensure proper loading of the bearing pad 542 and retaining ring 544 as the club head 500 bends about hinge 540. That is, regardless of the degree to which bending at the hinge 540 causes the head of the screw 534 to move with respect to the bearing pad 542 or retaining ring 544, the head of the screw 534 will always have a complementary mating surface for bearing against either the bearing pad 542 or the retaining ring 544. For example, bearing pad 542 and retaining ring 544 can be desirable for use with embodiments of adjustable golf club heads in which both the lie angle and the loft angle are intended to be adjustable.

Figure 32:
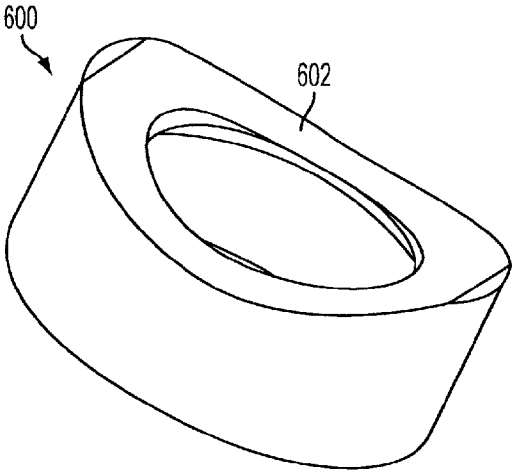
FIG. 32 shows one view of another exemplary bearing pad which can be used with adjustable golf club heads disclosed herein.
Figure 33:
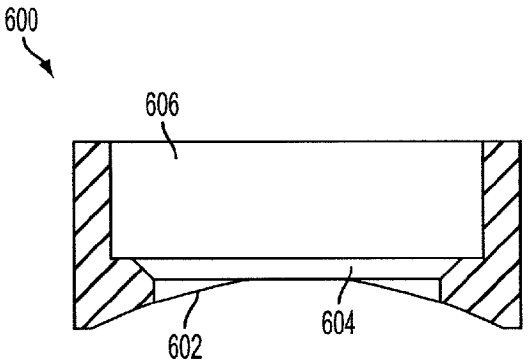
FIG. 33 shows a cross sectional view of the bearing pad of FIG. 32.
Figure 34:
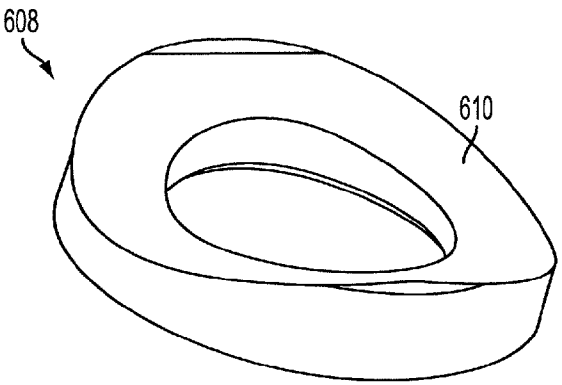
FIG. 34 shows one view of another exemplary retaining ring which can be used with adjustable golf club heads disclosed herein.
Figure 35:
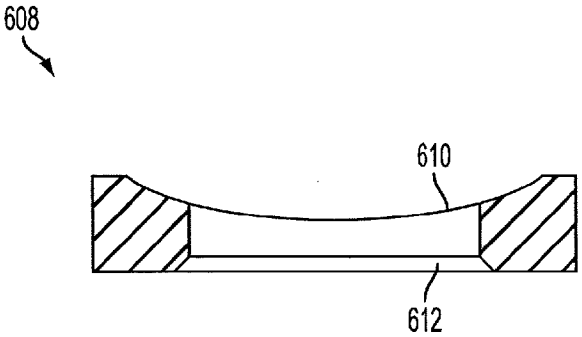
FIG. 35 shows a cross sectional view of the retaining ring of FIG. 34.

FIGS. 32 and 33 illustrate an alternative bearing pad 600 which can be used with golf club head 500 in place of bearing pad 542. As shown, the alternative bearing pad 600 can include a cylindrical bearing or mating surface 602 for mating with the head of the screw 534. The bearing pad 600 can also include a chamfered edge 604 and a relief area 606. FIGS. 34 and 35 illustrate an alternative retaining ring 608 which can be used with golf club head 500 in place of retaining ring 544. As shown, the retaining ring 608 can include a cylindrical bearing or mating surface 610 and a chamfered edge 612.

Cylindrical surfaces such as bearing surfaces 602 and 610 are advantageous in cases where movement of the head of the screw 534 is confined to a single dimension. In such cases, the dimension along which the head of the screw 534 is anticipated to move can be aligned with the cylindrical shape of the surfaces 602 and 610. In such a configuration, the head of the screw 534 will always have a complementary mating surface for bearing against either the bearing pad 600 or the retaining ring 608. For example, bearing pad 600 and retaining ring 608 can be desirable for use with embodiments of adjustable golf club heads in which only the lie angle is intended to be adjustable, with the cylindrical shape of surfaces 602 and 610 being aligned with an axis extending through the notch, screw, and hinge of the adjustable golf club head.

In some embodiments, the bearing pad and/or the retaining ring of a golf club head can be provided with a conical, rather than cylindrical or spherical bearing or mating surface for mating with the head of an adjustment screw. Such a surface can provide a different profile for contacting the head of the screw than spherical or cylindrical surfaces can provide.

In one alternative embodiment, a golf club head can have a threaded first opening connecting the adjustment bore to the notch, and an unthreaded second opening connecting the shaft bore to the notch. In such an embodiment, the head of the screw can be positioned within the adjustment bore, and the screw can thread through the first opening, extend across the notch and through the second opening, and terminate at a relatively wide or expanded tip situated within the shaft bore. The shaft bore can have a retaining ring situated therein, thus trapping the expanded tip of the screw at the distal end portion of the shaft bore. Thus, in a manner similar to that described above, by turning the screw in the threads of the first opening, the tip of the screw can be caused to either pull on the distal end of the shaft bore or push against the retaining ring situated within the shaft bore, thereby causing adjustments in the geometry of the golf club head. In one specific implementation, a set screw can be used in this alternative embodiment, in which case the head of the screw can be flush with its shaft.

In some embodiments, a filler element or cap can be inserted into the notch, in order to fill or enclose the space therein. In some cases, the filler element can be non-functional. In some cases, the filler element can improve the aesthetic properties of the adjustable golf club head by providing a flush surface or in other ways. In some cases, the filler element can provide additional rigidity and/or strength to the golf club head. Filler elements can be compliant, one-size fits all components which can be used with a golf club head as it is adjusted, or can come in a set of varying sizes such that as the golf club head is adjusted, different filler elements can be used to cover the notch based on the degree to which the club head has been adjusted. Filler elements are desirably configured to not interfere with the adjustability of the golf club head, and in some cases can be easily removable and replaceable.

In some embodiments, a golf club head can include adjustment range limiters which can limit the range of angles through which the lie or loft angles of the club head can be adjusted. An adjustment range limiter can prevent the living hinge being bent beyond a predetermined range and can thus help to prevent damage to and reduce fatigue in the hinge. As one example, a solid piece of material secured within the shaft bore can help to prevent an adjustment screw being tightened beyond a predetermined level. As another example, an adjustment screw can be configured so that it is impossible to loosen it beyond a predetermined level, for example, because it will run out of the threads in the opening between the notch and the shaft bore. In one specific embodiment, a golf club head can be fabricated in a neutral configuration and can be configured such that its lie angle is adjustable through a range of 5° in either direction, i.e., through a total range of 10°.

In some embodiments, a golf club head can include visual indicators which can indicate to a golfer the level to which the screw is tightened and thus the level to which the lie angle of the club head has been adjusted. For example, tabs, notches, or other indicators can be provided on each of the screw head and the hosel, the relative positions of which can indicate each degree, or each half degree, or each quarter degree of adjustment of the lie angle of the golf club head. In some cases, tabs, notches, or other indicators can be provided on the screw head, which can indicate how far the screw head has been turned. In some cases, notches or other indicators can be provided on the shaft of the screw in order to indicate the distance the shaft of the screw has traveled relative to other components of the golf club head.

The screws described herein can be either right-handed or left-handed screws. That is, depending on the particular screw used, turning the head of the screw clockwise can either tighten or loosen the screw.

FIGS. 21-27 illustrate an adjustable golf club head having a living hinge. A living hinge can be advantageous as a hinging mechanism because it experiences minimal friction and wear, and because it is relatively simple and cost effective to manufacture. Notably, the living hinge addresses current brute force methods using substantial force to plastically deform structurally strong hosel designs. While the disclosed embodiments significantly weaken the hosel itself by removing material to form a living hinge, the adjustment mechanism (which may be a screw in some embodiments) reinforces the structural integrity and strength of the hosel. In alternative embodiments, the principles, methods, and mechanisms described with regard to the living hinge of FIGS. 21-27 can be applied to other mechanisms for allowing a golf club head to be bent, including, for example, a rack and pinion system, a cam system, or any other mechanical hinging mechanism.

Adjustable golf club heads as described herein can be adjusted to improve a golfer's performance. For example, one method of adjusting a golf club head includes determining that a player's swing may benefit from an adjustment of the lie angle of one or more of their golf clubs, determining the amount of adjustment of the lie angle for the golf club to be adjusted, adjusting the golf club by turning a screw to cause the hosel to move toward or away from the club face, and ending the adjustment once the desired lie angle is obtained. In some cases, the adjustment can be ended when a visual indicator reveals that the desired lie angle has been achieved.

Various components of the golf club heads described herein can be formed from any of various appropriate materials. For example, components described herein can be formed from steel, titanium, or aluminum. Significant frictional forces can be developed between the surfaces of various components described herein as a golf club head is adjusted. Thus it can be advantageous if various components are fabricated from brass or other relatively lubricious materials, or if any of various surfaces are treated with any of various lubricants, including any of various wet or dry lubricants, with molybdenum disulfide being one exemplary lubricant. Frictional forces can help to ensure that the screw is not unintentionally tightened, loosened, or removed from the openings and the adjustment bore. Thus, various means can be used to advantageously increase frictional forces between various components. For example, chemical compounds or other thread locking components can be used for this purpose.

FIGS. 21-27 show adjustable iron-type golf club heads. In alternative embodiments, however, the features and methods described herein can also be used with a metalwood-type golf club head, or any type of golf club head generally. FIGS. 21-27 show a golf club head intended for use by a right-handed golfer. In alternative embodiments, however, any of the features and methods disclosed herein can also be used with a golf club head intended for use by a left handed golfer.

The components of the golf club heads described herein can be fabricated in any of various ways, as are known in the art of fabricating golf club heads. Features and advantages of any embodiment described herein can be combined with the features and advantages of any other embodiment described herein except where such combination is structurally impossible.

Figure 36:
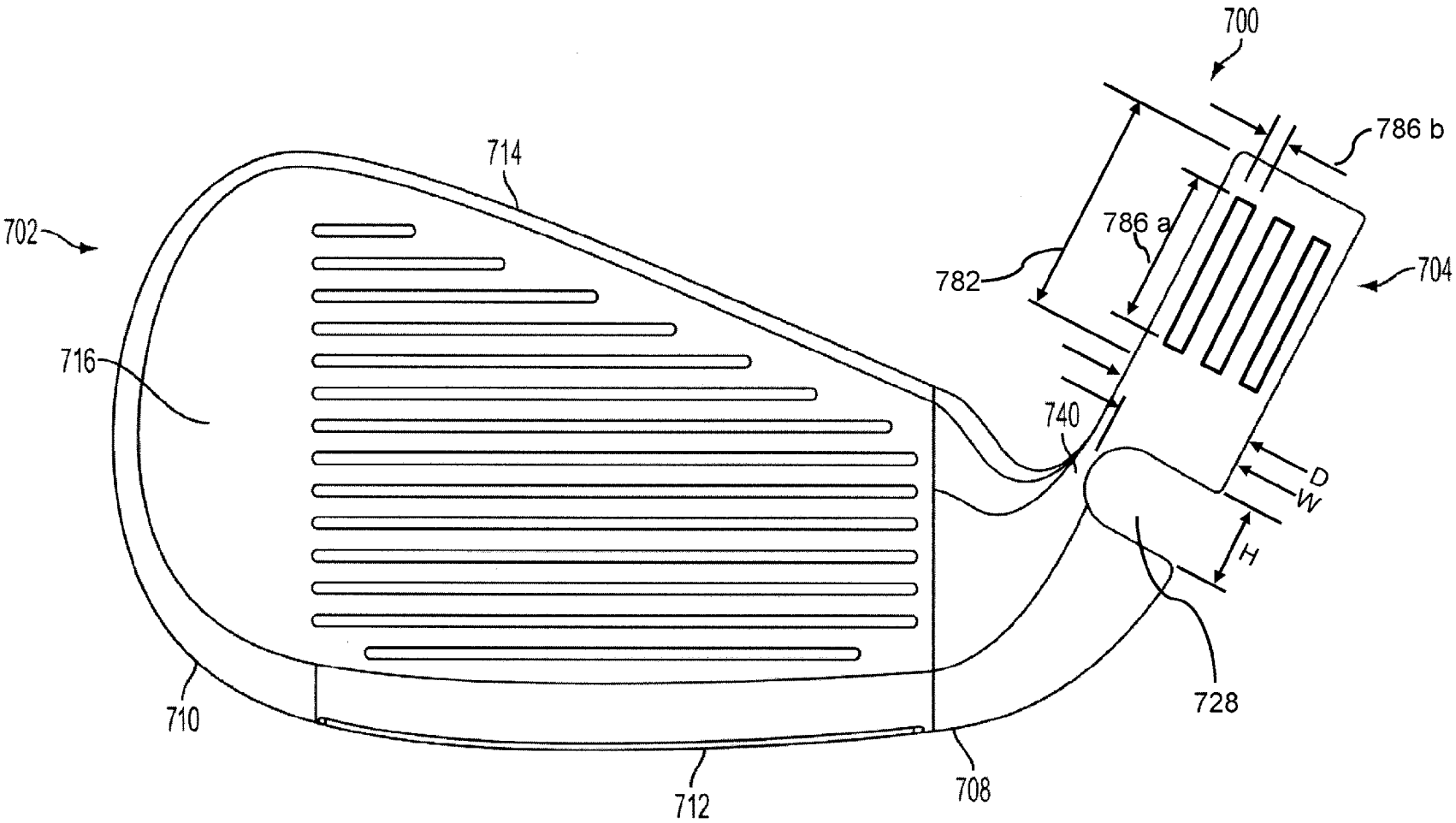
FIG. 36 shows an exemplary embodiment of an iron-type golf club head embodying another lightweight hosel design.

FIG. 36 shows an exemplary iron-type golf club head 700 which includes a body 702 and a hosel 704 configured to allow the club head 700 to be coupled to a shaft (not pictured). The golf club head 700 can include a heel portion 708, a toe portion 710, a sole portion 712, a topline portion 714, and a striking face portion 716 configured for striking golf balls. The iron-type golf club head 700 can further include a notch 728 in a hosel 704. As shown, the hosel 704 can have a narrow portion, or living hinge 740, in the region of the hosel 704 opposing the notch 728. The living hinge 740 can be formed as a continuous piece of material, formed integrally with the remainder of the hosel 704, and can be configured to provide a relatively flexible location about which the club head 700 can be bent.

The hosel 704 can further include a hosel weight reduction zone 782. This design is similar to the flute design shown in FIGS. **14*a*-14*c* and described by the corresponding text. Additionally, the iron-type golf club head 702 includes a notch 728. The notch 728 reduces the load required for bending of the loft angle and/or lie angle of the iron-type golf club head, which allows for even further mass savings in the hosel weight reduction zone 782. Notably, it was discovered on some designs that the hosel would fail during bending to adjust the loft angle and/or lie angle. This problem was solved by combining the notch 728 with the lightweight hosel design. The notch 728 is shown combined with the fluted hosel design for exemplary purposes. The notch 728** could be combined with any of the above lightweight hosel designs to achieve a similar function.

Similar to the discussion above, the design shown in FIG. 36 selectively removes material from the hosel creating flutes around the hosel perimeter and along the longitudinal axis of the hosel. The flutes allow for a mass savings of at least 1 g, such as at least 2 g, such as at least 3 g, such as at least 4 g. The design may incorporate multiple flutes, such as 2 or more flutes, such as 3 or more flutes, such as 4 or more flutes, such as 5 or more flutes, such as 6 or more flutes, such as 7 or more flutes, such as 8 or more flutes. The flute design and number of flutes has a direct effect on the amount of mass savings.

As shown, the flutes have a flute height **786*a* and a flute width 786*b*. As shown, there is a single row of flute features that encircle the hosel. More rows may be used, and the height 786*a* and width 786*b* may be varied. The flute height 786*a* may range from about 2 mm to about 30 mm and the width 786*b*** may range from about 1 mm to about 42 mm. The flute pattern extends from about 10 mm to about 30 mm. However, the flute pattern may extend further or less depending on the hosel length and desire to adjust the weight savings.

The flute design selectively reduces the hosel wall thickness by varying the outer hosel wall diameter. The outer hosel wall diameter ranges from about 11.6 mm to about 13.6 mm. The flute design like the honeycomb design is offset from the hosel top edge by about 2 mm to about 4 mm. The hosel bore diameter ranges from about 9.0 mm to about 9.6 mm resulting in a hosel wall thickness ranging from about 1.0 mm to about 2.3 mm. The flute pattern may have a length along the longitudinal axis of the hosel ranging from about 10 mm to about 30 mm. The pattern may extend further or less along the longitudinal axis of the hosel to adjust the weight savings. For example, a club with a longer hosel length, such as a sand wedge, the pattern may extend about 20 mm to about 50 mm.

The flute design may be angled relative to longitudinal axis of the hosel or it may be aligned with the longitudinal axis of the hose. The flute widths and flute heights may all be the same or vary along the hosel depending on the desired weight savings. The flute width is the horizontal distance measured from a first flute edge to a second flute edge, and the flute width is at least 1 mm and may range from about 1 mm to about 20 mm, preferably about 3 mm to about 5 mm. The flute length is the vertical distance measured from a top of the flute to a bottom of the flute, and the flute length is at least 4 mm and may range from about 5 mm to about 50 mm, such as about 10 mm to about 35 mm, such as about 15 mm to about 25 mm. Alternatively, a pattern of flutes having smaller flute lengths may be used instead of long flutes. For example, two or more flutes may be stacked on top of one another to create a flute pattern similar to the honeycomb pattern discussed above.

As shown in FIG. 36, the notch 728 has a height and a width similar to the notch discussed above in relation to FIGS. 21-27. The notch height H can range between 0.9 mm and 20.0 mm, between 0.9 mm and 15 mm, between 0.9 mm and 10 mm, between 0.9 mm and 5 mm, between 0.9 mm and 4 mm, between 0.9 mm and 3 mm, or between 0.9 mm and 2.5 mm. In some embodiments, the notch width W can range between 2.0 mm and 8.0 mm, between 3.0 mm and 6.0 mm, or between 4.0 mm and 6.0 mm. In other embodiments, the notch width W can be greater than 6.25 mm, greater than 6.5 mm, greater than 6.75 mm, or greater than 7.00 mm. In some embodiments, the notch width W can be greater than half the hosel outer diameter D (W>0.5*D).

The iron-type golf club head 702 further includes a bond length region of at least 10 mm and within the bond length region the hosel includes weight reducing features such that within the bond length region the hosel has a mass per unit length of less than about 0.45 g/mm. In other embodiments, the iron-type golf club head 702 hosel has a mass per unit length within the bond length region between 0.45 g/mm and 0.40 g/mm, between 0.40 g/mm and 0.35 g/mm, between 0.35 g/mm and 0.30 g/mm, or between 0.30 g/mm and 0.26 g/mm within the bond length region. In some embodiments, the iron-type golf club head and/or the hosel has a density between about 7,700 kg/m$^3$ and about 8,100 kg/m$^3$.

General Considerations

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

As used herein, the terms "a", "an" and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A," "B," "C," "A and B," "A and C," "B and C" or "A, B and C." As used herein, the term "coupled" generally means physically coupled or linked and does not exclude the presence of intermediate elements between the coupled items absent specific contrary language.

In view of the many possible embodiments to which the principles of this disclosure may be applied, it should be recognized that the illustrated embodiments are only preferred examples and should not be taken as limiting the scope of the inventions.

Rather, the scope of the invention is defined by the following claims. We therefore claim all that comes within the scope and spirit of these claims.

We claim:

1. A golf club head for an iron-type golf club, comprising:

a body including a heel portion, a sole portion, a toe portion, a top-line portion, and a face portion, wherein said sole portion extends rearwardly from a lower end of said face portion;

a hosel having a hosel top edge, a bond length region, an outside diameter and the hosel defining a hosel bore for receiving one end of a golf club shaft, said hosel bore having a longitudinal axis and a desired orientation relative to said body, said hosel having a neck connected to said heel portion of said body; and a notch having a height H and a width W, wherein the height H is between 0.9 mm and 5 mm, and the width W is between 2.0 mm and 8.0 mm, and wherein the notch is formed in the hosel;

wherein the bond length region of the hosel extends from about the hosel top edge along the longitudinal axis of the hosel bore to a point on the hosel that is at least 10 mm from the hosel top edge, wherein within the bond length region the hosel has a mass per unit length of less than about 0.45 g/mm.

2. The golf club head of claim 1, wherein within the bond length region the hosel has a mass per unit length of less than about 0.40 g/mm.

3. The golf club head of claim 1, wherein within the bond length region the hosel has a mass per unit length of less than about 0.35 g/mm.

4. The golf club head of claim 1, wherein within the bond length region the hosel has a mass per unit length of less than about 0.30 g/mm.

5. The golf club head of claim 1, wherein within the bond length region the hosel has a mass per unit length of less than about 0.26 g/mm.

6. The golf club head of claim 1, wherein the hosel has a density between about 7,700 kg/m$^3$ and about 8,100 kg/m$^3$.

7. The golf club head of claim 1, wherein the notch extends inward from a periphery of the hosel toward the longitudinal axis of the hosel bore.

8. A golf club head for an iron-type golf club, comprising:

a golf club body, the golf club body including a hosel, a top-line portion, a toe portion, a heel portion, and a sole portion;

a hosel having a hosel top edge, a hosel length, and a bond length region, wherein the hosel defines a hosel bore, and wherein the hosel has a neck connected to the heel portion of the golf club head body;

a striking face connected to the golf club body, the striking face including a striking surface defining a plurality of grooves; and a notch having a height H and a width W, wherein the height H is between 0.9 mm and 5 mm, and the width W is between 2.0 mm and 8.0 mm, wherein the bond length region is offset from the hosel top edge along a longitudinal axis of the hosel bore by about 0 mm to about 5 mm, wherein the hosel bond length region extends along the longitudinal axis of the hosel bore toward the heel portion for about 20 mm to about 30 mm, and wherein the notch is formed in the hosel and extends inward from a periphery of the hosel;

wherein a top portion of the hosel has a length of about 28.0 mm and a mass less than about 12.5 grams.

9. The golf club head of claim 8, wherein the top portion of the hosel has a mass less than about 12.0 grams.

10. The golf club head of claim 8, wherein the top portion of the hosel has a mass less than about 11.5 grams.

11. The golf club head of claim 8, wherein the top portion of the hosel has a mass less than about 11.0 grams.

12. The golf club head of claim 8, wherein the top portion of the hosel has a mass less than about 10.5 grams.

13. The golf club head of claim 8, wherein the top portion of the hosel has a mass less than about 10.0 grams.

14. The golf club head of claim 8, wherein the top portion of the hosel has a mass less than about 9.5 grams.

15. The golf club head of claim 8, wherein the hosel has a density between about 7,700 kg/m$^3$ and about 8,100 kg/m$^3$.

16. The golf club head of claim 8, wherein the top portion of the hosel extends from the hosel top edge along the longitudinal axis of the hosel bore toward the heel portion.

17. The golf club head of claim 8, wherein the face portion has a toe face height of at least 50 mm and a heel face height of at least 30 mm.

18. The golf club head of claim 8, wherein the hosel length is at least 60 mm.

19. A golf club head for an iron-type golf club, comprising:

a body including a heel portion, a sole portion, a toe portion, a top-line portion, and a face portion, wherein said sole portion extends rearwardly from a lower end of said face portion; and a hosel having a hosel top edge, a hosel length, a weight reducing region, an outside diameter and the hosel containing a hosel bore for receiving one end of a golf club shaft, said hosel bore having a longitudinal axis and a desired orientation relative to said body, said hosel having a neck connected to said heel portion of said body; and a notch having a height H and a width W, wherein the height H is between 0.9 mm and 5 mm, and the width W is between 2.0 mm and 8.0 mm, and wherein the notch is formed in the hosel and extends inward from a periphery of the hosel, opposite the body, toward the body;

wherein the weight reducing region of the hosel extends from about the hosel top edge along the longitudinal axis of the hosel bore to a point on the hosel that is at least 10 mm from the hosel top edge, wherein within the weight reducing region the hosel includes a weight reducing feature, and wherein within the weight reducing region the hosel has a mass per unit length of less than about 0.40 g/mm wherein the hosel has a density between about 7,700 kg/m$^3$ and about 8,100 kg/m$^3$.

20. The golf club head of claim 19, wherein the weight reducing feature comprises one or more flutes having a length of at least 10 mm and a width of at least 1.0 mm.

21. The golf club head of claim 19, wherein the weight reducing feature comprises one or more thru-slot having a length of at least 10 mm and a width of at least 1.0 mm.

* * * * *